United States Patent [19]

Takamura

[11] Patent Number: 4,887,412

[45] Date of Patent: Dec. 19, 1989

[54] WRAPPING MACHINE

[75] Inventor: Yoshiyuki Takamura, Nagoya, Japan

[73] Assignee: Fuji Pack Systems, Ltd., Nagoya, Japan

[21] Appl. No.: 228,959

[22] Filed: Aug. 4, 1988

[30] Foreign Application Priority Data

Aug. 7, 1987 [JP] Japan ..... 62-198651
Jan. 13, 1988 [JP] Japan ..... 63-6538

[51] Int. Cl.[4] ..... B65B 59/02

[52] U.S. Cl. ..... 53/504; 53/66; 53/137; 53/168; 53/228; 53/389

[58] Field of Search ..... 53/504, 66, 168, 222, 53/228, 389, 64, 137

[56] References Cited

U.S. PATENT DOCUMENTS

| | | | |
|---|---|---|---|
| 4,501,106 | 2/1985 | Treiber et al. | 53/504 X |
| 4,505,092 | 3/1985 | Bowers et al. | 53/168 |
| 4,622,802 | 11/1986 | Takamura | 53/228 X |
| 4,631,903 | 12/1986 | Takamura | 53/228 X |
| 4,748,800 | 6/1988 | Takamura | 53/222 X |

FOREIGN PATENT DOCUMENTS

| | | | |
|---|---|---|---|
| 0044820 | 1/1982 | European Pat. Off. | 53/504 |

*Primary Examiner*—James F. Coan
*Attorney, Agent, or Firm*—Stephen G. Rudisill

[57] ABSTRACT

A wrapping machine used to wrap with a prescribed wrapper a commodity having the shape of a hexahedron having a length, a width, and a height, as well as a top surface, a bottom surface, a front surface, a rear surface, a right side surface, and a left side surface; in this wrapping machine, the commodity being wrapped in a wrapping region, this wrapping region having a central position along the length of the commodity, and a reference wrapping position along the width of the commodity; the wrapping machine further comprising: a wrapping supply device that holds at least two wrappers of different sizes, and selectively supplies either of the wrappers to the wrapping region; a sensing device, provided in the wrapper supply device, that detects the sizes of the wrappers; a control device electrically connected to the sensing device, as well as operationally connected to the wrapper supply device; this control device has a display device, and it determines whether the sizes of the wrappers are within the usable range for wrapping the commodity or not; when the sizes of two or more of the wrappers are within the usable range for wrapping the commodity, it drives the wrapper supply device to supply either of the wrappers to the wrapping region; when only one of the wrappers has the size within the usable range for wrapping the commodity, it drives the wrapper supply device to supply the usable wrapper to the wrapping region; when neither of the sizes of the wrappers is within the usable range for wrapping the commodity, it displays the size of the wrapper capable of wrapping the commodity on the display device; and a wrapper folding device provided near the vicinity of the wrapping region that wraps the commodity in the wrapping region with the wrapper supplied from the wrapper supply device.

12 Claims, 51 Drawing Sheets

WRAPPING MACHINE

FIELD OF THE INVENTION

The present invention relates to a wrapping machine that automatically wraps a commodity with a piece of wrapper.

DESCRIPTION OF THE RELATED ART

As a method of wrapping a commodity with a piece of wrapper, wrapping by hand allows a variety of complicated folding and wrapping. However, there is a limitation when it comes to mechanical wrapping, and a wrapping machine that can mechanically and automatically wrap a commodity with considerable folding compexity has not yet been invented.

SUMMARY OF THE INVENTION

An object of the present invention is to provide a wrapping machine that can mechanically and automatically wrap a commodity with considerable folding complexity.

One other object of the present invention is to provide a wrapping machine that can wrap a large variety of commodities of different dimensions using a small variety of wrappers having different sizes.

In order to realize the objects mentioned above, in the wrapping machine used to wrap with a prescribed wrapper a commodity having the shape of a hexahedron having a length, a width, and a height, as well as a top surface, a bottom surface, a front surface, a rear surface, a right side surface, and a left side surface:

the commodity is wrapped in a wrapping region, this wrapping region having a central position along the length of the commodity, and a reference wrapping position along the width of the commodity;

the wrapping machine further comprises:

a wrapper supply means that holds at least two wrappers of different sizes, and selectively supplies either of the wrappers to the wrapping region, a sensing means, provided in the wrapper supply means, that detects the sizes of the wrappers, a control means electrically connected to the sensing means, as well as operationally connected to the wrapper supply means; this control means has a display means, and it determines whether the sizes of the wrappers are within the usable range for wrapping the commodity or not; when the sizes of two or more of the wrappers are within the usable range for wrapping the commodity, it drives the wrapper supply means to supply either of the wrappers to the wrapping region; when only one of the wrappers has the size within the usable range for wrapping the commodity, it drives the wrapper supply means to supply the usable wrapper to the wrapping region; when neither of the sizes of the wrappers is within the usable range for wrapping the commodity, it displays the size of the wrapper capable of wrapping the commodity on the display means, and a wrapper folding means provided near the vicinity of the wrapping region that wraps the commodity in the wrapping region with the wrapper supplied from the wrapper supply means.

Other objects of the present invention will become clear with an understanding of the embodiments described later, and as specified in the appended claims. Further, many advantages not mentioned in this specification will become obvious to one skilled in the art upon application of the present invention.

BRIEF DESCRIPTION OF THE DRAWINGS

FIG. 2 is a partially broken plane view showing the wrapped conveyor;

FIG. 3(*a*) is a partially broken side view of the same;

FIG. 3(*b*) is a partial plane view of FIG. 2;

FIG. 3(*c*) is an enlarged partial sectional view as seen from the line X—X of FIG. 3(*b*);

FIG. 3(*d*) is a partial plane view showing a wrapper after it has been folded;

FIG. 3(*e*) is sectional view of FIG. 3(*d*), showing a commodity raising a wrapper;

FIG. 4 is a partially broken plane view showing the wrapper support portion of a wrapper conveying mechanism;

FIG. 5 is a partially broken side view of the same;

FIG. 6 is a partially broken side view showing the wrapper conveying guide portion of a wrapper conveying mechanism;

FIG. 7 is a partially broken side view showing a portion of FIG. 6;

FIG. 8 is a partially broken back view of the wrapper conveying guide portion;

FIG. 9 is a partially broken plane view showing a commodity receiving base mechanism;

FIG. 10 is a partially broken side view showing a portion of FIG. 9;

FIG. 11 is a partially broken front view showing a portion of FIG. 9;

FIG. 12(*a*), (*b*) are partially broken plane views showing a commodity conveyor;

FIG. 13 is a partially broken side view showing a portion of FIG. 12(*a*), (*b*);

FIG. 14 is a partially broken plane view showing front and rear bottom surface first folding plates and a tape applying mechanism;

FIG. 15 is a partial plane view of FIG. 14;

FIG. 16(*a*), (*b*) are partially broken plane views showing front and rear bottom surface second folding plates, front and rear surface first folding plates, and front and rear surface second folding plates, as well as a wrapper dispensing device;

FIG. 17 is a partially broken front view showing bottom surface front and rear second folding plates, rear surface first folding plates, and a rear surface second folding plates;

FIG. 18 is a partially broken side view of FIG. 17;

FIG. 19 is a partial plane view of FIG. 17;

FIG. 20 is a partially broken front view showing the bottom surface front second folding plates, front surface first folding plates, and front surface second folding plates;

FIG. 21 is a partially broken side view of FIG. 20;

FIG. 22 is a partial plane view of FIG. 20;

FIGS. 23(*a*), (*b*), (*c*), and (*d*) are operation diagrams showing the positional adjustments of the front and rear surface first folding plates according to the changes in the width and height of the commodity;

FIG. 24(*a*), (*b*) are a partially broken side views showing a commodity discharging mechanism;

FIG. 27 is a partially broken right side view showing one of the tape applying mechanisms, FIG. 28 is a partially broken rear view of the same, FIG. 29 is a tape application operation corresponding to FIG. 27, FIG. 43 is a partial plane view showing the same mechanism, FIG. 44 is an enlarged partially broken plane view of FIG. 43, FIG. 45 is an enlarged view seen from the point Y in FIG. 43, FIG. 46(*a*), (*b*), (*c*), (*d*) partial plane views showing the commodity discharging operation, FIG. 47 is a partial plane view in which a part of the tension giving mechanism is added to the tape disposing mechanism, FIG. 48 is a partial plane view showing this tension giving mechanism, FIG. 49 is a partial view seen from the point Z in FIG. 48, FIG. 50 is a partial view seen from Z2—Z2 in FIG. 48, FIG. 51(*a*), (*b*) are partial views showing the tension giving operation, FIG. 52 is a view corresponding to FIG. 27, FIG. 53 is a view corresponding to FIG. 28, FIG. 54 is a partial view of FIG. 52 showing the locked state of the tape drawing rollers, FIG. 55 is a partial view showing the unlocked state of the tape drawing roller, and FIG. 56 is a view corresponding to FIG. 29.

DESCRIPTION OF THE PREFERRED EMBODIMENTS

[First Embodiment]

Below, a wrapping machine related to the first embodiment of the present invention is described with reference to FIG. 1(*a*) to FIG. 35.

Wrapper Supplying Device A

First, the wrapper supplying device A is described with reference to FIG. 1 to FIG. 8.

Figure 2:
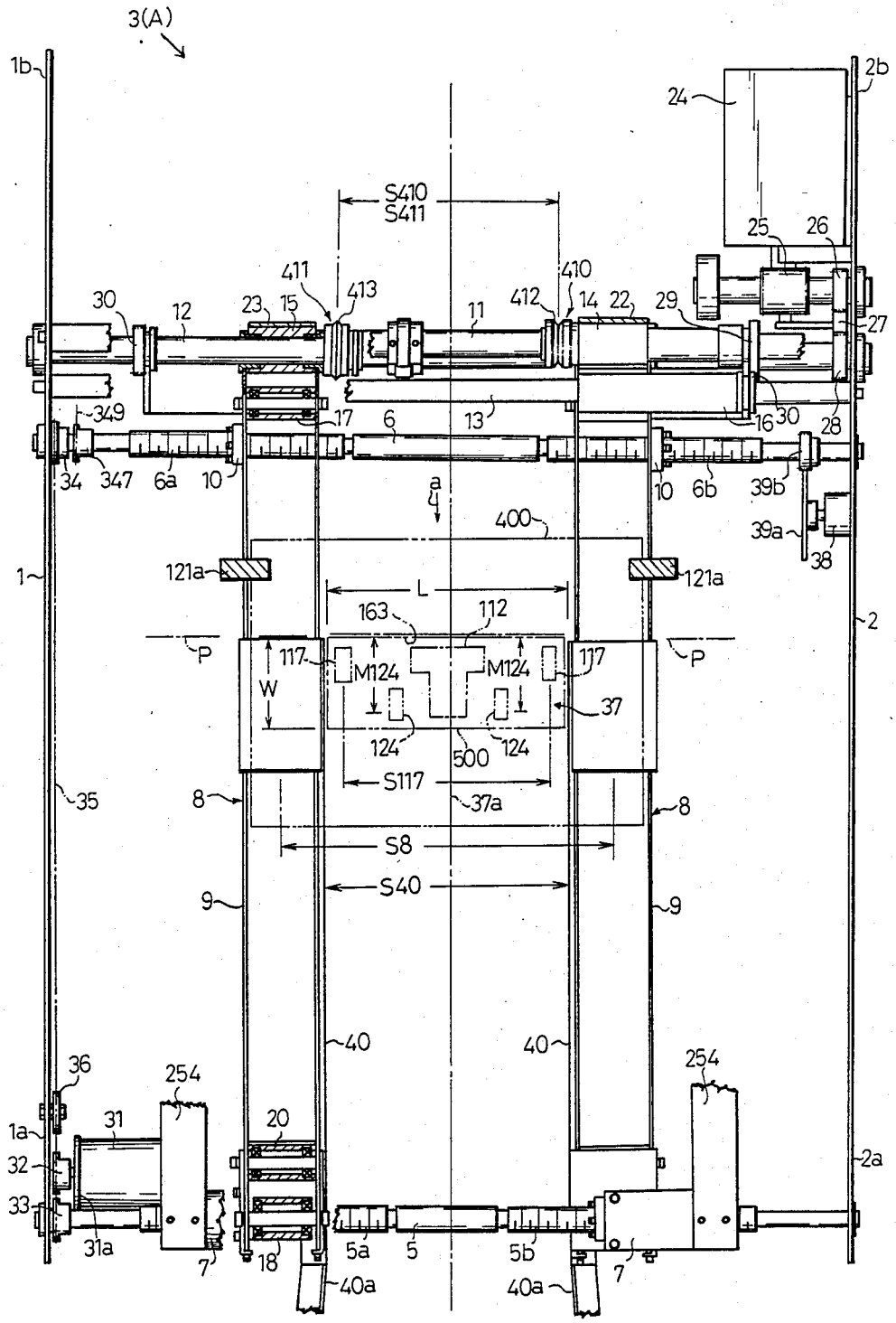
FIG. 2 to FIG. 8 show the wrapper supply device.
Figure 3A:
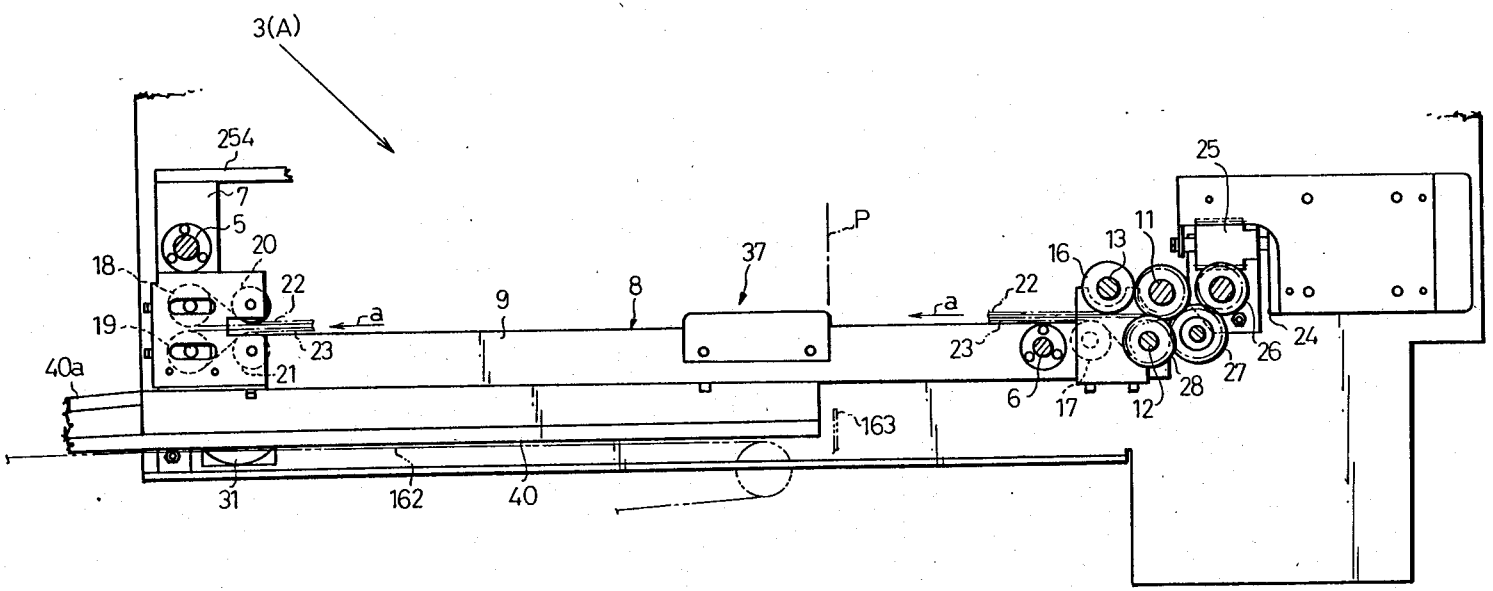
Figure 3:
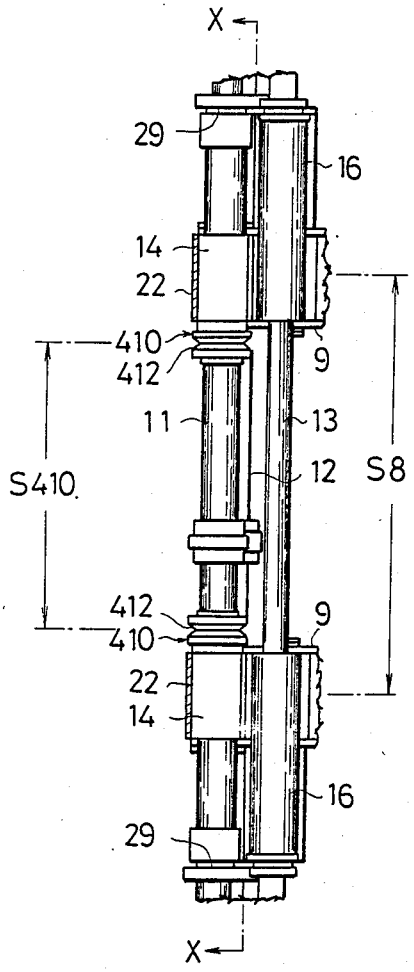
Figure 3:
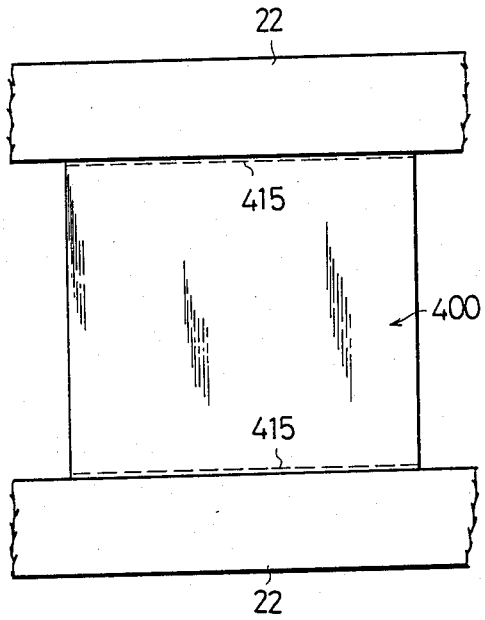
Figure 3E:
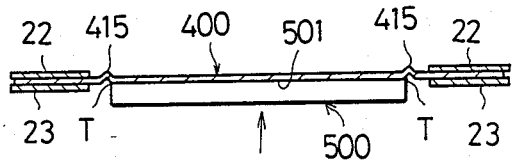
Figure 3:
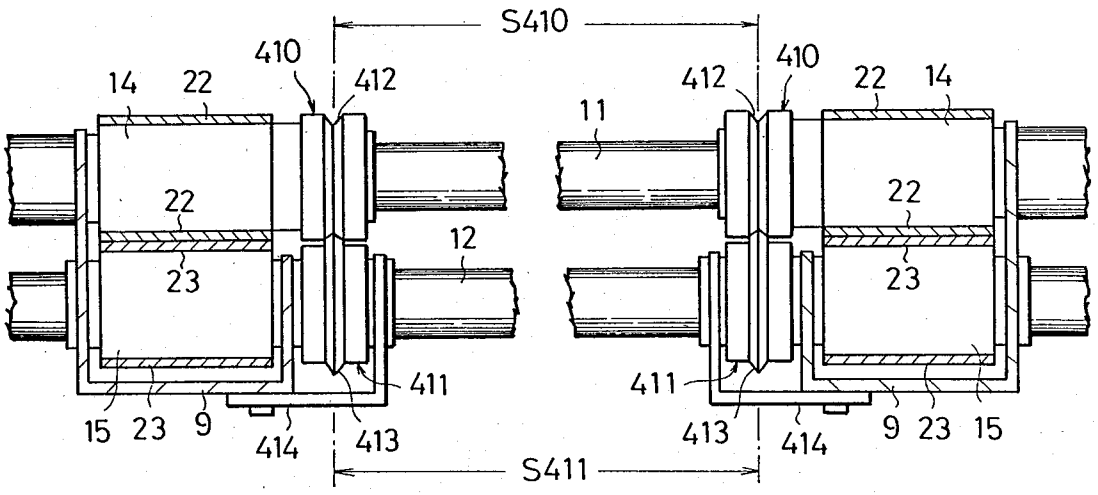

The wrapper supply device A comprises a wrapper conveyor 3 provided horizontally between the left and right machine frames 1, 2 (refer to FIG. 2 and FIGS. 3(*a*)–(*e*)), and a wrapper dispensing mechanism 4 provided between the rear end portions 1*b*, 2*b* of the left and right machine frames 1, 2 (refer to FIG. 4 to FIG. 8).

The wrapper conveyor 3 is described in detail with reference to FIG. 2 and FIGS. 3(*a*)–(*e*).

Rotating shafts 5, 6 extending laterally in the horizontal direction are provided between the front end portions 1*a*, 2*a*, and the rear end portions 1*b*, 2*b* of the left and rigth machine frames 1, 2. Threaded portions 5*a*, 6*a*, and threaded portions 5*b*, 6*b* (threaded in the reverse direction of the threaded portions 5*a*, 6*a*) are formed on the left and right sides, respectively, of both rotating shafts 5, 6. Both threaded portions 5*a*, 5*b* of the front rotating shaft 5 are screwed to female screw pieces 7. To the left and right sides of the front and rear rotating shafts 5, 6, conveyor belt portions 8 extend along the front-to-back direction, the front end portions of the outer frames 9 of both conveyor portions 8 being fixed to the lower side of both female screw pieces 7. The rear rotating shaft 6 passes through the back portions of both outer frames 9, with the female screw pieces 10 fixed to the back portion of both outer frames 9 being screwed to both threaded portions 6*a*, 6*b* of this rotating shaft 6.

A driving shaft 12 is provided on the lower portion behind the back rotating shaft 6, between the back end portions 1*b*, 2*b* of the left and right machine frames 1, 2. Also, on the upper portion, an irrotational support shaft 11 and a tension shaft 13 are provided. On the lower driving shaft 12, lower driving pulleys 15 are supported within the outer frames 9 of both conveyor portions 8, such that they are integrally rotatable, as well as movable with both outer frames 9 in the direction of the length of the shaft. On the upper support shaft 11, upper driving pulleys 14 are supported within the outer frames 9 of the conveyor portions 8, such that they are rotatable, as well as movable with both outer frames 9 in the direction of the length of the shaft. Tension pulleys 16 are rotatably supported on the left and right sides of the tension shaft 13, with both outer frames 9 being fitted to these tension pulleys 16 such that both outer frames 9 are movable in the direction of the length of the shaft. On the back end portions of both outer frames 9, tension pulleys 17 are supported below the tension pulleys 16. Upper and lower follower pulleys 18, 19 and upper and lower tension pulleys 20, 21 are supported on the front end portions of both outer frames 9. Upper and lower conveyor belts 22, 23 are passed over between these upper and lower follower pulleys 18, 19 and the upper and lower driving pulleys 14, 15 via the tension pulleys 16, 17, 20, 21. A driving motor 24 is provided at the inner side of the back end portion 2b of the right machine frame 2. The rotation of this motor is transmitted to the lower driving shaft 12 by means of gears 25, 26, 27, 28, and others, and the rotation of this lower driving shaft 12 is further transmitted to the upper driving pulley 14 by means of the left and right gears 29, 30. Then, when the lower driving shaft 12 rotates, the upper and lower conveyor belts 22, 23, both mutually touching, are induced to rotate in the direction of the arrow a.

A motor 31, used for setting the lateral positions of the belt conveyor portions is provided on the inner side of the front end portion 1a of the left machine frame 1. An interlocking chain 35 spans the interval between a driving sprocket 32 fixed to the output shaft 31a of the motor 31 and follower sprockets 33, 34 via a tension sprocket 36. The rotation of the output shaft 31a of the motor 31 is transmitted to the rotatable shafts 5, 6 by means of this interlocking chain 35. Then, when the rotatable shafts 5, 6 rotate, the female screw pieces 7, 10 move along the threaded portions 5a, 5b, 6a, 6b such that the left and right conveyor belt portions 8 mutually approach each other toward the central position 37a of the wrapping region 37 between these conveyor belt portions 8.

A position detecting potentiometer 38 is provided on the inner side of the right machine frame 2, near the vicinity of the rear rotatable shaft 6. This potentiometer 38 is linked to the rotatable shaft 6 by means of gears 39a, 39b.

Commodity guide plates 40 extending in the front-to-back direction are provided on the inner sides of the outer frames 9 of the conveyor belt portions 8, their front portions 40a protruding from the front end portions of the outer frames 9. These commodity guide plates 40 are movable in the lateral direction, together with the conveyor belt portions 8.

On the support shaft 11 and driving shaft 12, crease marking rollers 410, 411 are provided next to the outer frames 9 of the conveyor portions 8. The crease marking rollers 411 on the driving shaft 12 are attached to the outer frames 9 through brackets 414, and supported such that they are integrally rotatable with the driving shaft 12 and, together with the outer frames 9, movable in the direction of the length of the shaft. Protruding portions 413 in the shape of a V are formed on the outer circumferences of the crease marking rollers 411, spanning continuously throughout their perimeters. Also, the crease marking rollers 410 on the support shaft 11 are attached to the upper driving pulleys 14, and supported such that they are rotatable with the support shaft 11, and together with the outer frames 9, movable in the direction of the length of the shaft. Recessed grooves 412 in the shape of a V are formed on the outer circumferences of the crease marking rollers 410, spanning continuously throughout their perimeters. The recessed grooves 412 and the protruding portions 413 mutually fit into each other. These recessed grooves 412 and protruding portions 413 are situated on the path along the conveying direction a of a wrapper 400, within the opposing inner edges of the pair of conveyor belts 22, 23. The intervals S410, S411 between the recessed grooves 412 of the pair of left and right crease marking rollers 411, and between the protruding portions 413 of the pair of left and right crease marking rollers 411 are the same as the interval S40 between the pair of left and right commodity guide plates 40.

The rotatable shafts 5, 6, the female screw pieces 7, 10, the motor 31 used for setting the lateral position of the belt conveyor portions, the interlocking chain 35, and others constitute a mechanism for adjusting the lateral interval S8 of the belt conveyor portions 8, the lateral intervals S410, S411 of the crease marking rollers 410, 411, as well as the lateral interval S40 of the commodity guide plates 40, relative to the lateral central position 37a of the wrapping region 37, according to the lateral length L of the commodity 500.

The wrapper despensing mechanism 4 is described in detail with reference to FIG. 4 to FIG. 8.

Figure 4:
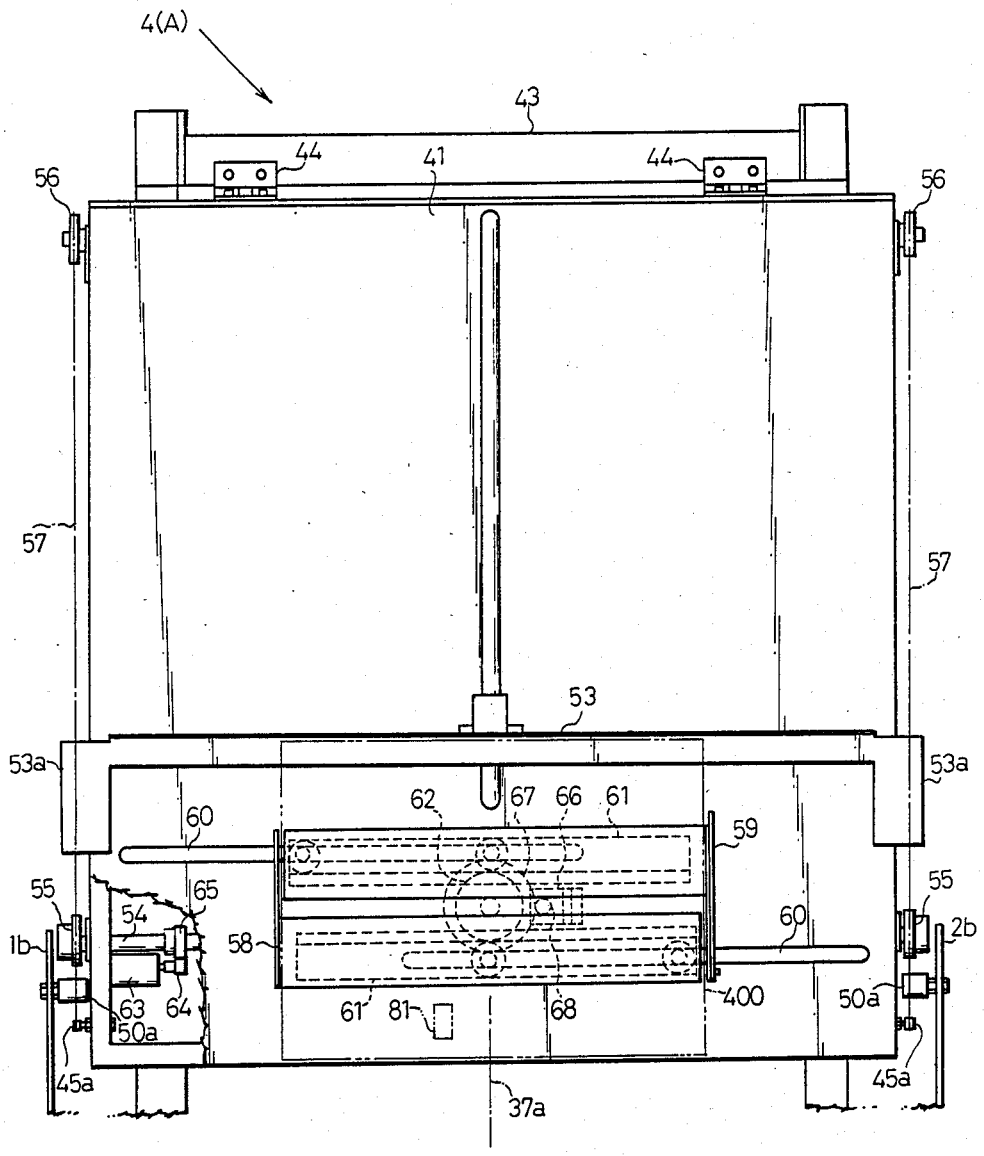
Figure 5:
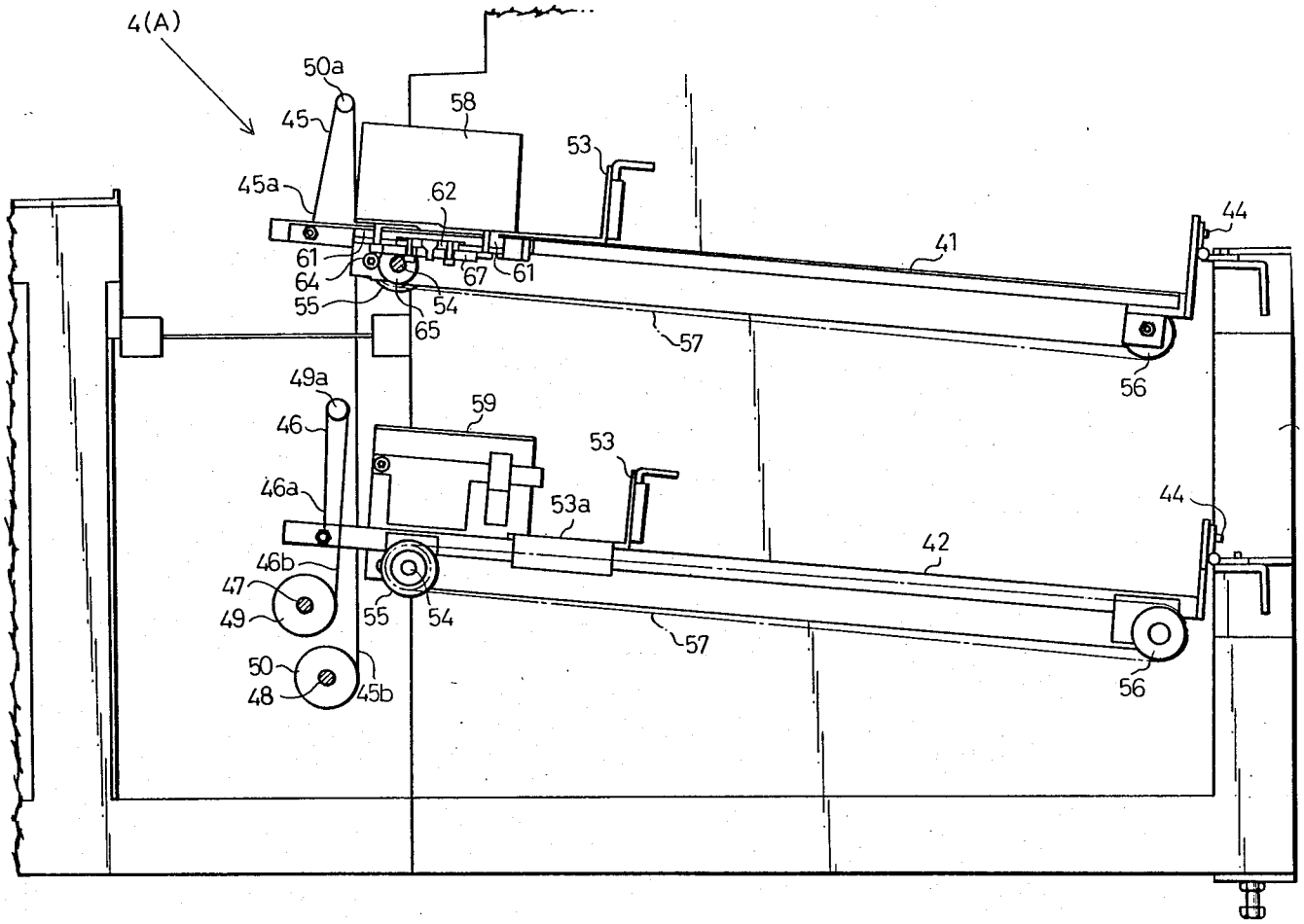

As shown in FIG. 4 and FIG. 5, an upper and lower support bases 41, 42 are connected by means of hinges 44 at their rear end portions to the frame body 43, such that they are movable upward or downward, and on the left and right sides at their front portion, the ends 45a, 46a of the suspension wires 45, 46 are connected. A pair of upper and lower rotatable shafts 47, 48 are provided on the lower portion between the rear end portions 1b, 2b, spanning the interval between the left and right machine frames 1, 2. A pair of reel drums 49, 50 are fixed at the left and right ends of these shafts 47, 48, on which the other ends 45b, 46b of the suspension wires 45, 46 are wound, after passing through rollers 49a, 50a respectively. These two rotatable shafts 47, 48 are linked to wire winding motors 51, 52 provided on the left and right machine frames 1, 2. When the rotatable shafts 47, 48 rotate with the operation of these motors 51, 52, the support bases 41, 42 are tilted upward or downward by means of the suspension wires 45, 46.

A rear position defining plate 53, movable forward and backward, is placed on both support bases 41, 42, and supported such that guide portions 53a at their left and right ends are movable along the left and right side edges of the support bases 41, 42. On the lower sides of the front end portions of the upper and lower support bases 41, 42, interlocking shafts 54 are rotatably provided, with interlocking chains 57 fitted between sprockets 55 fixed to the left and right ends of these shafts 54, just outside the support bases 41, 42, and sprockets 56 supported at the left and right sides of the rear end portions of the support bases 41, 42. The guide portions 53a of the rear position defining plates 53 are connected to the interlocking chains 57. When an operator moves the rear position defining plates 53 forward or backward, the interlocking shafts 54 rotate through the action of the interlocking chains 57.

Left and right position defining plates 58, 59 in front of the rear position defining plates 53 are supported on the lower and upper support bases 41, 42, such that they are movable in the lateral direction, along elongated holes 60. Rack plates 61 are fitted through the elongated holes 60 below the support bases 41, 42, on the lower portion of the position defining plates 58 59, with a pinion 62 being meshed between these two rack plates 61. When an operator moves either of the left and right position defining plates 58, 59 in the lateral direction, the left and right position defining plates 58, 59 approach each other toward the lateral central position 37a of the wrapping region 37 through the action of the rack plates 61 and the pinion 62.

Near the vicinity of the interlocking shafts 54, wrapper size detecting potentiometers 63 are provided on the left side of the upper and lower support bases 41, 42, and linked to the interlocking shaft 54 by means of gears 64, 65. Also, near the vicinity of the pinion 62, wrapper size detecting potentiometers 66 are provided below the upper and lower support bases 41, 42, and linked to the pinion 62 by means of gears 67, 68.

Two types of wrappers 400 having different sizes are placed on the upper and lower support bases 41, 42, and the respective position defining plates 53, 58, 59 are moved and adjusted according to the size of the wrapper 400.

Figure 6:
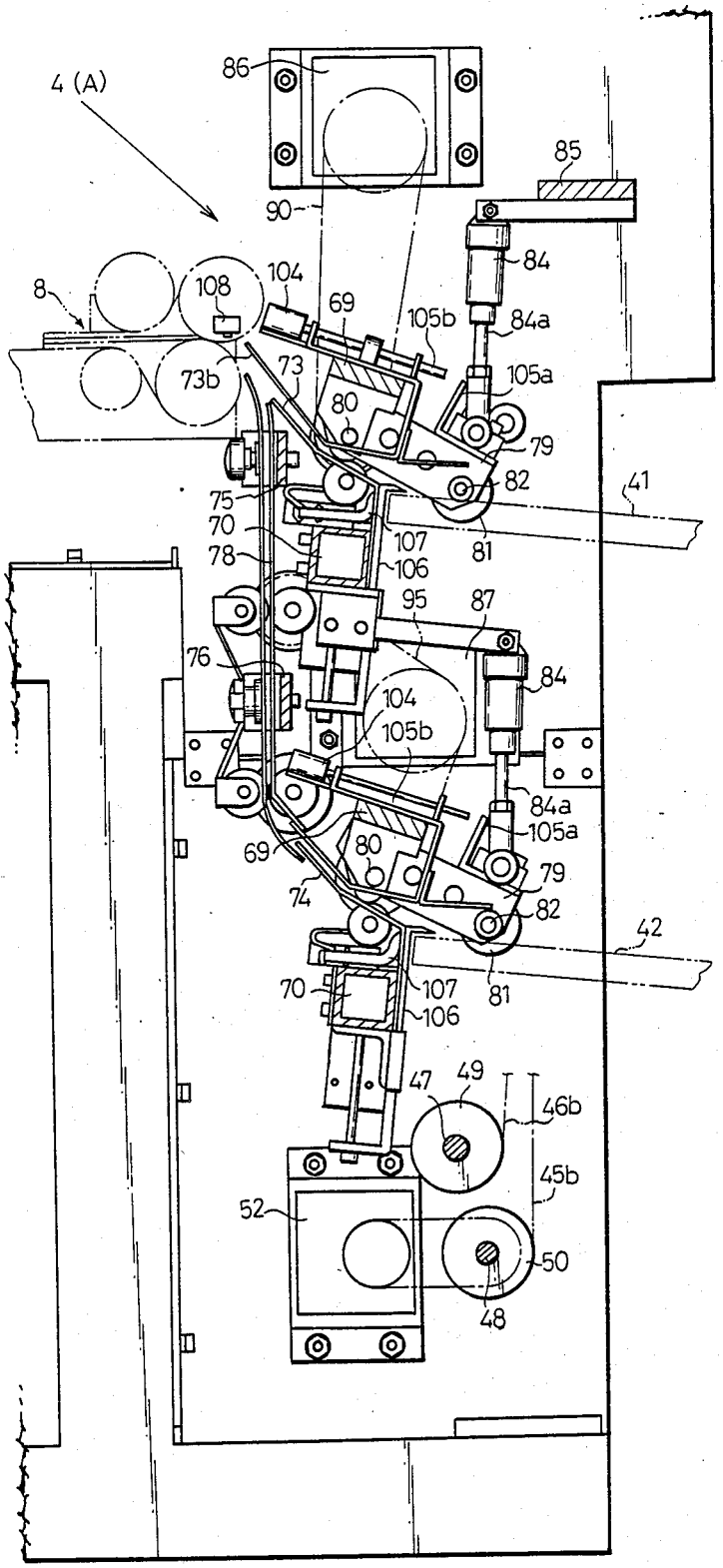
Figure 7:
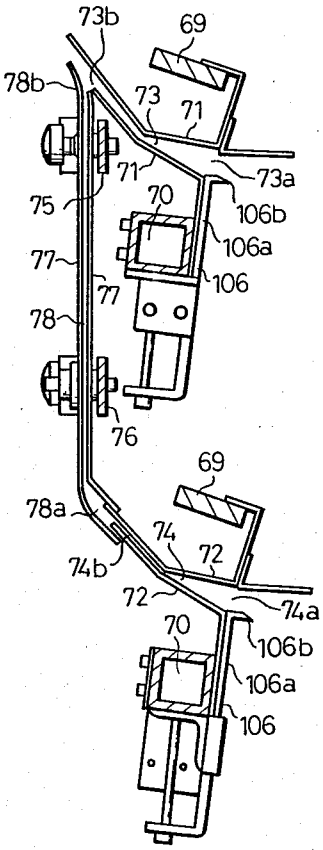
Figure 8:
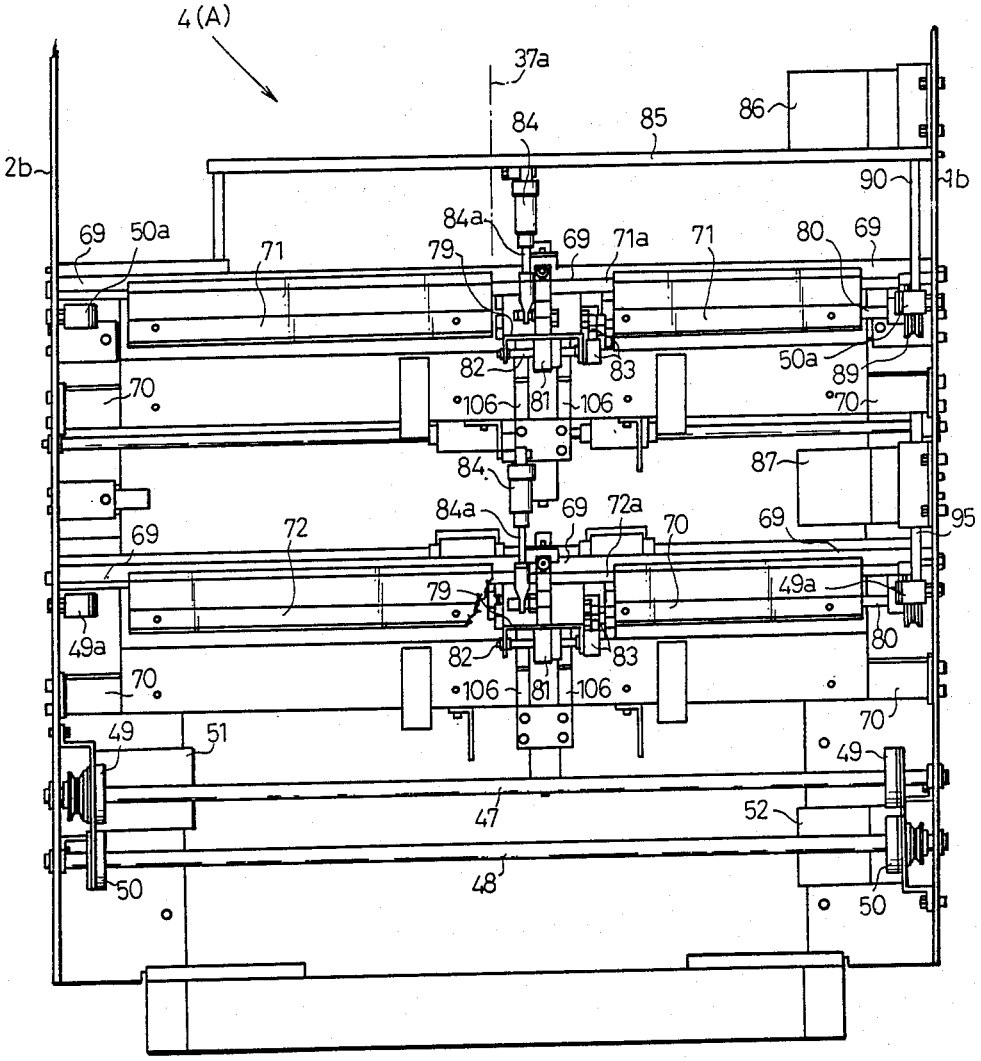

As shown in FIG. 6 to FIG. 8, near the front end portions of the support bases 41, 42, below and above each, a support plate 69 and a support pipe 70 are respectively provided, spanning the rear end portions 1*b*, 2*b* of the left and right machine frames 1, 2, with an upper and lower guide path 73, 74 respectively formed between the upper guide plates 71 and the lower guide plates 72 attached to the support plates 69 and support pipes 70, respectively. In front of the support plates 69 and the support pipes 70, a pair of upper and lower mounting plates 75, 76 are provided, spanning the rear end portions 1*b*, 2*b* of the left and right machine frames 1, 2, with an intermediate guide path 78 being formed between the guide plates 77 attached to the mounting plates 75, 76. An entrance 78*a* of this guide path 78 is connected to an exit 74*b* of the lower guide path 74, as well as an exit 78*b* to an exit 73*b* of the upper guide path 73, this exit 73*b* corresponding to the rear end portions of the left and right conveyor belt portions 8 of the wrapper conveyor 3. The entrances 73*a*, 74*a* of the upper and lower guide paths 73, 74 correspond to the front end portions of the upper and lower support bases 41, 42. On the upper guide plate 71 and lower guide plate 72 making up the upper and lower guide paths 73, 74, insertions 71*a*, 72*a* are formed a little to a side of the lateral central position 37*a* of the wrapping region 37.

On the upper and lower support plates 69, support pieces 79 having a shape similar to the cross section of a gutter are supported within the upper and lower insertions 71*a*, 72*a* such that they are rotatable upward and downward with driving shafts 80 as the centers of rotation. Within these support pieces 79, rotatable rollers 81 are supported by means of rotatable shafts 82. The driving shafts 80 and the rotatable shafts 82 are linked by gears 83. Above the upper and lower support pieces 79, air cylinders 84 used for pressing the wrappers are attached to a mounting plate 85 and to the support pipes 70. Piston rods 84*a* of these air cylinders are connected to the support pieces 79, and the support pieces 79 move upward or downward according to the upward or downward movement of the piston rods 84*a*. Above the upper and lower support plates 69, motors 86, 87 for dispensing wrappers are attached on the inner side of the right machine frame 1. The rotation of the upper motor 86 is transmitted to the upper driving shaft 80 by means of a belt 90, and the rotation of the lower motor 87 is transmitted to the lower driving shaft 80 by means of a belt 95. Consequently, the rotations of the upper and lower driving shafts 80 are transmitted to the rotatable rollers 81 by means of the gears 83 and the rotatable shaft 82 of the support pieces 79.

Limit switches 104 are attached in front of the upper and lower support plates 69. These limit switches 104 are disconnected with the upward motion of the upper and lower support pieces 79 by means of operating plates 105*a* on the support pieces and operating rods 105*b* on the support plates 69.

On the rear portions of the upper and lower support pipes 70, a pair of left and right restraining pieces 106 corresponding to the rotatable rollers 81 are supported such that they are movable upward or downward. On the upper ends of these restraining pieces, a hook portion 106*b* is formed, protruding backwards from a perpendicular portion 106*a* adjacent to the entrances 73*a*, 74*a* of the upper and lower guide paths 73, 74. These hook portions 106*b* are provided to restrain the front end of the wrapper 400 placed on the upper and lower support bases 41, 42, with the weight of the restraining pieces 106. Also, air blowing nozzles 107 corresponding to the same rotatable rollers 81 are attached to the upper and lower support pipes 70, such that they blow air to the front end of the wrapper 400 placed on the upper and lower support bases 41, 42.

A wrapper detecting sensor 108 is mounted near the rear end portion of the left and right conveyor belt portions 8 of the wrapper conveyor 3.

Commodity Supply Device B

Next, the commodity supply device B is described with reference to FIG. 1(*a*), (*b*) and FIG. 9 to FIG. 13.

The commodity supply device B comprises a commodity receiving base mechanism 109 (refer to FIG. 9 to FIG. 11) provided below the wrapping region 37 of the wrapper conveyor 3, and a commodity conveyor 110 (refer to FIG. 12(*a*), (*b*) and FIG. 13) provided below the same wrapper conveyor 3, occupying the space from the outer side of the interval of the front ends 1*a*, 2*a* of the left and right machine frames 1, 2 to the commodity receiving base mechanism 109.

Figure 10:
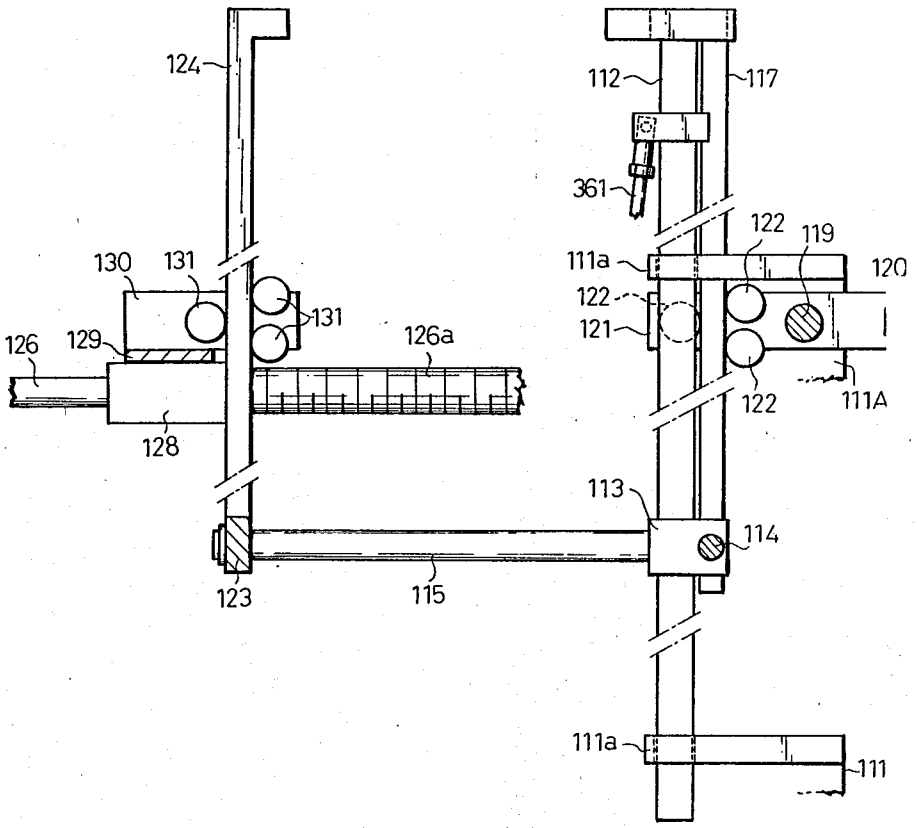
FIG. 9 to FIG. 13 show the commodity supply device.
Figure 9:
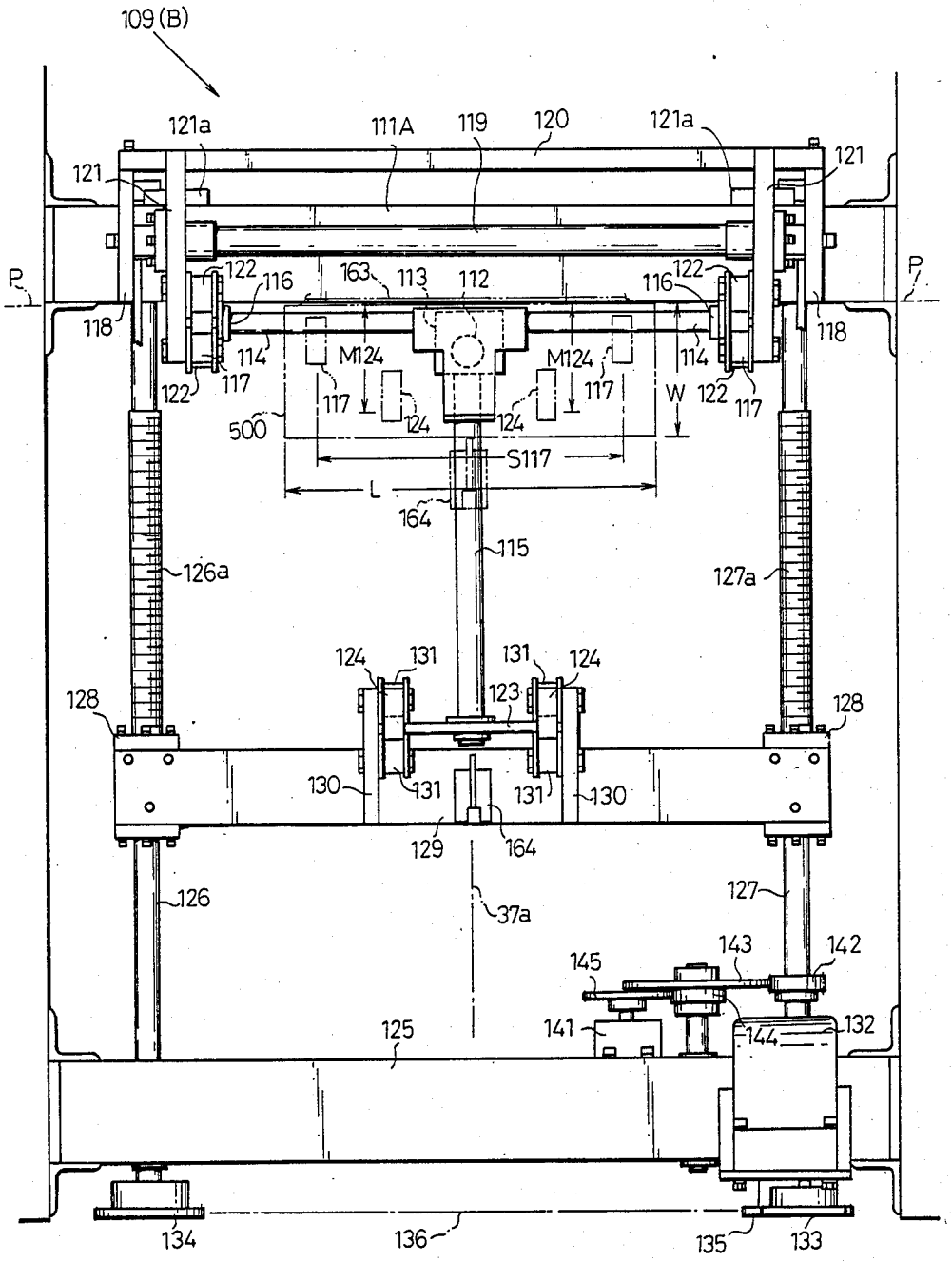
Figure 11:
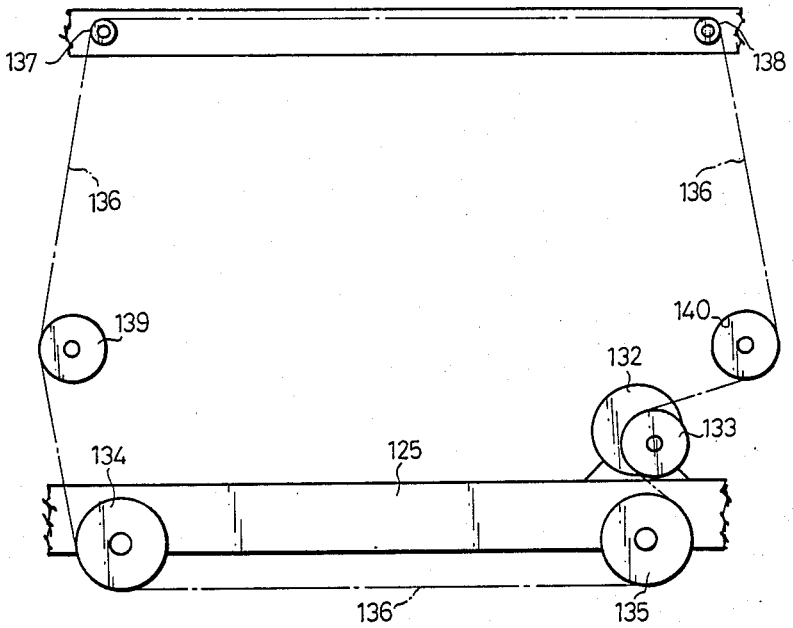

The commodity receiving base mechanism 109 is described in detail with reference to FIG. 9 to FIG. 11.

Support plates 111A, 111B span the upper and lower portions of the interval between the left and right machine frames 1, 2. At the lateral central portion of these support plates, a central support shield 112 is supported at the outwardly protruding bearing portions 111*a*, such that the central support shield can be moved upward or downward while maintaining a perpendicular position. This central support shield 112 is situated right below the lateral central position 37*a* of the wrapping region 37. At the middle of the upper and lower bearing portions 111*a* a mounting block 113 is fixed to the central support shield 112, and a support rod 114 horizontally extendible laterally, and a support rod 115 horizontally extendible to the front are fixed to this mounting block 113.

Support blocks 116 are fitted to the support rod 114 so as to be movable laterally, and rear support shields 117 are provided on the support blocks 116, and are perpendicular to them. On the mounting plates 118 fixed to the left and right sides of the upper support plate 111A, a slide shaft 119 and a guide shield 120 are provided such that they are extendible laterally, with slide plates 121 fitted to the left and right sides of the slide shaft 119 such that they are also movable laterally. The rear end portions of these left and right slide plates 121 are attached to the guide shield 120 such that they are movable laterally. Three guide rollers 122 are each supported by the slide plates 121, and the rear support shields are inserted between these guide rollers such that they are movable upward and downward. The left and right slide plates 121 are linked by a linkage plate 121*a* to the outer frames 9 of the left and right conveyor belt portions 8 for the wrapper conveyor 3. When both conveyor belt portions 8 approach each other from the sides, both slide plates 121 move sideways along the slide shaft 119 and the guide shield 120, and due to this movement, the left and right rear support shields 117 move along the support rod 114 and approach each other toward the central support shield 112.

A slide plate 123 is fitted to the support rod 115 such that this slide plate 123 is movable forward and backward, and perpendicular front support shields 124 are provided on the left and right sides of the slide plate 123. A support plate 125 spans the lower portion of the interval between the front ends 1*a*, 2*a* of the left and right machine frames 1, 2. A pair of left and right rotatable shafts 126, 127 are supported between the left and right sides of the support plate 125 and the left and right sides of the upper support plate 111A. On these left and right rotatable shafts 126, 127, threaded portions 126*a*, 127*a* are formed, and female screw pieces 128 are screwed to these threaded portions 126*a*, 127*a*. A movable plate 129 is provided between these two female screw pieces 128. Three guide rollers 131 are supported on each mounting plate 130 provided to the left and right sides of the central portion of the movable plate 129, with the front support shields 124 inserted between these guide rollers 131 such that these shields are movable upward and downward.

At the inner side of the front end 2*a* of the right machine frame 2, a motor 132 used for setting the front-to-back position of the front support shield is mounted on the support plate 125. A sprocket 133 linked to this motor 132 and sprockets 134, 135 attached to the front ends of the rotatable shafts 126, 127 are linked by an interlocking chain 136 via sprockets 137, 138, 139, 140. When the rotatable shafts 126, 127 rotate as a result of the movement of the interlocking chain 136 due to the motor 132, the female screw pieces 128 move forward or backward along the threaded portions 126*a*, 127*a*. Consequently, the front support shields 124 move forward or backward and approach each other toward the central support shield 112.

A position detecting potentiometer 141 is provided on the support plate 125, adjacent to the motor 132, and is linked to the right rotatable shaft 127 through gears 142, 143, 144, 145.

The commodity conveyor 110 is described in detail with reference to FIG. 12(*a*), (*b*) and FIG. 13.

A pair of left and right frame bodies 146, 147 are attached between the support plates 111A, 125 (refer to FIG. 9), with a driving shaft 148 spanning the middle portion of the interval between the frame bodies 146, 147. A commodity conveyor driving motor 149 is provided on the support plate 125, the rotation of this motor being transmitted to the driving shaft 148 by means of a belt 151. A plurality of sprockets 153 is fixed to the driving shaft 148. On a mounting plate 154 spanning the left and right frame bodies 146, 147 at a farther position to the rear than that of the driving shaft 148, a plurality of backward projecting cantilevered support plates 155 is supported, a sprocket 156 being supported at the end of each support plate 155 at a position a little closer to the front than that of the central support shield 112. A follower shaft 157 spans the interval between the front end portions of the left and right frame bodies 146, 147, with a plurality of sprockets 158 being fixed to this follower shaft 157. Above the driving shaft 148, a tension shaft 159 spans the interval between the left and right frame bodies 146, 147, with sprockets 161 being supported by a plurality of levers 160 fixed to this tension shaft 159. A plurality of conveyor chains 162 are fitted in parallel to the sprockets 153, 156, 158, 161.

At a position a little farther to the rear than that of the central support shield 112, a commodity stopper plate 163 is attached on the upper support plate 111A such that it is extendible laterally. The rear support shields 117 move laterally along the stopper plate 163 between this same commodity stopper plate 163 and the rear ends of the chains 162. The front support shield 124 moves front to back along the chains 162 therebetween. Limit switches 164 are attached to the movable plate 129 (refer to FIG. 9) of the commodity receiving mechanism 109, and are operated by the commodity 500 as it is being carried by the chains 162 in the direction of the arrow b.

In the commodity receiving mechanism 109, there is a mechanism that adjusts the lateral interval S117 between the left and right rear support shields 117 according to the lateral length L of the commodity 500, relative to the lateral central position 37*a* of the wrapping region 37, by means of the support rods 114, support blocks 116, slide shaft 119, slide plates 121, guide rollers 122, and others; as well as a mechanism that links the lateral movements of the left and right conveyor belt portions 8 of the wrapper conveyor 3 by means of the linkage 121*a* of the slide plates 121. Also, there is a mechanism that adjusts the front-to-back interval M124 between the support shields 124 according to the front-to-back width W of the commodity 500 relative to the commodity stopper plate 163 of the commodity conveyor 110, by means of the support rod 115, slide plate 123, rotatable shafts 126, 127, female screw pieces 128, movable plate 129, guide rollers 131, motor 132, chain 136, and others.

Wrapper Folding Device

Next, the wrapper folding device C is described with reference to FIG. 1 and FIG. 14 to FIG. 22.

The wrapper folding device C is provided above the wrapper conveyor 3, and is equipped with a pair of front and rear bottom surface first folding plates 165, 166 (refer to FIG. 14) that fold the wrapper 400 from the front and rear sides of the bottom surface 502 of the commodity 500 (refer to FIG. 35(*a*)) along this bottom surface 502; a pair of left and right bottom surface front second folding plates 167, 168 (refer to FIG. 20) and a pair of left and right bottom surface rear second folding plates 169, 170 (refer to FIG. 17) that fold the wrapper 400 from the left and right sides of the front portion and the rear portion of the bottom surface 502 of the commodity 500, along the same bottom surface 502; a pair of left and right front surface first floding plates 171, 172 (refer to FIG. 20) and a pair of left and right rear surface first folding plates 173, 174 (refer to FIG. 17) that fold the wrapper 400 from the left and right sides of the front surface 503 and rear surface 504 of the commodity 500 along these same front surface 503 and rear surface 504; and front surface second folding plates 175 (refer to FIG. 20) and rear second folding plates 176 (refer to FIG. 17) that fold the wrapper 400 from the front surface 503 and rear surface 504 of the commodity 500 toward the same front surface 503 and rear surface 504 respectively. Below, a detailed description of each folding plate 165–176 is given.

Figure 14:
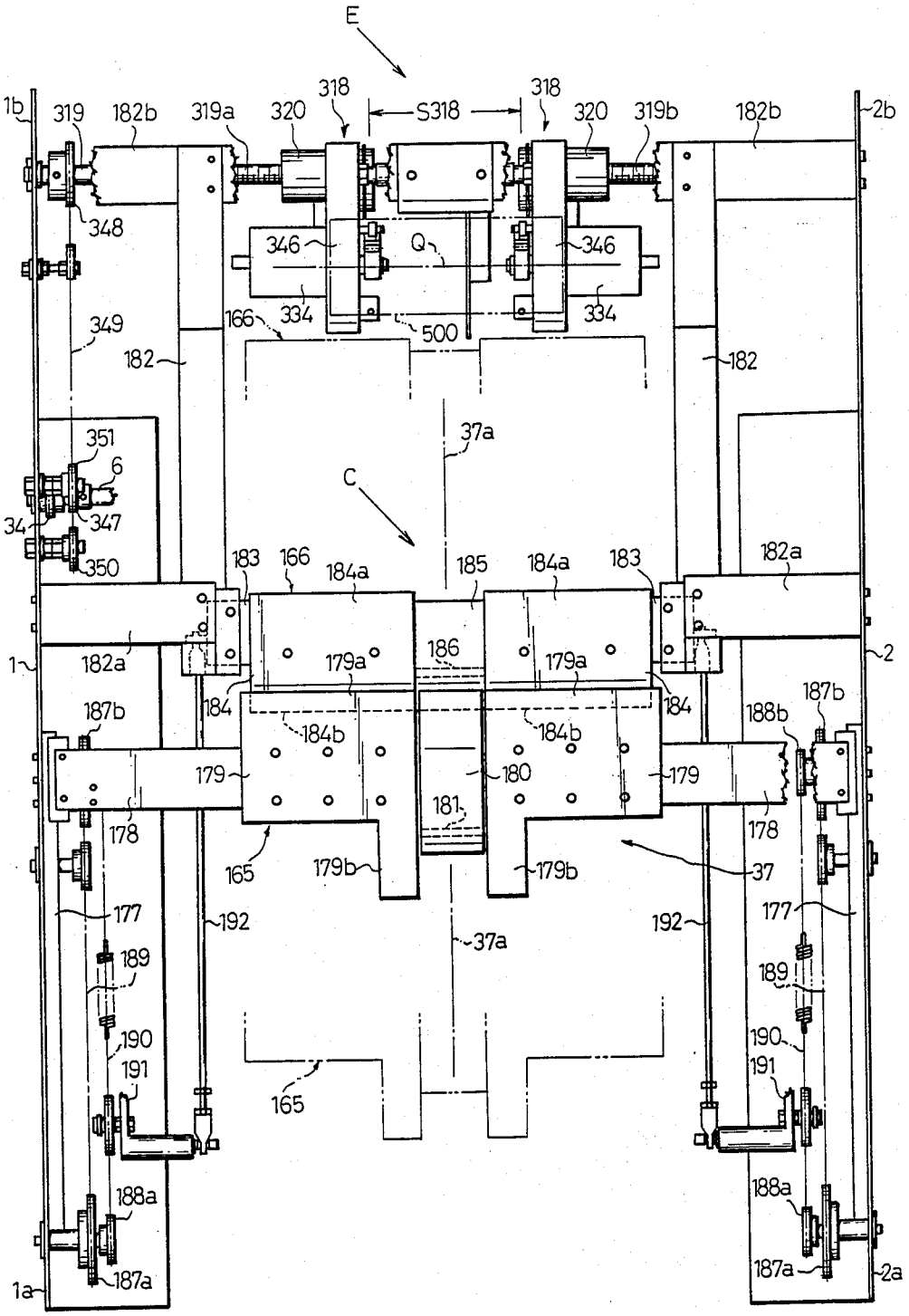

As shown in FIG. 14, on the inner surfaces of the front ends of the left and right machine frames 1, 2, rails 177 are attached, extendible forward and backward, with a support plate 178 movable forward and backward spanning these pair of rails. The bottom surface folding plates 165 are mounted in the middle portion of this support plate 178. These bottom surface first folding plates 165 comprise a pair of left and right folding portions 179 and a folding portion 180 between them, with the whole rear portions 179*a* of the pair of left and right folding portions 179 protruding backward from the support plate 178. Also, protruding portions 179*b* that extend forward are formed on the adjacent edges of the folding plates 179. The folding portion 180 in the middle is rotatably supported a little below the protruding portions 179*b* with a shaft 181 as the center of rotation, and is always pushed upward, extending diagonally upward and rearward from the shaft 181, being in the same plane as the rear portion 179*a* of the left and right folding portions 179.

A pair of left and right rails 182 are attached such that they extendible forward and backward, between a mounting plate 182*b* spanning the rear end portions 1*b*, 2*b* of the machine frames 1, 2 and mounting plates 182*a* attached in the front-to-back middle portion of the left and right machine frames 1, 2, with a support plate 183 spanning these rails 182, and movable forward and backward. The rear bottom surface first folding plates 166 are mounted in the middle portion of the support plate 183. These bottom surface first folding plates 166 comprise a pair of left and right folding portions 184 and a folding portion 185 between them, the front portions 184*b* of this pair of left and right folding portions 184 projecting downward and forward from the support plate 183. When the front and rear bottom surface first folding plates 165, 166 approach each other, the rear portions 179*a* of the left and right folding portions 179 of the front bottom surface first folding plates 165 become piled on top of the front portions 184*b* of the folding portions 184. The folding portion 185 in the middle is rotatably supported with a shaft 186 as the center of rotation, a little below the interval between the front portions 184*b* of the left and right folding portions 184, and is always pushed upward, extending diagonally upward and rearward from the shaft 186, and being situated in the same plane as the rear portions 184*a* of the left and right folding portions 184.

Below the front rails 177, pairs of front and rear sprockets 187*a*, 187*b*, 188*a*, 188*b* having the same respective central axes are provided on the inner surface of the left and right machine frames 1, 2, with chains 189, 190 linking these sprockets 187*a*, 187*b*, 188*a*, 188*b*. Both ends of the front support plate 178 are attached to the chains 189 of the sprockets 187*a*, 187*b*, while tilting levers 191 are attached to the other chains 190. A pair of rods 192 connect both ends of the rear support plate 183 and the levers 191. When the chains 189, 190 revolve due to the tilting of the levers 191, the front support plate 178 moves backward or forward along the rails 177, the rear support plate 183 moves backward or forward along the rails 182 due to the rods 192, and the front and rear bottom surface first folding plates 165, 166 approach each other toward the wrapping region 37.

Figure 16A:
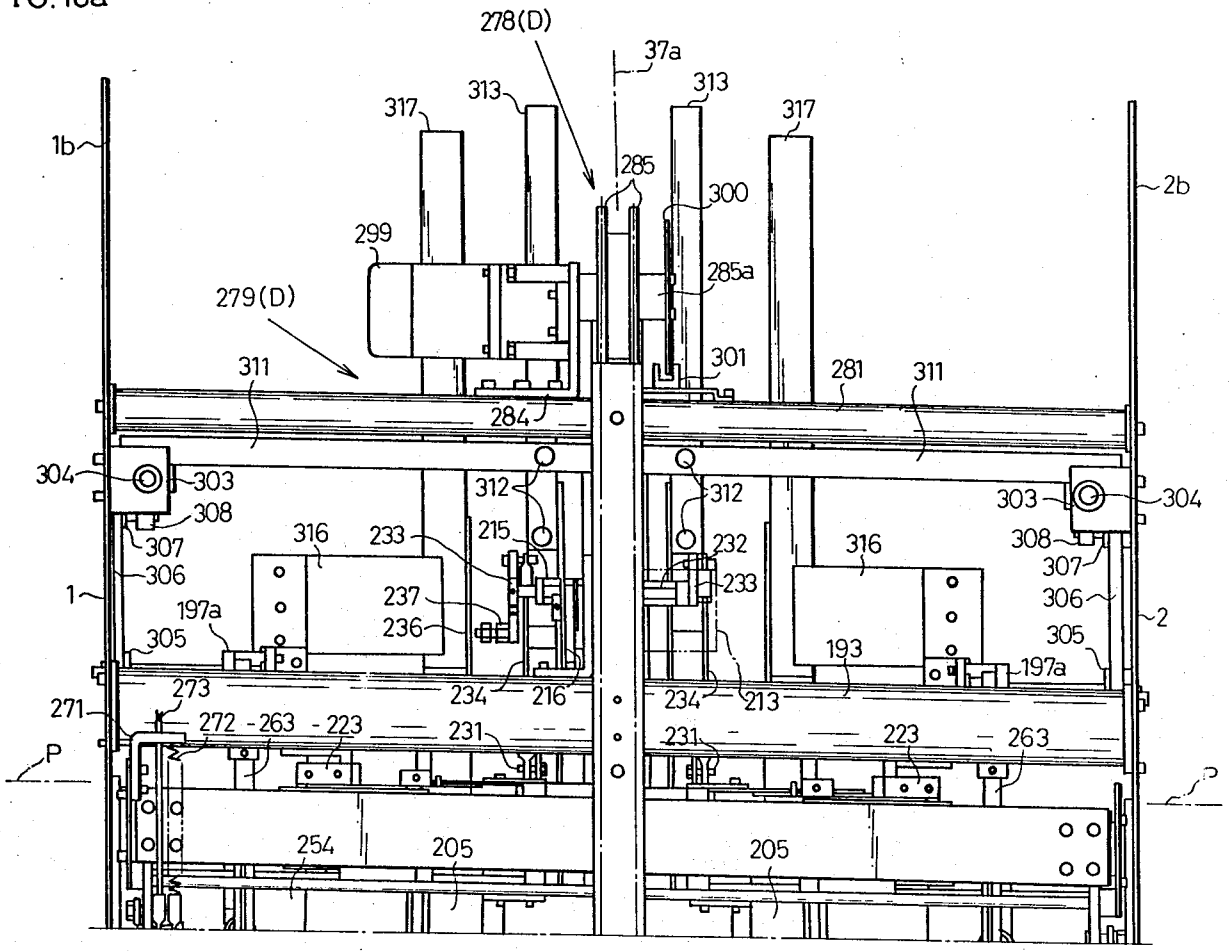
Figure 16B:
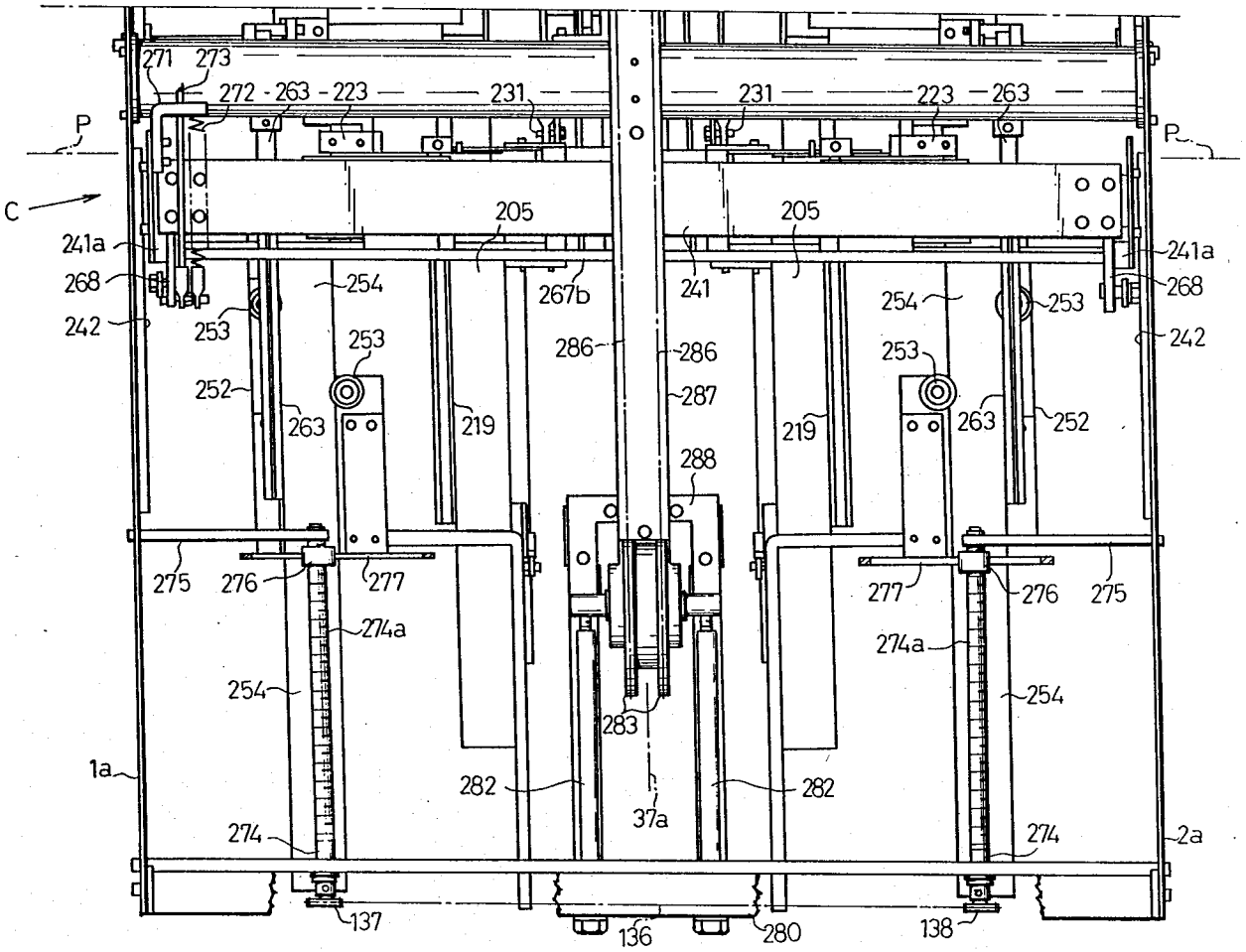
Figure 19:
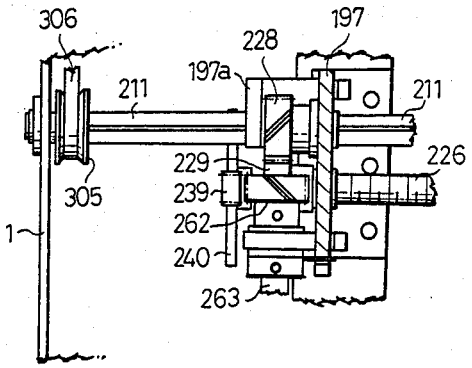

As shown in FIG. 16(*a*)–FIG. 19, above the bottom surface folding plates 165, 166, a fixed support base 193 spans the interval between the left and right machine frames 1, 2, with support pieces 194, 195 supported on this fixed support base 193 such that they are movable laterally along the rails 196. On the lower end portions of connecting plates 197 extending downward from the support pieces 194, 195, support blocks 198 are attached, with guide plates 199 projecting upward from the inner side of these support blocks 198. In these support blocks 198, the rear bottom surface second folding plates 169, 170 are supported such that they are laterally movable by means of sliders 200. Wires 201 are introduced into the support blocks 198 and connected to the sliders 200, and within these support blocks 198, the sliders 200 are pushed inside by coil springs 202 wound around the wires 201, such that the rear bottom surface second folding plates 169, 170 protrude toward the wrapping region 37 from the support blocks 198, passing below the guide plates 199. When the wires 201 are pulled against the elastic force of the coil springs 202, the rear bottom surface folding plates 169, 170 are induced to move away from the wrapping region 37.

Mounting frames 204 are attached to the lower end portion of connecting plates 203 extending downward from the outer sides of the support blocks 198, the outer frames 9 of the left and right conveyor belt portions 8 of the wrapper conveyor 3 being fitted within this mounting frame 204. Above these outer frames 9, wrapper restrainers 205 extending forward and backward relative to the wrapping region 37 are supported at the inner side of the mounting frames 204, such that they are rotatably movable laterally, with shafts 206 as the centers of rotation. Bolts 208 fixed to the wrapper restrainers 205 are inserted to brackets 207 attached to the mounting frames 204, the wrapper restrainers 205 being pushed inward by means of springs 209 wound around the bolts 208 between the same wrapper restrainers 208 and brackets 207, and made to be at rest by the locking of stopper nuts 210 screwed to the bolts 208 with the brackets 207. In this rest position, the wrapper restrainers 205 protrude a little toward the wrapping region 37 than the outer frames 9 of the left and right conveyor belt portions 8 of the wrapper conveyor 3 and the guide plates 199 on the inner sides of the support blocks 198.

Below the fixed support base 193, a driving shaft 211 spans the left and right machine frames 1, 2, the connecting plates 197 of the support portions 194, 195 being laterally movably supported relative to this driving shaft 211. Below the lateral central portion of the fixed support base 193, a motor 213 used for setting the position of the folding plates is provided, and linked to the driving shaft 211 by means of pulleys 214, 215 and a belt 216.

On the support pieces 194, 195, sliders 217 are supported such that they are laterally movable along rails 218, and on the front sides of these sliders 217, the rear surface first folding plates 173, 174 are laterally rotatably supported, with shafts 219 as the centers of rotation. These rear surface first folding plates 173, 174 comprise support portions 220 that extend horizontally outward from the shafts 219, intermediate portions 221 that extend perpendicularly downward from the tip of the support portions 220, and diagonal portions 222 that extend diagonally downward to the inner side from the lower tip of the intermediate portions 221, the diagonal portions 222 becoming adjacent at the back of the guide plates 199. The inner sides of these diagonal portions 222 act as diagonal folding edges 222*a*. Brackets 223 are fixed to the left and right support pieces 194, 195, with coil springs 224 attached between these brackets 223 and the rear surface first folding plates 173, 174. The diagonal portions 222 of the rear surface folding plates 173, 174 are rotatably pushed toward the wrapping region 37, with the shafts 219 as the centers of rotation, by means of the coil springs 224, the lower tips of the diagonal portions 222 protruding toward the guide plates 199, and being in the same horizontal planes as the bottom surface rear second folding plates 169, 170. Wires 225 are introduced into these brackets 223, and are connected to the rear surface first folding plates 173, 174. When these wires are pulled, the rear surface first folding plates 173, 174 are rotated, against the elastic force of the coil springs 224, away from the wrapping region 37, with the shafts 219 as the centers of rotation. On the connecting plates 197 of the left and right support pieces 194, 195, threaded rods 226 protruding inward are rotatably supported, with female screw portions 227 formed on the sliders 217 screwed to these threaded rods 226. On the gear mounting portions 197*a* attached to the connecting portions 197 of the left and right support pieces 194, 195, gears 228 are supported on the driving rod 211 such that they are movable along this rod, and gears 229 are supported on the threaded rods 226, the threaded rod 226 being linked to the driving shaft 211 by means of these gears 228, 229.

On a bracket 230 provided above the lateral middle portion of the fixed support base 193, the pair of left and right rear surface second folding plates 176 are supported such that are rotatable forward and backward with shafts 231 as the centers of rotation, and situated a little to the rear than the rear surface first folding plates 173, 174. A shaft 232 is rotatably supported on this bracket 230, with levers 233 fixed to the left and right ends of the shaft 232. The levers 233 and the rear surface second folding plates 176 are connected by links 234, the rear surface second folding plates 176 being linked such that they rotate in the same direction. Above one of the levers 233, a bracket 235 is fixed to the fixed support base 193, with a coil spring 236 being provided between this bracket 235 and the lever 233. The rear surface second folding plates 176 are rotatably pushed toward the front by means of the coil spring 236 through the levers 233 and the links 234, coming close to the rear surface first folding plates 173, 174 at the rear. A wire 237 is introduced into the bracket 235, and connected to the lever 233. When this wire 237 is pulled, the rear surface second folding plates 176 are rotated against the elastic force of the coil spring 236, away from the wrapping region 37, with the shafts 231 as the centers of rotation.

A position detecting potentiometer 238 is attached to the left connecting plate 197, and linked to the threaded rod 226 through gears 239, 240.

Figure 20:
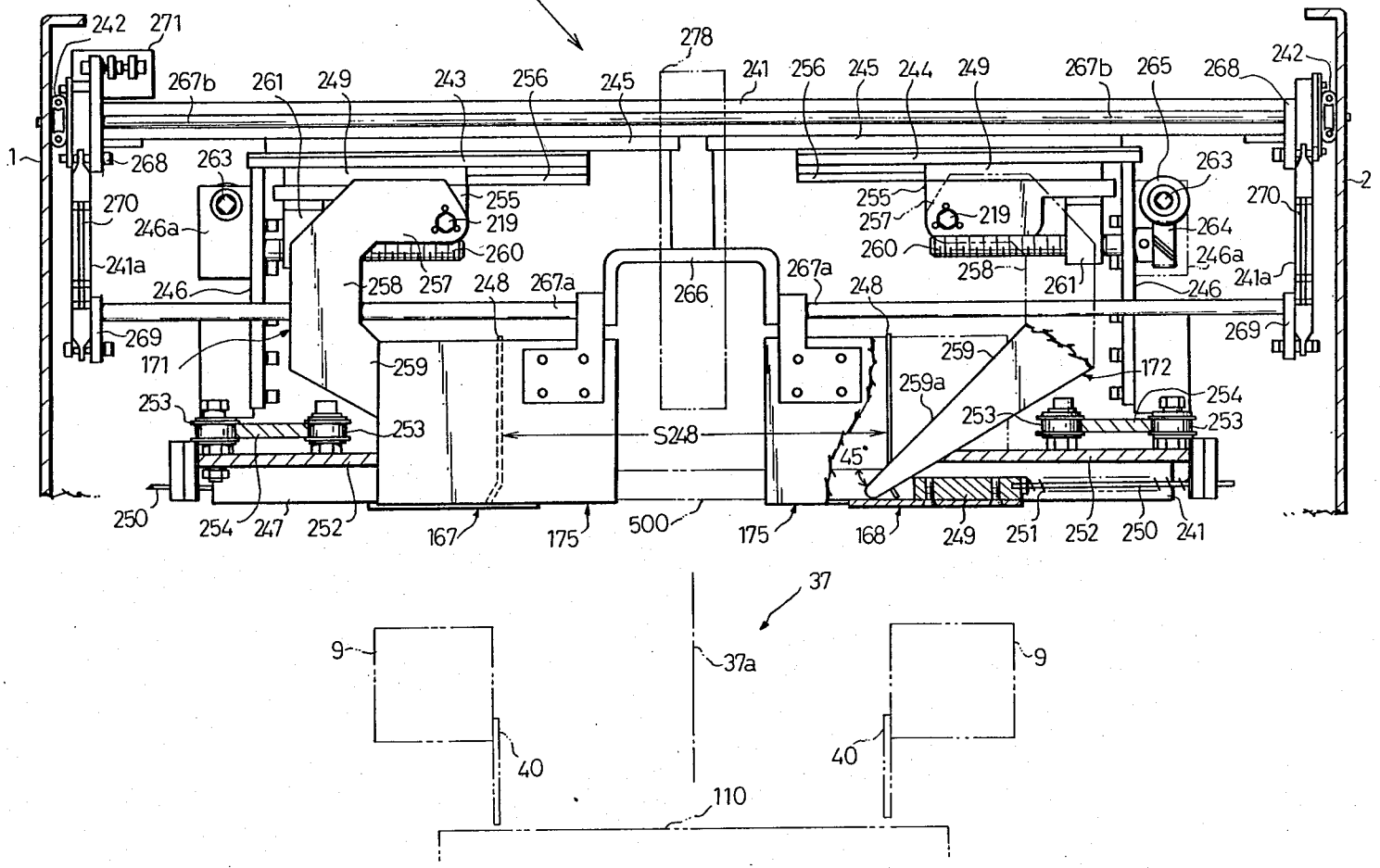
Figure 22:
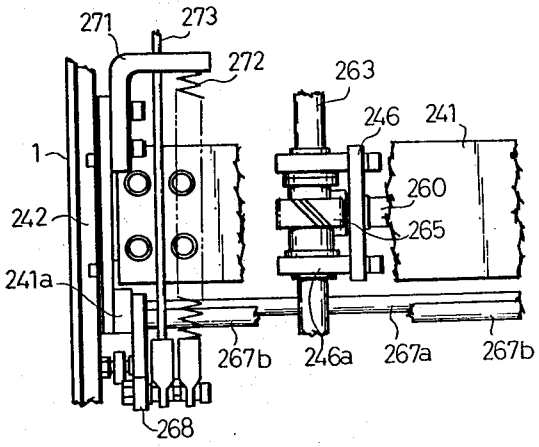
Figure 21:
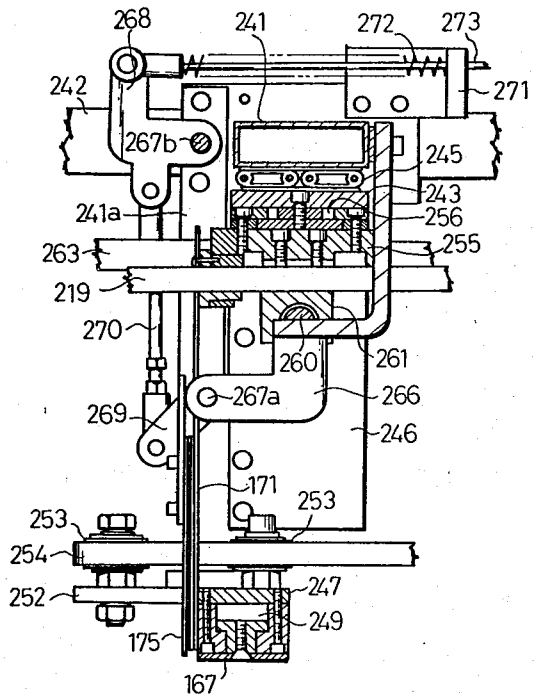
Figure 23A:
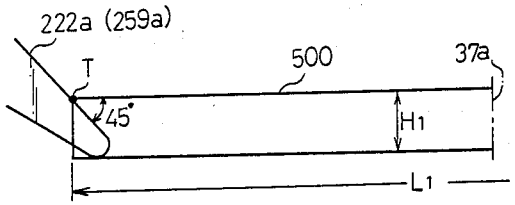
Figure 23B:
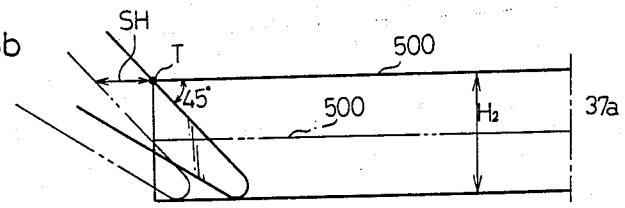
Figure 23C:
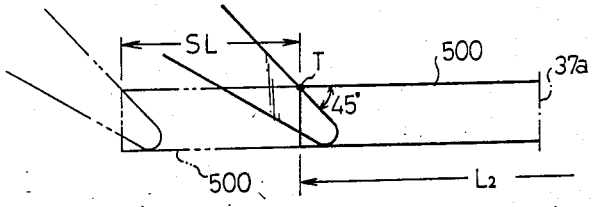
Figure 23D:
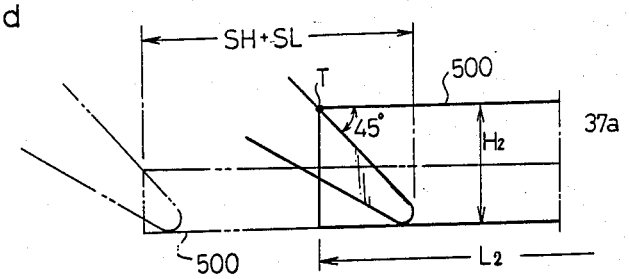

On the other hand, as shown in FIG. 16(*a*), (*b*) and FIG. 20 to FIG. 22, in front of the fixed support base 193, a support base 241, movable forward and backward along rails 242, is supported between the left and right machine frames 1, 2. On the left and right sides of this movable support base 241, support pieces 243, 244 are supported such that they are laterally movable along rails 245. Support blocks 247 are attached at the lower ends of connecting plates 246 extending downward from the support pieces 243, 244, and guide plates 248 protruding upward are provided on the inner sides of these support blocks 247. Sliders 249 are laterally movably supported within the support blocks 247, and the bottom surface front second folding plates 167, 168 are attached to these sliders 249. Wires 250 are inserted into the support blocks 247 and connected to the sliders 249. Within the support blocks 247, coil springs 251 are wound around the circumference of the wires 250. By means of these coil springs 251, the sliders 249 are pushed inward, and the bottom surface front second folding plates 167, 168 protrude from the support blocks 247, passing below the guide paltes 248, toward the wrapping region 37. When the wires 250 are pulled, the bottom surface front second folding plates 167, 168 are moved, against the elastic force of the coil springs 251, away from the wrapping portion 37.

Connecting plates 252 extending forward are attached to the support blocks 247, with a plurality of guide rollers 253 being supported on top of these connecting plates 252. On the female screw pieces 7 fixed to the front ends of the left and right conveyor belt portions 8 of the wrapper conveyor 3, connecting plates 254 extending backward are attached, the front-to-back middle portions of these connecting plates being supported between the guide rollers 253.

Sliders 255 are laterally movably supported by the support pieces 243, 244 along rails 256. The shafts 219 which are the centers of rotation of the rear surface first folding plates 173, 174 extend forward and pass through the sliders 255, the sliders 255 being movable forward and backward relative to these shafts 219. The front surface first folding plates 171, 172 are integrally rotatably supported by the shafts 219. These front surface first folding plates 171, 172, like the rear surface first folding plates 173, 174, comprise support portions 257, intermediate portions 258, and diagonal portions 259 and their folding edges 259*a*. When the rear surface first folding plates 173, 174 rotate, the front surface first folding plates 171, 172 also rotate in the same direction through the shaft 219.

Bolts 260 extending inward are rotatably supported on the connecting plates 246 of the left and right support pieces 243, 244, with the female screw portions 261 formed on the sliders 255 being screwed to these bolts 260. On the fixed support base 193 side, gears 262 meshing with the gears 229 on the threaded rod 226 are supported on the gear mounting portion 197*a* of the connecting plates 197 of the left and right support pieces 194, 195, with the axis of rotation 263 of the gear 262 extending forward. On the gear mounting portion 246*a* of the connecting plate 246 of the movable support base 241 side, gears 264 on the bolts 260 and gears 265 that mesh with these gears 264 are supported, the gears 265 being supported such that they are integrally rotatably movable with the shafts 263, as well as being movable forward and backward.

A bracket 266 is attached to the lateral middle portion of the movable support base 241. The front surface second folding plates 175 are fixed to shafts 267*a* rotatably supported at the left and right sides of the bracket 266. A shaft 267*b* is rotatably supported between the mounting shields 241*a* extending downward from the left and right ends of the movable support base 241, the shafts 267*a* being rotatably supported below this shaft 267*b*. Levers 268, 269 are fixed to both ends of the upper and lower shafts 267*b*, 276*a* respectively, with links 270 connecting these levers 268, 269, forming a four-node parallel link mechanism comprising the levers 268, 269 and the links 270. A bracket 271 is attached to the left end portion of the movable support base 241. A coil spring 272 is fitted between this bracket 271 and the lever 268, and by means of this coil spring 272, the front surface second folding plates 175 are induced to rotate toward the rear via the four-node parallel link mechanism, with the shafts 267*a* as centers of rotation, coming close to and in front of the front surface first folding plates 171, 172. A wire 273 is introduced into the bracket 271, and is connected to the lever 268. When this wire 273 is pulled, the front surface folding plates 175 are rotated, against the elastic force of the coil spring 272, away from the wrapping portion 37, with the shafts 267*a* as the centers of rotation.

At the front portion of the left and right machine frames 1, 2, the central axes 274 of rotation of the upper left and right sprockets 137, 138 among the sprockets 134, 135, 137, 138, 139, 140 (refer to FIG. 11) linked by the interlocking chain 136 are provided, extending backward, their rear end portions being rotatably supported on a mounting plate 275 extending from the left and right machine frames 1, 2. Threaded portions 274*a* are formed on these shafts 274, and female screw pieces 276 are screwed to these threaded portions 274*a*. Elongated holes 277 extending laterally are formed on the front end portions of the connecting plates 252 extending forward from the support blocks 247 of the movable support base 241, the female screw pieces 276 being fitted into the elongated holes 277 such that they are laterally movable to the front integrally with the connecting plates 252.

When the left and right conveyor belt portions 8 of the wrapper conveyor 3 approach or move away from each other, the left and right support pieces 194, 195 on the fixed support base 193 move laterally via the mounting frames 204 and connecting plates 203, 197. Also, the left and right support pieces 243, 244 on the movable support base 241 move laterally via the connecting plates 254 of the conveyor belt portions 8, the connecting plates 252 of the movable support base 241, and the connecting plates 246. The left and right rear surface first folding plates 173, 174, the left and right front surface first folding plates 169, 190, the left and right bottom surface front second folding plates 167, 168, the guide plates 199, 248, and also the left and right wrapper restrainers 205 respectively approach or move away from the central position 37*a* of the wrapping region 37 with the lateral movement of the rear support pieces 194, 195 and the front support pieces 243, 244.

When the driving shaft 211 on the fixed support base 193 side rotates, its rotation is transmitted to the rod screws 226 on the fixed support base 193 side, as well as to the bolts 260 on the movable support base 241 side via the gears 262, shaft 263, and gears 265, 264. The sliders 217 on the rear side and the sliders 255 on the front side are moved laterally relative to the rear support pieces 194, 195 and front support pieces 243, 244, via the female screw portions 227, 261. Therefore, the left and right front surface first folding plates 171, 172 approach or move away from each other, undergoing relative movement with respect to the guide plates 199, 248, with the length of the lower ends of their slanting portions 222, 259 protruding from the guide plates 199, 248 toward the wrapping region 37 capable of being adjusted.

On the movable support base 241 side, the connecting plates 252 also move laterally, but the female screw pieces 276 fitted through the elongated holes 277 in the front end portion being moved laterally along the elongated holes 277 with the lateral movement of the connecting plates 252.

On the other hand, when the shafts 274 screwed to the female screw piece 276 rotate, the female screw pieces 276 are moved forward or rearward together with connecting plates 255, and with this movement, the whole movable support base 241 moves forward or backward with respect to the fixed support base 193. Due to this, the front surface front portion second folding plates 167, 168 on the movable support base 241 side, the front surface first folding plates 171, 172, the front surface second folding plates 175, and the guide plates 248 also move forward or backward, approaching or moving away from the bottom surface rear second folding plates 169, 170 on the fixed support base 193 side, the rear surface first folding plates 173, 174, the rear surface second folding plates 176, and the guide plates 199. Also, the connecting plates 252 on the movable support base 241 side move forward or backward relative to the connecting plates 254 on the wrapper conveyor 3 side via the rollers 253.

The orthogonal plane within which the rear surface first folding plates on the fixed support base 193 side rotate is situated approximately right above the commodity stopper plate 163 of the commodity conveyor 110. This orthogonal plane becomes the reference wrapping position P.

Figure 15:
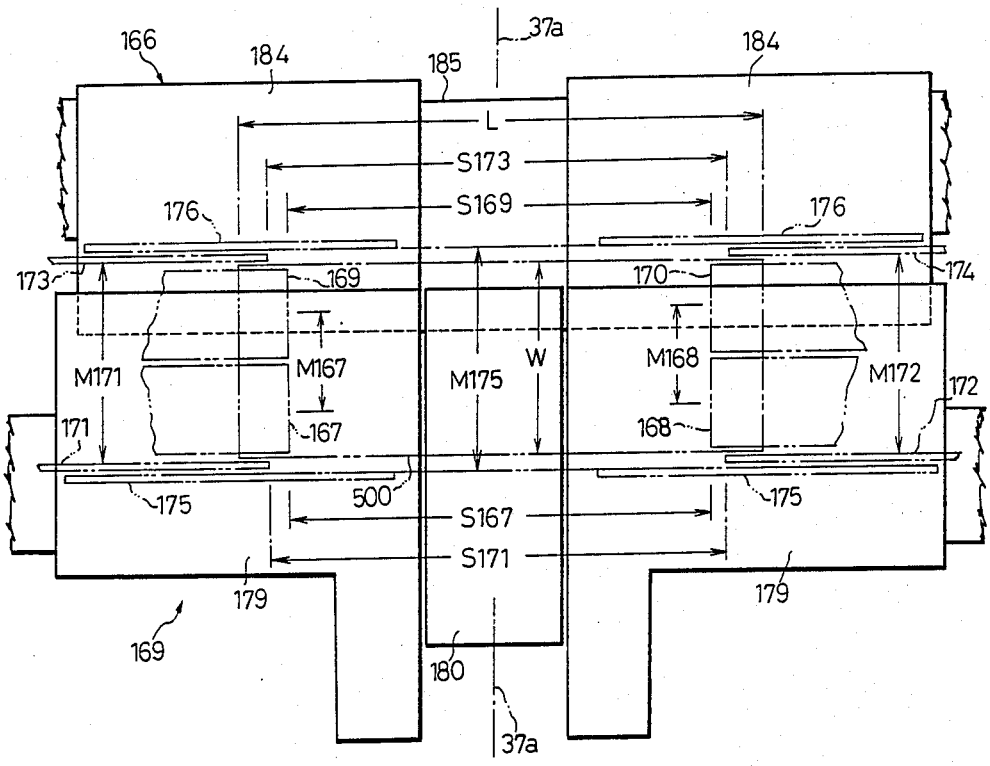
FIG. 14 to FIG. 23 show a wrapper folding device.

A mechanism for adjusting the lateral intervals S171, S173 during the folding of the pair of left and right front and rear surface first folding plates 171, 172, 173, 174, and the lateral intervals S167, S169 during the folding of the pair of left and right bottom surface front and rear second folding plates 167, 168, 169, 170, shown in FIG. 15, via the fixed support base 193, movable support base 241, support pieces 194, 195, 243, 244, connecting plates 197, 246, support blocks 198, 246, and others, relative to the lateral central position 37*a* of the wrapping region 37 according to the lateral length L of the commodity 500, is formed. Also, a mechanism that links with the lateral movement of the left and right conveyor belt portions 8 of the wrapper conveyor 3, via the mounting frames 204, connecting plates 203, connecting plates 252, 254, and others is formed. Further, a mechanism for adjusting the front-to-back interval M175 during the folding of the front and rear surface second folding plates 175, 176, the front-to-back intervals M171, M172 during the folding of the front and rear first folding plates 171, 172, 173, 174, and the front-to-back intervals M167, M168 during the folding of the bottom surface front and rear second folding plates 167, 168, 169, 170, via the fixed support base 193, movable support base 241, support pieces 194, 195, 243, 244, connecting plates 197, 246, support blocks 198, 247, brackets 230, 266, and others, according to the front-to-back width W of the commodity 500, relative to the reference wrapping position P, is formed. Also, a mechanism that links with the forward and rearward movement of the support shields 124 of the commodity receiving base mechanism 109, via the interlocking chain 136, shafts 274, female screw pieces 276, and others, is formed.

In the present embodiment, specifically, when the folding edges 222*a*, 259*a* of the front surface first folding plates 171, 172 and the rear surface first folding plates 173, 174, are folded toward the commodity 500, an edge slants at a fixed angle, e.g. at about 45 degrees from a point T, as shown in FIG. 23(*a*), but as shown in FIG. 23(*b*), when the height of the commodity 500 changes from a height H1 to a height H2, in order to maintain this folding condition, it is necessary to adjust the lateral intervals S171, S173 during the folding of the folding plates 171, 172, 173, 174 as shown in FIG. 15. The size of the adjustment is SH×2. The mechanism that adjusts the intervals S171, S173 a distance SH×2 according to the height H of the commodity is made up of the driving shaft 211, the folding plate position setting motor 213, belts 216, sliders 217, 249, threaded rods 226, 260, female screw portions 227, 261, gears 228, 229, 262, 264, 265 and the shaft 263, and others, in the wrapper folding device C. On the other hand, as shown in FIG. 23(*c*), when the lateral length of the commodity 500 changes from L1 to L2, it is necessary to adjust the intervals S171, S173 by an interval SL×2 by means of an other mechanism mentioned earlier. Therefore, as shown in FIG. 23(*d*), when the height of the commodity changes from H1 to H2 and the lateral length changes from L1 to L2, it is necessary to make an adjustment of (SH+SL)×2.

Commodity Conveying Device D

Figure 26:
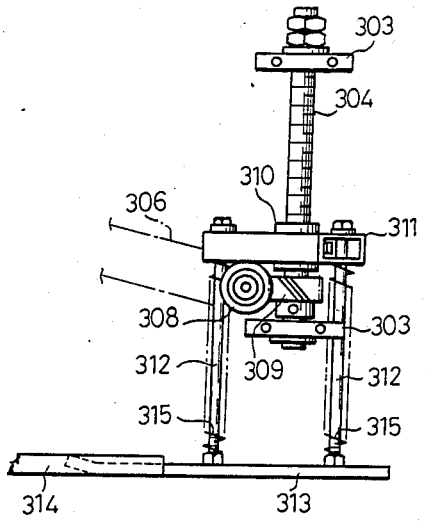
FIG. 26 is a partially broken side view of FIG. 25.

Next, the commodity conveying device D is described with reference to FIG. 1(*a*), (*b*), FIG. 16(*a*), (*b*), and FIG. 24(*a*) to FIG. 26.

The commodity conveying device D comprises a wrapper commodity discharging mechanism 278 (refer to FIG. 16(*a*), (*b*) and FIG. 24(*a*), (*b*)) provided to extend entirely from the front side to the rear side in the lateral middle portion of the wrapper folding device C, and a wrapped commodity conveyor guide mechanism 279 (refer to FIG. 16(*a*), (*b*), FIG. 25, and FIG. 26) provided below the commodity discharging mechanism 278, at the rear of the fixed support base 193 of the wrapper folding device C.

The commodity discharging mechanism 278 is described in detail with reference to FIG. 16(*a*), (*b*) and FIG. 24(*a*), (*b*).

Support shields 280, 281 span the intervals between the front ends 1*a*, 2*a* and rear ends 1*b*, 2*b* of the left and right machine frames 1, 2, with a pair of sprockets 283 being supported on a pair of support rods 282 extending rearward from the lateral middle portion of the front support shield 280, and a pair of sprockets 285 being supported on a bracket 284 attached to the rear side of the lateral middle portion of the rear support shield 281. A pair of chains 286 are attached between these front and rear sprockets 283, 285. A chain guide plate 287 is attached on top of the rear support shield 281 and the fixed support base 193, the upper side of the running portion of the chain 286 passing on top of this guide plate 287. Below the support rods 282, a mounting frame 288 is attached to the front support shield 280. A chain path piece 290 comprising a pair of upper and lower guide plates 290*a*, 290*b*, is attached to the mounting frame 288 and to the lower ends of a plurality of suspended rods 289 extending downward from the guide plate 287. This chain path piece 290 passes through the brackets 230, 266, between the pair of left and right front surface second folding plates 175 and between the pair of left and right rear surface second folding plates 176 supported by these brackets, with the lower side of the running portion of the chain 286 passing inside this guide path piece 290.

A pair of pushing pieces 291 are mounted at equal intervals on the chain 286. In each of these pushing pieces 291, a pair of pushing arms 292, extending orthogonally relative to the direction of rotation c of the chain 286, are rotatably supported on the chain 286 by a pair of shafts 292*a*. Between the tip portions of these pushing arms 292, an L-shaped support plate 293 is rotatably supported in the direction of rotation c of the chain 286, with a shaft 294 as the center of rotation. In an adjacent location opposite the direction of rotation c of the chain 286, relative to the dispensing arms 292, a pair of left and right L-shaped levers 295 are rotatably supported along the direction of rotation of the chain 286 through a shaft 296, the tips of these levers 295 and the support plates 293 being connected by the link 297 via the shafts 298*a*, 298*b*. These levers 295 are pushed in the direction of the arrow d, away from the pushing arms 292.

A chain driving motor 299 is attached to the bracket 284, its rotation being transmitted to the central shaft of rotation 285*a* of the rear sprocket 285. When the chain 286 rotates due to the motor 299, the pushing pieces 291 rotate together with the chain 286. When the pushing pieces 291 pass through the guide path pieces 290, since the base portions 295*a* of the levers 295 are regulated by the upper and lower guide plates 290*a*, 290*b* of the guide path pieces 290, the levers 295 become parallel to the the pushing arms 292, the support portions 293*a* of the support plates 293 maintain a horizontal position, facing toward the direction of rotation c of the chain 286. When the base portions 295*a* of the levers 295 deviate from the rear ends of the guide path piece 290 below the rear sprocket 285, the levers 295 rotate toward the direction of the arrow d, and the support plates 293 rotate downward via the link 297, with the shaft 294 as the center of rotation. Until the pushing pieces 291 reach the upper portions of the rear sprockets 285, the support plate 293 maintain this position, after that, the base portions 295*a* of the levers 295 become restricted again by the guide plates 287 and return to their original position.

When the support portions 293*a* of the support plates 293 move toward the direction of rotation c of the chain 286 in a horizontal position below the guide path pieces 290, they come in contact on top of the intermediate folding portions 180, 185 of the front and rear bottom surface first folding plates 165, 166 approaching each other at the wrapping region 37, and push these intermediate portions downward.

A gear plate 300 having a plurality of toothed portions on its perimeter is attached to the central shaft of rotation 285*a* of the rear sprockets 285, and a sensor 301 that detects these toothed portions of the gear plate 300 is attached to the rear support shield 281. Also, near the front sprockets 283, a sensor 302 that detects the pushing pieces 291 is attached to the mounting frame 288.

The commodity conveyor guide mechanism 279 is described in detail with reference to FIG. 16(*a*), (*b*), 25 and 26.

A pair of upper and lower mounting plates 303 are attached inside the left and right machine frames 1, 2 behind the fixed support base 193, with bolts 304 being rotatably supported perpendicularly between the mounting plates 303. These bolts 304 are linked to the driving shaft 211 on the fixed support base 193 side through pulleys 305, belts 306, pulleys 307, gears 308, and gears 309. Movable blocks 310 are screwed to the bolts 304, a support plate 311 spanning the interval between these movable blocks 310. A pair of front and rear suspended rods 312 are supported such that they are movable upward or downward on the left and right side of the lateral middle portion of the support plate 311. A pair of left and right guide shields 313, extending forward and rearward above the bottom surface rear first folding plates 166, are attached to the tips of the suspended rods 312. Also, guide shields 314 are attached to the front ends of the guide shields 313, extending to the front of the fixed support base 193 above the bottom surface rear first folding plates 166. Coil springs 315 are wound around the suspended rods 312, between the support plates 311 and the guide shields 313, forcing the suspended rods 312 downward through their elastic force.

In the wrapper folding device C, the connecting plates 254 of the wrapper conveyor 3 passing on top of the connecting plates 252 of the movable support base 241 side extend up to the rear portions of the fixed support base 193. Guide shields 317 are attached via connecting plates 316 to the rear end inner side of the connecting plates 254, above the bottom surface rear first folding plates 166. These guide shields 317 and guide shields 313 extend up to the upper portion of the front ends of the upper support base 41 of the wrapper supply device A.

When the driving shaft 211 rotates, the bolts 304 rotate and the female screw pieces 310 move upward or downward, the guide shields 313, 314 also move upward or downward and approach or move away from the bottom surface rear first folding plates 166. Due to this, the vertical interval R313 between the guide shields 313, 314 and the bottom surface rear first folding plates 166 can be adjusted according to the height H of the commodity 500. Also, when the left and right conveyor belt portions 8 of the wrapper conveyor 3 approach or move away from each other, since the connecting plates 254 linked to these also move laterally, as a result of the movement of these connecting plates 254, the left and right guide shields 317 also approach or move away from the lateral central position 37*a* of the wrapping region 37. As a result, the lateral interval S317 between the guide shields 317 can be adjusted according to the lateral length L of the commodity 500.

Tape Disposing Device E

Next, the tape disposing device E is described with reference to FIG. 1, FIG. 14 and FIGS. 27 to 29.

The tape disposing device E is provided between the rear ends of the guide shields 313, 317 of the commodity conveyor guide mechanism 279 and the front ends of the upper support base 41 of the wrapper dispensing mechanism 4, and has a pair of left and right tape disposing mechanisms 318.

The tape disposing mechanisms 318 are next described in detail.

A rotatable shaft 319 is supported below the mounting plate 182*b*, between the left and right machine frames 1, 2, both of its ends being formed with threaded portions 319*a*, 319*b* having opposite screwing directions. Female screw pieces 320 are screwed to these threaded portions 319*a*, 319*b*, and are laterally movably fitted to the rail 182*c* attached to the lower side of the mounting plate 182*b*. Side plates 321 extending forward are attached to the female screw pieces 320. A circular tape mounting plate 322 is rotatably supported at the lower inner surface of the side plate 321, its central shaft of rotation 323 being mounted with a toothed plate 324 having toothed portions throughout its perimeter. A sensor 325 corresponding to this toothed plate 324 is attached to the side plate 321 to detect its toothed portions.

An arm 326 is supported in the upper inner side of the side plate 321, such that it is tiltable forward or rearward with a shaft 327 as the center of rotation. A flat spring 328 is attached to the arm 326, such that is extends upward like a cantilevered beam past the central shaft of slanting rotation 327, its tip portion 328*a* forming an L-shape that folds rearward. A tape drawing roller 329 is supported on the arm 326, in front of the flat spring 328, the middle portion of the flat spring 328 pressing against this tape drawing roller 329. A little above this contact portion, a tape disposing pin 330 is supported on the arm 326. A tape guide plate 331 is provided on the arms 326, extending downward behind the flat spring 328, and below the central shaft of slanting rotation 327 of the arm 326, and in front of the tape guide plate 331, a tape guide pin 332 is supported on the side plate 321. An end portion 601 of a tape 600 fitted to the circular tape mounting plate 322 is inserted between the flat spring 328 and the tape drawing roller 329 after passing through the tape guide pin 332*a* on the side 321, the lower tip of the tape guide plate 331, the tape guide pine 332, and the tape guide pin 332*b* on the arm 326, then further inserted between the flat spring 328 and the tape drawing pin 330, finally being guided by the tip portion 328*a* of the flat spring 328. A tape pressing roller 333 is supported on the side plate 321, behind the flat spring spring 328.

On the outer side of the side plate 321, a tape drawing rotary solenoid 334 is attached such that it transmits a rotational motion to the central shaft of slanting rotation 327 of the arm 326. A one-way clutch 336 is fitted between the tape drawing roller 329 and its central shaft of rotation 335, the tape drawing roller being enabled to rotate only in the direction of the arrow e. The central axis of rotation 335 of the tape drawing roller 329 is linked to the central axis of slanting rotation 327 of the arm 326 via the gears 337, 338.

Figure 29:
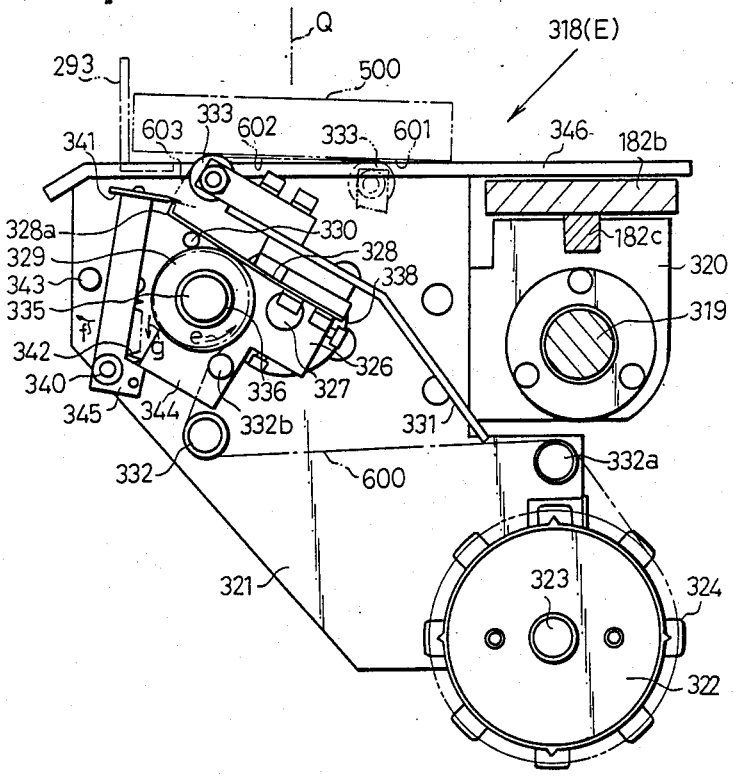

In front of the arm 326, a tiltable shield 339, tiltable forward and rearward with a shaft 340 as the center of rotation, is supported on the side plate 321, with a cutter 341 being attached to the upper end of the tiltable shield 339 that extends upward past the shaft 340. Corresponding to this tiltable shield 339, on the side plate 321, the tip of a spring 342 is fixed, a stopper pin 343 perforates through, and the other tip of the spring 342 is linked to the tiltable shield 339. As a result of this elastic force, the tiltable shield 339 tilts in the direction of the arrow f then stops upon coming in contact with the stopper pin 343. Locking portions 344, 345 are provided on the front side of the arm 326 and on the basal portion of the tiltable shield 339 respectively, and as shown in FIG. 29, when the arm 326 rotates in the direction of the arrow g, the locking portion 344 comes in contact with the locking portion 345 of the tiltable shield 339. The tiltable shield 339 is rotated in the direction of the arrow f, against the elastic force of the spring 342, and cuts an end portion 601 of the tape 600 a little behind the tip portion 328*a* of the flat spring 328.

A commodity support plate 346 is formed on the side plate 321 such that it extends forward and backward, its rear end portion being on the mounting plate 182*b*. The tip portion 328*a* of the flat spring 328, the tape drawing roller 329, the tape pressing roller 333 and cutter 341 are located inside this commodity support plate 346. The paths of rotation of the tip portion 328*a* of the flat spring 328 and the tape pressing roller 333 are such that they reach a little beyond the commodity support plate 346.

In the inner side of the left machine frame 1, sprockets 347, 348 are fixed to the rotatable shaft 319 and the rear rotatable shaft 6 of the wrapper conveyor 3 respectively, these sprockets being linked by a chain 349 through the sprockets 350, 351. When the rear rotatable shaft 6 rotates, and the left and right conveyor belt portions 8 of the wrapper conveyor 3 approach or move away from each other, the rotatable shaft 319 rotates, and the pair of left and right tape disposing mechanisms 318, as a whole, approach or move away from the lateral central position 37*a* of the wrapping region 37.

A mechanism for adjusting the lateral interval S318 between the left and right tape disposing mechanisms 318 according to the lateral length L of the commodity 500 relative to the lateral central position 37*a* of the wrapping region 37, is formed, comprising the rotatable shaft 319, the female screw portions 320, and others, and a mechanism for linking with the lateral movement of the left and right conveyor belt portions 8 of the wrapper conveyor 3 is formed, comprising the chain 349, and others. The driving systems of the devices B and C.

Next, the driving system that causes the central support shield 112 of the commodity receiving base 109 of the commodity supply device B to ascend and descend, and the driving system that makes the bottom surface front first folding plates 165 of the wrapper folding device C move forward and backward, and the driving system that operates on the control wires 250, 201, 225, 273, 237 of the folding plates 167, 168, 169, 170, 171, 172, 173, 174, 175, 176 are described.

Figure 30:
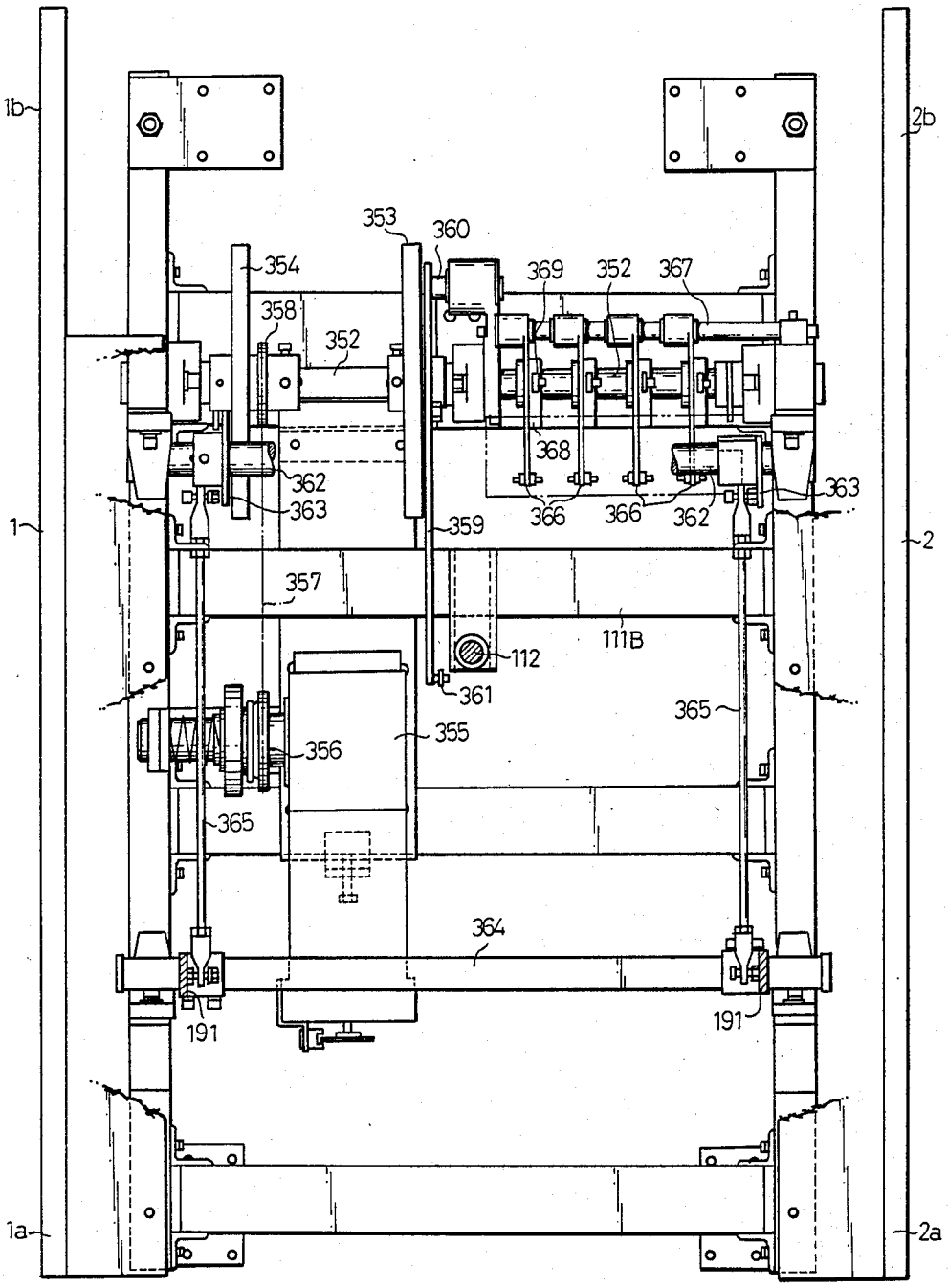
FIG. 30 is a partially broken plane view showing the driving systems of the various devices.

As shown in FIG. 30, a rotatable shaft 352 is supported between the lower portions on the rear side of the left and right machine frames 1, 2, a pair of cam plates 353, 354 being attached to this rotatable shaft 352. This rotatable shaft 352 is linked to a main motor 355 via a sprocket 356, a chain 357 and a sprocket 358. A lever 359 is rotatably supported near one of the cam plates 353, with a shaft 360 as the center of rotation, a cam roller (not shown) supported on the lever 359 being fitted to the cam plate 353. This lever 359 is linked to the upper end portion of the central support shield 112 by means of a rod 361. When the cam plate 353 rotates with the rotation of the main motor 355, the central support shield 112 moves upward or downward through the lever 359 and the rod 361.

A connecting shaft 362 is rotatably supported between the left and right machine frames 1, 2, above the cam plates 353, 354, both end portions of this connecting shaft 362 supporting a pair of levers 363, cam rollers (not shown) supported by one of these levers 363 and fitted to the cam plate 354. A connecting shaft 364 is rotatably supported between the lower portions on the front side of the left and right machine frames 1, 2. The levers 191 are supported at the end portions of this connecting shaft 364, these levers 191 and the levers 363 being connected by links 365. When the cam plate 354 rotates with the rotation of the main motor 335, the bottom surface front first folding plates 166 move forward or backward through the levers 363, the links 365 and the levers 191.

A plurality of levers 366 is rotatably supported on the upper left portion of the rotatable shaft 352, the wires 250, 201, 225, 273, 237 being connected at the tips of these levers 366. A cam plate 368 corresponding to these levers 366 is attached to the rotatable shaft 352, with cam rollers 369 pressed against the cam plate 368 being supported on the levers 366. When the cam plate 368 rotates with the rotation of the main motor 355, the levers 366 tilt and control the wires 250, 201, 225, 273, 237. Links between the devices A–E.

The above descriptions gave the mechanical structure of the wrapping machine of the present embodiment; specifically, it has the characteristic that when the lateral interval S8 between the left and right conveyor belt portions 8 are adjusted according to the lateral length L of the commodity 500 by the driving force of the position setting motor 31, the driving force and the movement of these conveyor belt portions 8 are transmitted, causing the lateral interval S8 between the left and right conveyor belt portions 8 of the wrapper conveyor 3, the lateral intervals S410, S411 between the crease marking rollers 410, 411, the lateral interval S40 between the left and right commodity guide plates 40, the lateral interval S117 of the left and right rear support shields 117 of the commodity receiving base mechanism 109, the lateral interval S167 during the folding of the left and right bottom surface front second folding plates 167, 168, the lateral interval S169 during the folding of the left and right bottom surface rear second folding plates 169, 170, the lateral interval S171 during the folding of the left and right front surface first folding plates 171, 172, the lateral interval S173 during the folding of the left and right rear surface first folding plates 173, 174, the lateral intervals S199, S248 between the left and right guide plates 199, 248, the lateral interval S205 between the left and right wrapper restrainers 205, the lateral interval S317 between the left and right guide shields 317, and the lateral interval S318 between the left and right tape disposing mechanisms 318 to be simultaneously adjusted. Also, when the front-to-back interval M124 between the front support shields 124 is adjusted according to the front-to-back width W of the commodity 500 by means of the position setting motor 132, the driving force is transmitted, causing the front-to-back interval M124 between the commodity stopper plates 163 of the front support shields 124 of the commodity receiving base mechanism 109, the front-to-back intervals M167, M168 during the folding of the bottom surface front second folding plates 167, 168 and the bottom surface rear second folding plates 169, 170, the front-to-back intervals M171, M172 during the folding of the front surface first folding plates 171, 172 and the rear surface first folding plates 173, 174, and the front-to-back interval M175 during the folding of the front surface second folding plates 175 and the rear surface second folding plates 176 to be simultaneously adjusted. Further, when the lateral interval S171 during the folding of the left and right front surface first folding plates 171, 172 and the lateral interval S173 during the folding of the left and right rear surface first folding plates 173, 174 are adjusted according to the height of the commodity 500 by driving the position setting motor 213, its driving force is transmitted, causing the vertical interval R313 between the guide shields 313, 314 and the bottom surface rear first folding plates 166 to be adjusted. The various moving mechanism are designed such that the dimensions of the respective intervals S8, S410, S411, S40, S117, S167, S169, S171, S173, S199, S248, S205, S317, S318, M124, M167, M168, M171, M172, M175, and R313 are set to appropriate values according to the lateral length L, the front-to-back width W and the height H of the commodity 500. The electrical structure of the wrapping machine.

Next, the electrical structure of the wrapping machine constructed above is described.

Figure 31:
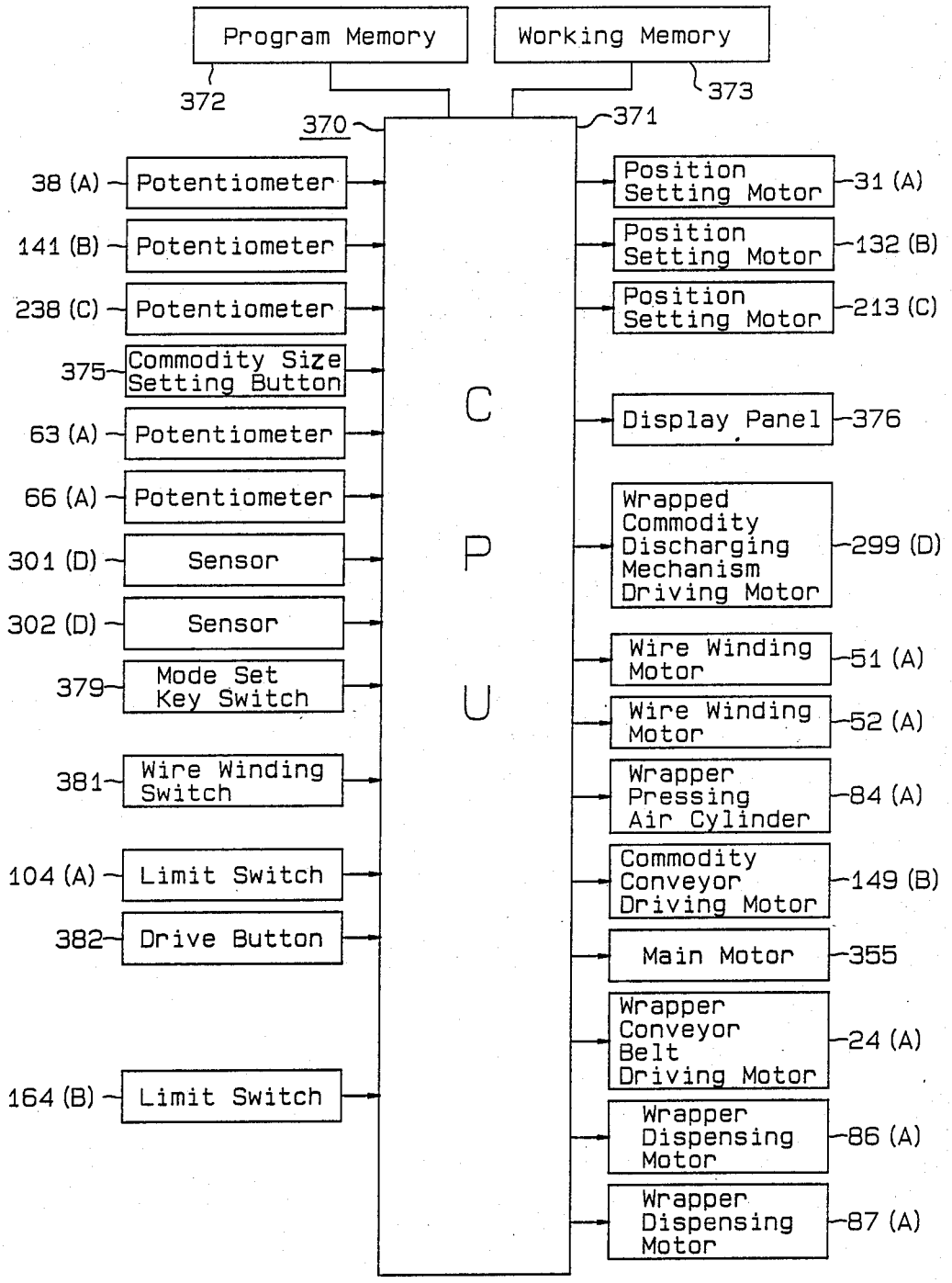
FIG. 31 is an electrical block diagram.
Figure 32:
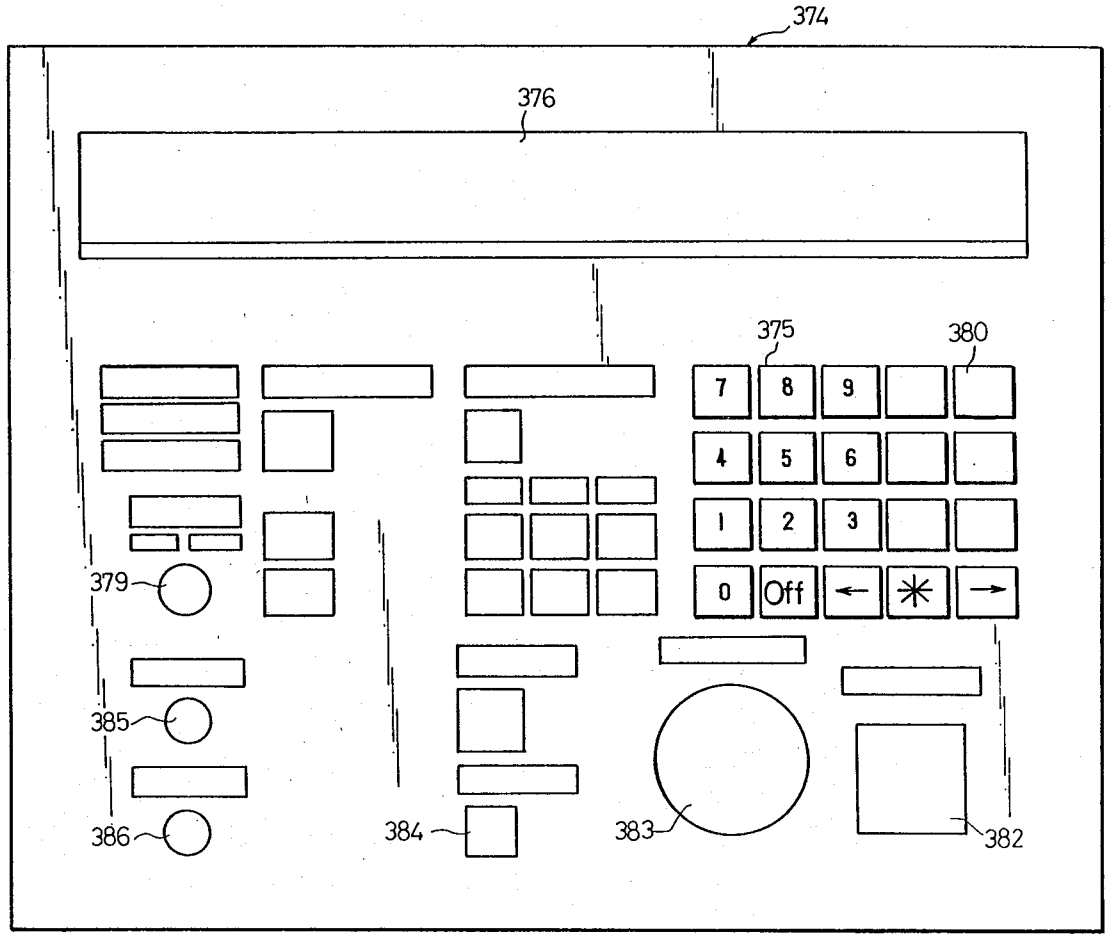
FIG. 32 is a font view showing the control box, FIG. 33(*a*), (*b*), (*c*), (*d*), (*e*) are operation diagrams showing the steps in the supply of a wrapper to the commodity, FIG. 34(*a*), (*b*), (*c*) are operation diagrams showing the drawing of a piece of wrapper, FIG. 35(*a*), (*b*), (*c*), (*d*) are perspective views showing the folding procedure of the wrapper on the commodity.
Figure 33C:
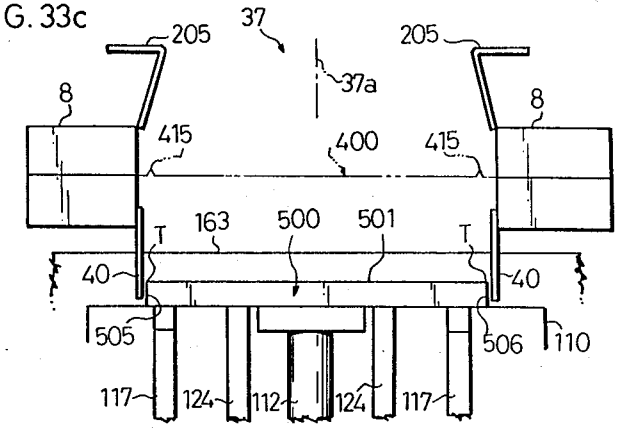
Figure 33B:
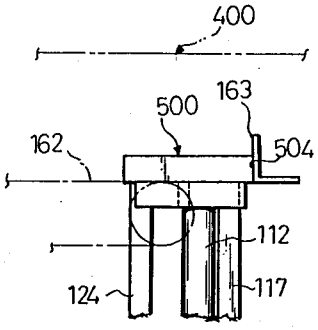
Figure 33A:
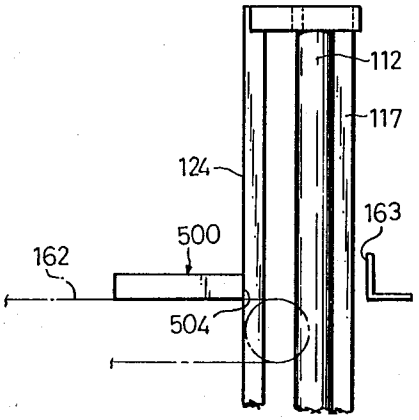
Figure 33E:
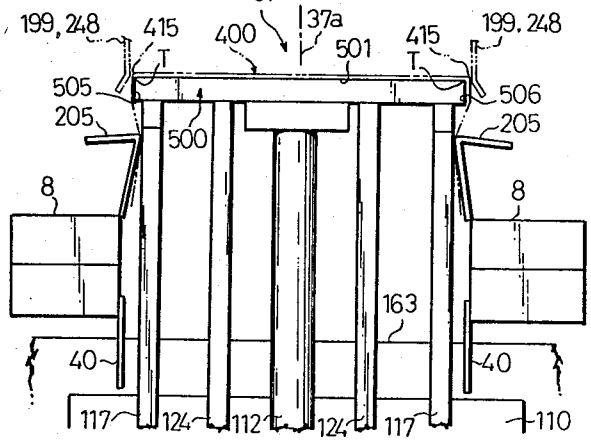
Figure 33D:
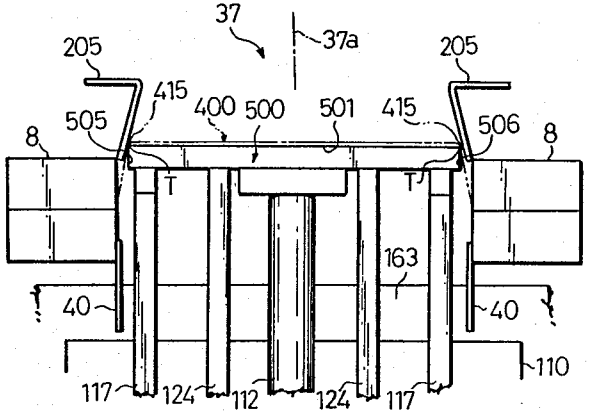

As shown in FIG. 31, a microcomputer 370 comprises a central processing unit 371 (hereinafter referred to as CPU), a program memory 372 made up of read only memory (ROM), and a work memory made up of random access memory (RAM), and is stored inside a control box 374, as shown in FIG. 32. The CPU 371 operates according to the control program stored in the program memory 372.

The position detecting potentiometer 38 (refer to FIG. 2), connected to the rear rotatable shaft 6 among the front and rear rotatable shafts 5, 6 supporting the left and right conveyor belt portions 8 of the wrapper conveyor 3 of the wrapper supply device A, detects signals respectively proportional to the lateral interval S8 between the conveyor belt portions 8, the lateral intervals S410, S411 between the crease marking rollers 410, 411 connected to these conveyor portions 8, the lateral interval S40 between the left and right commodity guide plates 70 attached to the conveyor belt portions 8, the lateral interval S117 between the left and right rear support shields 117 of the commodity receiving base mechanism 109 of the commodity supply device B, the lateral interval S167 between the left and right bottom surface front second folding plates 167, 168 of the wrapper folding device C, the lateral interval S169 between the left and right bottom surface rear second folding plates 169, 170, the lateral interval S171 between the left and right front surface first folding plates 171, 172, the lateral interval S173 between the left and right rear surface first folding plates 173, 174, the lateral intervals S199, S248 between the left and right guide plates 199, 248, the lateral intervals 205 between the left and right wrapper restrainers 205, the lateral interval S317 between the left and right guide shields 317 of the wrapper disposing device D, and the lateral interval S318 between the left and right tape disposing mechanisms 318, according to the lateral length L of the commodity 500, and sends these detected signals to the CPU 371.

The position detecting potentiometer 141 (refer to FIG. 9), connected to the right rotatable shaft 127 in the commodity receiving base mechanism 109 of the commodity supply device B, detects signals respectively proportional to the front-to-back interval M124 between the front support shields 124 and the commodity stopper plates 163, the front-to-back intervals M167, M168 between the bottom surface front second folding plates 167, 168 and the bottom surface rear second folding plates 169, 170, the front-to-back intervals M171, M172 between the front surface first folding plates 171, 172 and the rear surface first folding plates 173, 174, and the front-to-back interval M175 between the front surface second folding plates 175 and the rear surface second folding plates 176, according to the front-to-back width W of the commodity 500, and send these detected signals to the CPU 371.

The position detecting potentiometer 238 (refer to FIG. 17), connected to the threaded rods 226 on the fixed support base 193 side of the wrapper folding device C, detects signals respectively proportional to the lateral interval S171 between the left and right front surface first folding plates 171, 172, the lateral interval S173 between the left and right rear surface first folding plates 173, 174, and the vertical interval R313 between the guide shields 313, 314 of the wrapped commodity conveyor guide mechanism 279, according to the height H of the commodity 500, and send these detected signals to the CPU 371.

Appropriate data for the values of the intervals S, M and R based on the values of the intervals S8, S410, S411, S40, S117, S167, S169, S171, S173, S199, S248, S205, S317, S318, M124, M167, M168, M171, M172, M175, and R313 derived according to the dimensions of the commodity 500 (lateral length L, front-to-back width W, and height H) are stored beforehand in the program memory 372. A commodity size setting button 375 is provided on the control box 374, and based on the signal received from this commodity size setting button 375, the CPU 371 calculates the dimensions L, W and H of the commodity 500, calls the values for the intervals S, M and R corresponding to the dimensions L, W and H of the commodity 500, and drives the position setting motors 31, 132, 213 until the signals detected by the position detecting potentiometers 38, 141, 238 match the intervals S, M and R.

The wrapper size detecting potentiometers 63 (refer to FIG. 4) connected to the rear position defining plates 53 on the support bases 41, 42 in the wrapper dispensing mechanism 4 of the wrapper supply device A, and the wrapper size detecting potentiometer 66 (refer to FIG. 4) connected to the left and right position defining plates 58, 59 of the same support bases 41, 42 detect signals proportional to the size of the wrapper 400, and send these detected signals to the CPU 371.

Appropriate sizes of the wrapper 400 corresponding to the dimensions L, W and H of the commodity 500 are stored beforehand in the program memory 372. A display panel 376 is provided on the control box 374. The CPU 371 calculates the size of the wrapper 400 based on the detected signals from the potentiometers 63, 66, and another size of the wrapper 400 based on the detected signals from the commodity size setting buttons 375. When both the wrappers 400 on the upper and lower support bases 41, 42 are outside the range of the set size, the CPU 371 displays this information and the set size through the display panel 376.

Figure 24A:
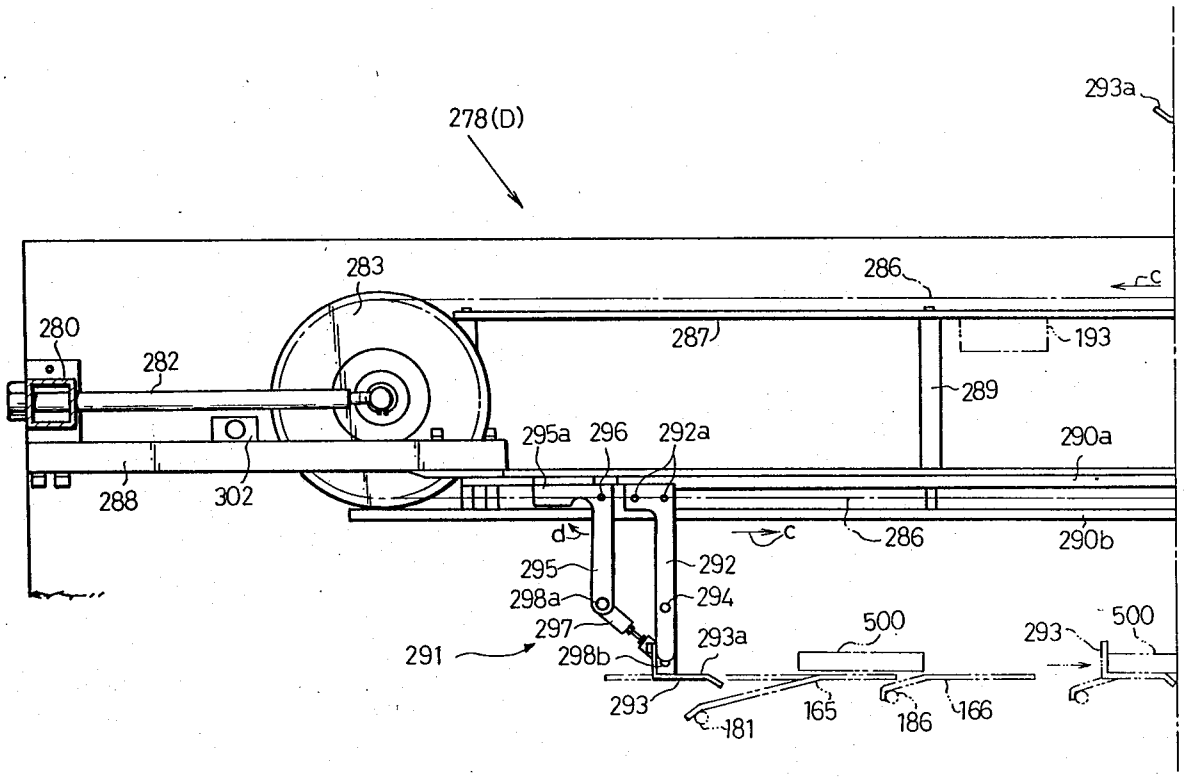
FIG. 24(*a*) to FIG. 26 show a commodity conveying device.
Figure 24B:
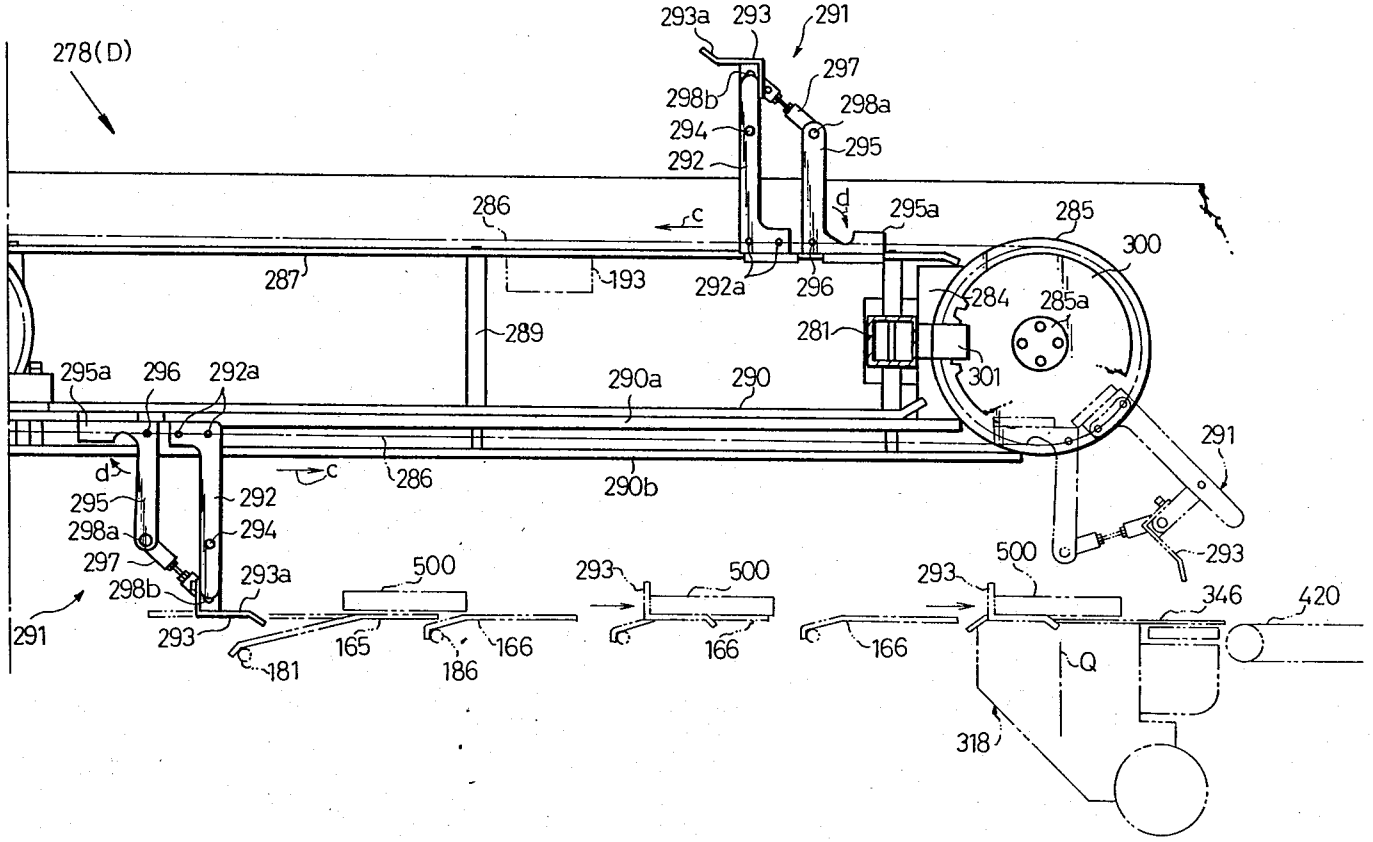

The sensor 301 that detects the toothed plate 300 in the wrapped commodity discharging mechanism 278 of the wrapped commodity conveying device D and the sensor 302 that detects the pushing piece 291 (refer to FIG. 24(*a*), (*b*)) send inputs to the CPU 371, and the CPU 371 counts the number of toothed portions of the toothed plate 300 as detected by the sensor 301, after the sensor 302 has detected the pushing pieces 291. The CPU 371 controls the resting position of the pushing pieces 291 such that the commodity 500 comes to rest in a position where the front-to-back center of the commodity 500 corresponds to the tape disposing center of the tape disposing mechanisms 318. The appropriate numbers of counts based on the front-to-back width W of the commodity 500 are stored beforehand in the program memory. The CPU 317 calculates the number of counts based on the signals from the sensor 301, calculates the fixed number of counts based on the signals from the commodity size setting button 375, and when these two values match, it disenables the wrapped commodity discharging mechanism driving motor 299.

Another function of the CPU 371 is to control the operation of the wrapping machine, based on the control program stored in the program memory 372.

The control means adjusts the amount of supply of the wrapper relative to the wrapping region according to the width and height of the commodity and to the length of the wrapper in the supplying direction, calculates the position of the seam of the wrapper formed in the direction of the width of the wrapper on the bottom surface of the commodity according to the width and height of the commodity and to the amount of supply of the wrapper, and determines the conveying distance of the commodity such that the seam of the wrapper is positioned in the tape disposing center of the tape disposing means.

Operation of the wrapping machine

Next, the operation of the wrapping machine constructed above is described.

First, the various parts of the wrapping machine are set according to the dimensions of the commodity 500.

After the power supply is turned on, the mode set key switch 379 is set to operating, and the dimension L, W and H of the commodity 500 are set by means of the commodity size setting buttons 375, and are displayed in the display panel 376. When the start button 380 is pressed after having confirmed that the display is correct, in response to this signal, based on the stored values of the intervals S, M and R corresponding to the dimensions of the commodity 500, the CPU 371 automatically sets the intervals S8, S410, S411, S40, S117, S167, S169, S248, S205, S317, S318, M124, M167, M168, M171, M172, M175, and R313.

In this case, as mentioned earlier, the CPU 371 determines the size of the wrapper 400 based on the stored fixed data corresponding to the dimensions L, W and H of the commodity 500. However, when the wrappers 400 on both the upper and lower support bases 41, 42 of the wrapper dispensing mechanism 4 of the wrapper supply device A are not within the range of the set size, this information and the set size are displayed on the display panel 376. Consequently, the operator replaces the wrapper 400 on the upper and lower support bases 41, 42. After replacement, the message on the display panel 376 disappears, and operation is enabled. When only one of the wrappers 400 on the upper and lower support bases 41, 42 is within the set size, the wrapper 400 within the set size is used, and operation is enabled. When both of the wrappers 400 are within the set size, the smaller one is chosen, and operation is enabled.

Figure 34A:
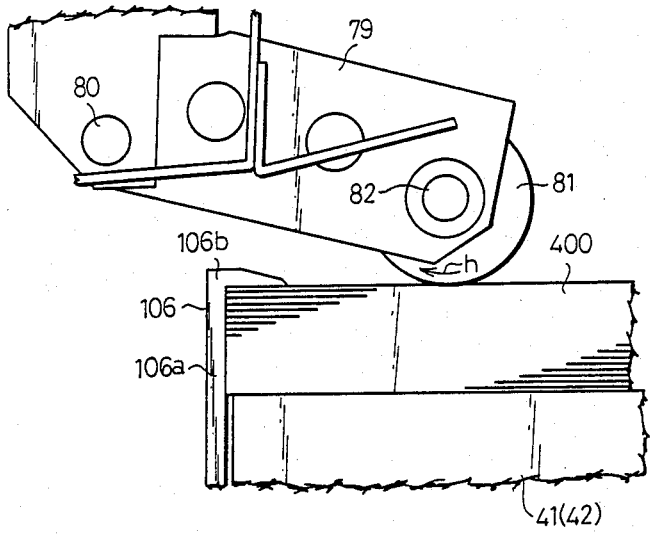
Figure 34B:
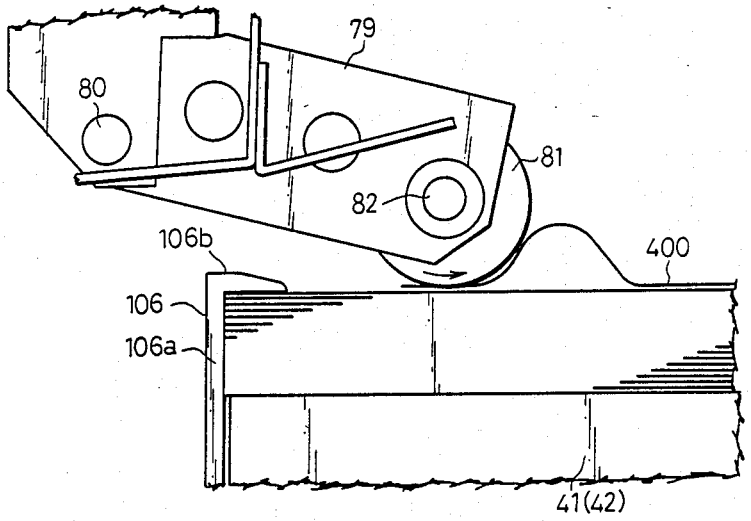
Figure 34C:
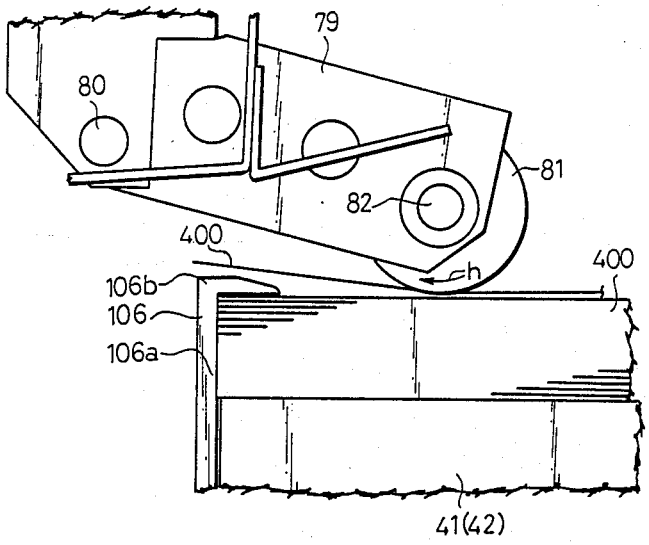
Figure 35A:
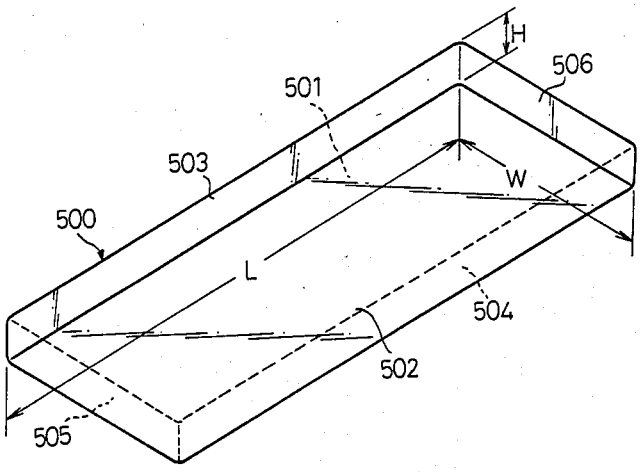
Figure 35B:
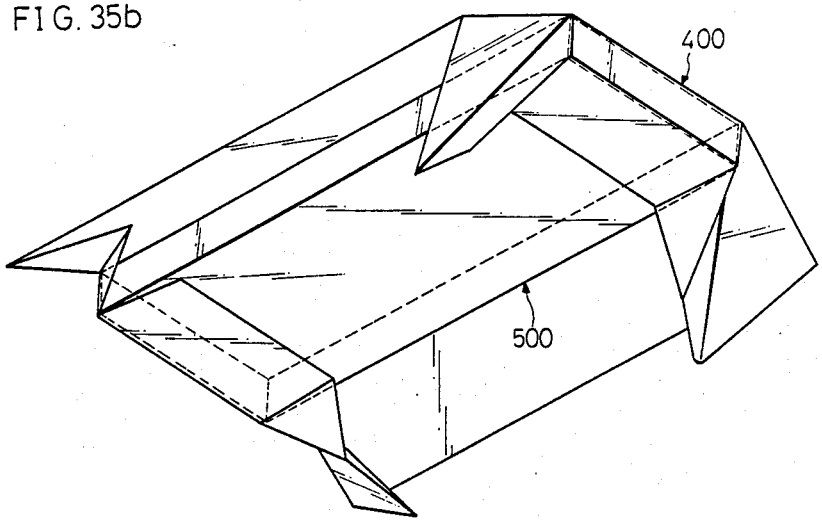
Figure 35C:
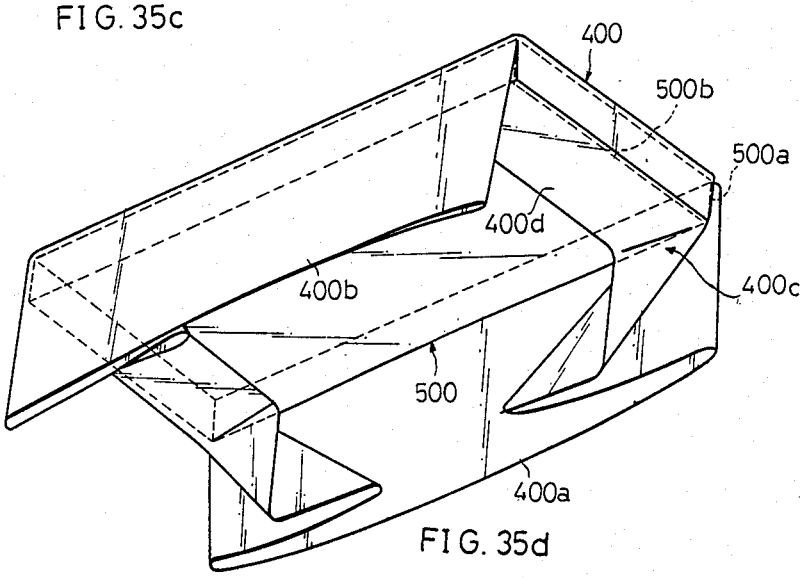
Figure 35D:
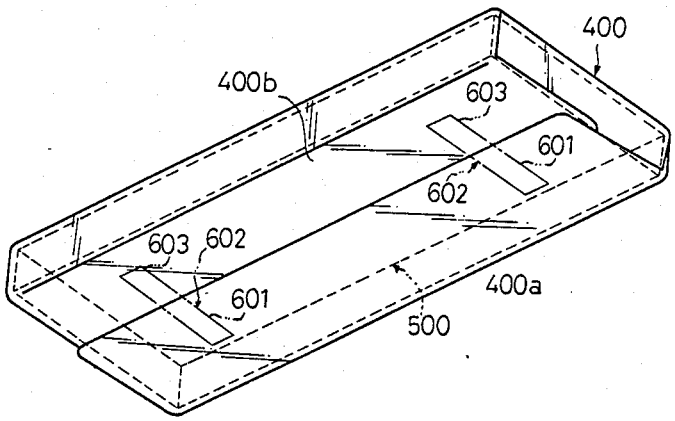

Setting of the upper and lower support bases 41, 42 is done simultaneous with the process of inputting the commodity size. Hence, when the switch 381 is pressed (since it is not on the control box 374, it is shown only in FIG. 31), the upper and lower wire winding motors 51, 52 in the wrapper dispensing mechanism 4 of the wrapper supply device A are driven, and the upper and lower support bases 41, 42 are tilted upward through the upper and lower suspension wires 45, 46. Due to this tilting process, the support pieces 79 are pushed and rotate upward through the rotatable rollers 81, and the limit switches 104 are pushed by the control plates **105*a* and the control rods 105*b*, and are turned off. As a result, the motors 51, 52 stop operating, the air cylinders 84 are enabled and the piston rods 84*a* descend, and the rotatable rollers 81 are pressed against the front end portions of the wrappers 400 on the upper and lower support bases 41, 42. The setting of the wrappers 400 is thus completed. In this set condition, as shown in FIG. 34**(*a*), the front end portions of the wrappers 400 are in contact with the orthogonal portions **106*a* of the pressing pieces 106, and are pressed downward by the hooked portions 106*b***.

Figure 12A:
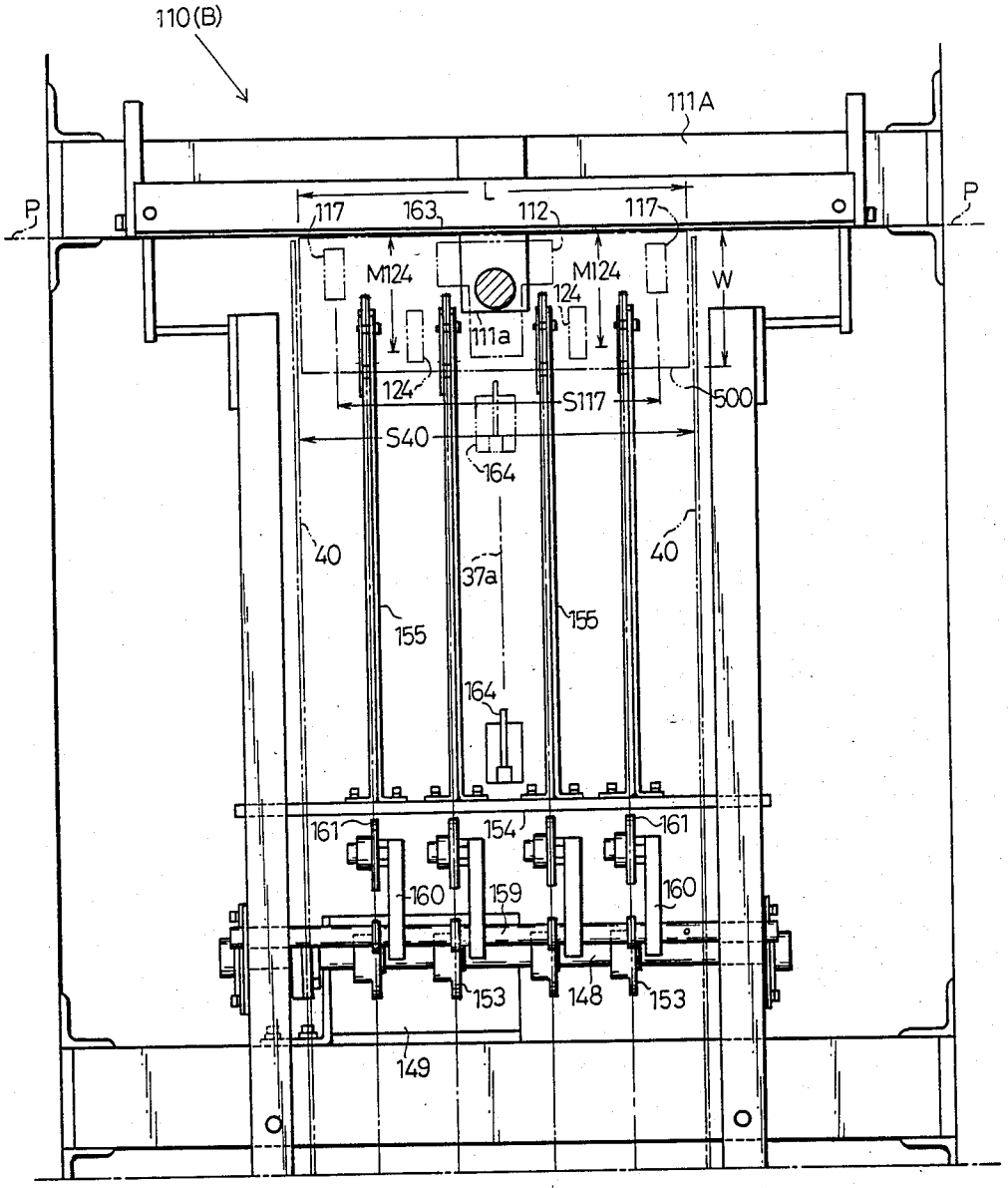
Figure 12B:
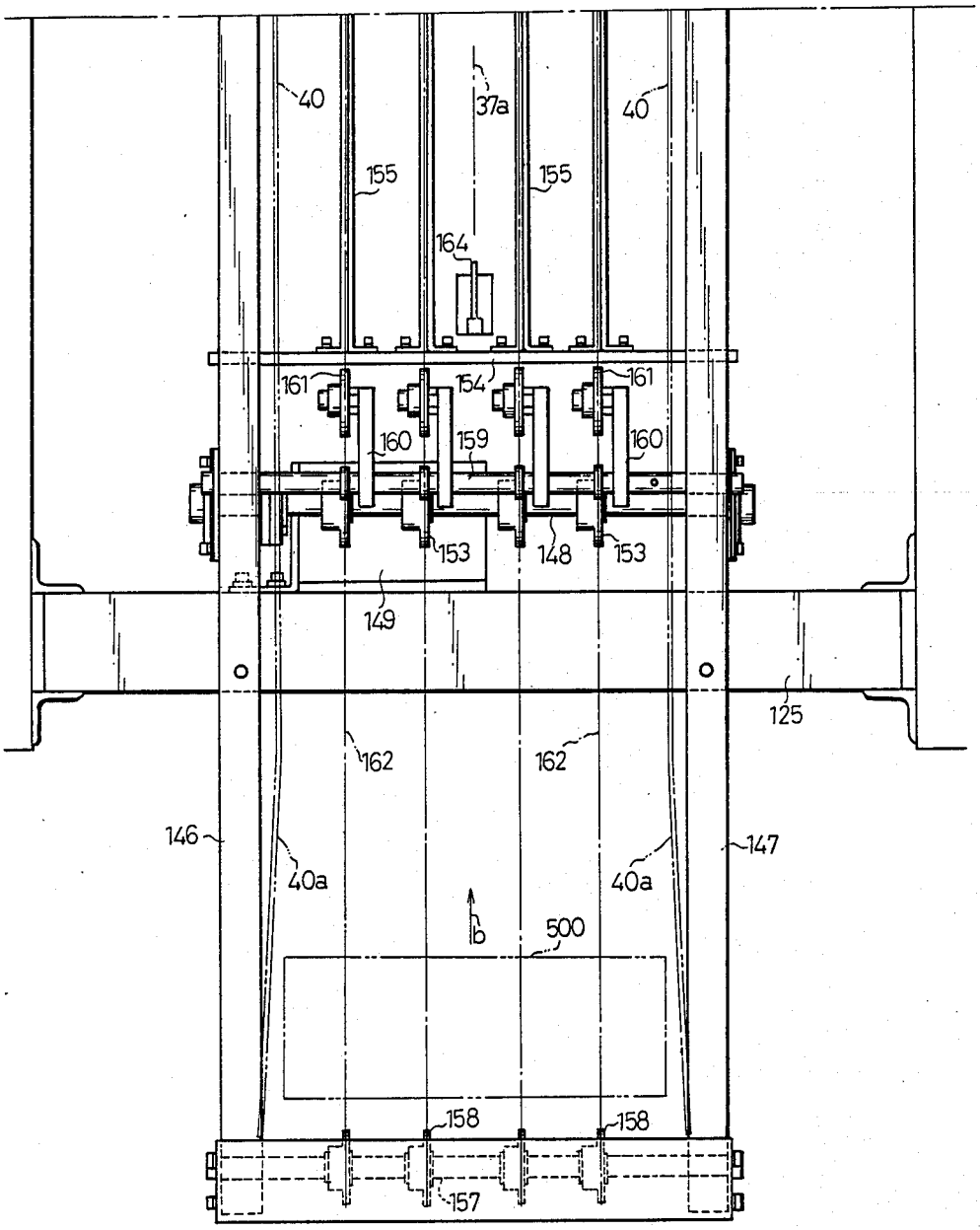
Figure 13:
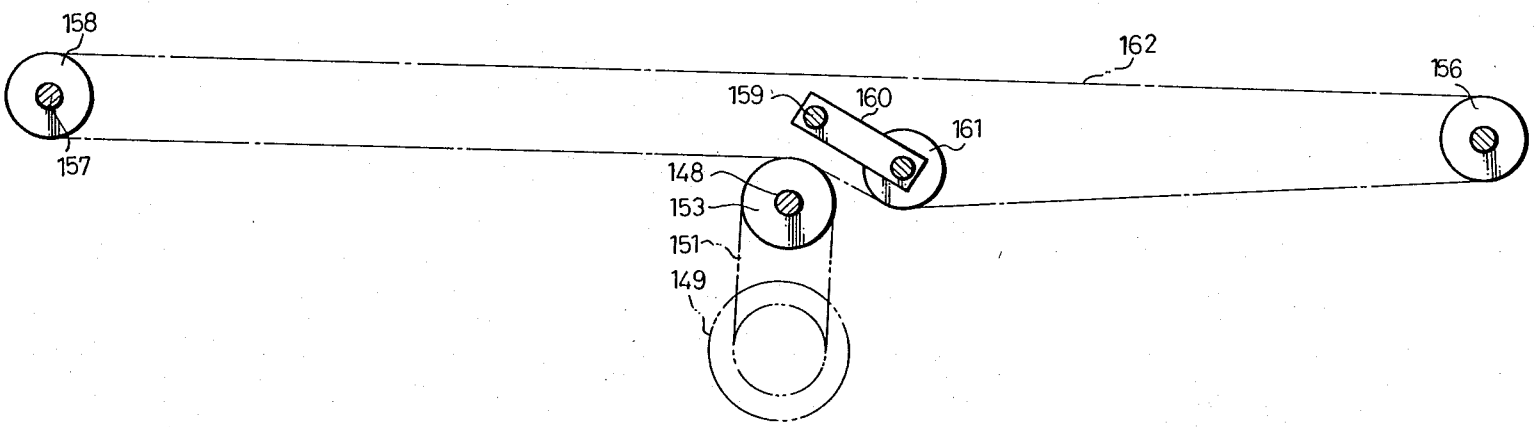

Then when the drive button 382 is pressed, as shown in FIG. 12(*a*), (*b*), first, the motor 149 in the commodity conveyor 110 of the commodity supply device B is driven, and the chains 162 are rotated. When the commodity 500 is placed on the front end portion of the chains 162, the commodity 500 is conveyed in the direction of the arrow b as it is guided by the commodity guide plates 40, and as shown in FIG. 33(*a*), it comes in contact with the front support shield 124 of the stationary commodity receiving base mechanism 109 at the topmost position and comes to rest. At this point, the commodity 500 presses the limit switches 164. When these limit switches 164 are pressed, the main motor 355, the belt driving motor 24 of the wrapper conveyor 3, and (only one of) the wrapper disposing motors 86, 87 of the wrapper dispensing mechanism 4 are driven.

When the main motor 355 is driven, the support shields 112, 117, 124 in the commodity receiving base mechanism 109 of the commodity supply device B are elevated, the folding plates 165, 166, 167, 168, 169, 170, 171, 172, 173, 174, 175, 176 in the wrapper folding device G are operated.

As shown in FIG. 33(*b*) and 33(*c*), when the support shields 112, 117, 124 of the commodity receiving base mechanism reaches its lowest position from its topmost position due to the operation of the main motor 355, the commodity 500 is conveyed onto the support shields 112, 117, 124, comes in contact with the commodity stopper plates 63 and comes to rest.

When the motors 86, 87 of the wrapper dispensing mechanism 4 of the wrapper supply device A rotate, as shown in FIG. 34(*b*), first, the rotatable rollers 83 rotate in a direction opposite that of the dispensing direction h, the front end portion of the uppermost wrapper 400 is freed from the hooked portion **106*b* of the pressing piece 106, and as shown in FIG. 34**(*c*), the rotatable rollers 81 rotate in the direction of the dispensing direction h, and only the uppermost wrapper 400 is dispensed. During this time, air is being blown against the front end portion of the wrapper 400 from the air blowing nozzle 107 (refer to FIG. 6). This wrapper 400 passes through the guide paths 73, 74, 78 until it reaches the rear end portion of the wrapper conveyor 3. Here, when the sensor 108 detects the front end portion of the wrapper 400, the piston rods **84*a* of the air cylinders 84, as well as the support piece 79 ascend, and the rotatable rollers 81 move away from the wrapper 400. The wrapper 400 is inserted between the upper and lower conveyor belts 22, 23 of the left and right conveyor belt portions 8 of the wrapper conveyor 3 and carried to the wrapping region 37. Along the way, both sides of the wrapper 400 pass through the pair of crease marking rollers 410, 411 and becomes inserted between the recessed grooves 412 and the protruding portions 413, leaving creases 415 on both sides of the wrapper 400 along the direction of conveyance a, from the front end to the rear end, as shown in FIG. 3**(*d*). Since the number of driving pulses for the belt driving motor 24 of the wrapper conveyor 3 corresponding to the front-to-back width W of the commodity 500 and the front-to-back size of the wrapper 400 is stored beforehand in the CPU 371, based on the appropriate number of pulses, the wrapper 400 above the commodity 500 resting on the support shields 112, 117, 124 of the commodity receiving base mechanism 109 on the lowermost position is made to stop at the set position of the wrapping region 37. In this rest position, the creases 415 on the wrapper 400 is positioned right above the corners T on the top surface 501 of the commodity 500 along the direction of conveyance a of the wrapper 400.

Afterward, as shown in FIG. 33(*d*), 33(*e*), when the support shields 112, 117 of the commodity receiving base mechanisms 109 ascend, first, the commodity 500 ascends along the commodity stopper plates 163, and is sandwiched between the upper and lower conveyor belts 22, 23 of the left and right conveyor belt portions 8 of the wrapper conveyor 3, and the top surface 501 of the commodity 500 comes in contact with the wrapper 400 set on the wrapping region 37, bringing the wrapper 400 with it. When this happens, the corners T on the top surface 501 of the commodity 500 formed along the direction of conveyance a of the wrapper 400 are accurately aligned with the creases 415 on the wrapper 400, as shown in FIG. 3(*e*). Therefore, since both ends of the wrapper 400 do not evenly slip off the interval between the pair of conveyor belts 22, 23, even if the wrapper 400 shifts towards any of the conveyor belts 22, 23, this shift can be prevented as the creases 415 are locked with the corners T of the commodity 500. Further, the left and right portions of the wrapper 400 are freed from the interval between the upper and lower conveyor belts 22, 23 of the left and right conveyor belt portions 8, while being sandwiched between the wrapper restrainers 205 located inside the left and right conveyor belt portions 8 of the wrapper conveyor 3 and the left and right side surfaces 505, 506 of the commodity 500. In this state, the lateral movement of the commodity 500 is regulated by the left and right guide plates 199, 248.

A little before the support shields 112, 117, 124 of the commodity receiving base mechanism 109 start to ascend from their lowermost positions, the front and rear bottom surface first folding plates 165, 177 both start to open starting from their most closed state. These front and rear bottom surface first folding plates 165, 166 become completely opened a little before the support shields 112, 117, 124 reach their uppermost positions.

Afterwards, the left and right front surface first folding plates 171, 172 and the left and right rear surface first folding plates 173, 174 pass along the front surface 503 and the rear surface 504 of the commodity 500 as they enter diagonally upward and inward from the lower corners of the front surface 503 and rear surface 504. When the support shields 112, 117, 124 reach their uppermost positions, the slanting folding edges **222*a*, 259*a* come to rest at positions where they extend diagonally downward and inward from the upper corners T of the front surface 503 and rear surface 504, as shown in FIG. 23**(*a*). After the left and right front surface first folding plates 171, 172 and the left and right rear surface first folding plates 173, 174 have started to fold towards the commodity 500, right before the support shields 112, 117, 124 reach their uppermost positions, the left and right bottom surface front second folding plates 167, 168 and the left and right bottom surface rear folding plates 169, 170 begin to fold, passing along the front portion and the rear portion of the bottom surface 502 of the commodity 500. This process of folding stops as soon as the support shields 112, 117, 124 reach their uppermost positions, and the commodity 500 is placed on the left and right bottom surface front second folding plates 167, 168 and the left and right bottom surface rear second folding plates 169, 170. As a result, the support shields 112, 117, 124 begin to descend. A midway state in the folding process mentioned above is shown in FIG. 35(*b*).

Simultaneous with the descent of the support shields, the front surface second folding plates 175 and the rear surface second folding plates 176 start to approach each other toward the front surface 503 and the rear surface 504 of the commodity 500. When these front surface second folding plates 175 and rear surface second folding plates 176 come in contact with the front surface 503 and the rear surface 504 of the commodity 500 via the left and right front surface first folding plates 171, 172 and the left and right rear surface first folding plates 173, 174, the front and rear bottom surface first folding plates 165, 166 begin to close starting from their most opened state. Right after the front surface second folding plates 175 and the rear surface second folding plates 176 have come in contact with the front surface 503 and the rear surface 504 of the commodity 500, the left and right front surface first folding plates 171, 172, and the left and right rear surface first folding plates 173, 174 begin to open, and the left and right bottom surface front second folding plates 167, 168 and the left and right bottom surface rear second folding plates 169, 170, from their rest conditions, begin to fold further, and this folding stops right after the left and right front surface first folding plates 171, 172 and the left and right rear surface first folding plates 173, 174 have completely opened. A midway state in the folding process mentioned above is shown in FIG. 35(*c*).

Then, right before the front and rear bottom surface first folding plates 165, 166 are completely closed, the left and right bottom surface front second folding plates 167, 168, the left and right bottom surface rear second folding plates 169, 170, the front surface second folding plates 175, and the rear surface second folding plates 176 begin to open, and will become completely opened as soon as the front and rear bottom surface first folding plates 165, 166 are completely closed. A midway state in the folding process mentioned above is shown in FIG. 35(*d*).

The support shields 112, 117, 124 reach their lowermost positions midway in the folding process. As mentioned earlier, the commodity 500 is placed on these support shields, and the wrapper 400 is carried to the wrapping region 37.

The commodity 500 wrapped with the wrapper 400 in the manner described above is placed on the front and rear bottom surface first folding plates 165, 166 which are in the closed state, as shown in FIG. 24(*a*), (*b*). In this state, when the chain 286 rotates as the motor 299 of the wrapped commodity discharging mechanism 278 is driven, after the pushing pieces 291 has been detected by the sensor 302, it moves forward toward the commodity 500. The support portions **293*a* of the pushing pieces 291 are inserted below the bottom surface of the wrapped commodity 500 in the wrapping region 37, and in this state, the pushing arms 292 of the pushing pieces 291 push the wrapped commodity 500 rearward. With the movement of these pushing pieces 291, the front and rear bottom surface first folding plates 165, 166 open, and the wrapped commodity 500 is also loaded on the rear bottom surface first folding plate 166, on the left and right sides of the pushing pieces 291**.

In this manner, the wrapped commodity 500 is pushed rearward by the pushing arms 292 of the pushing pieces 291 while being loaded on the support portions **293*a* of the disposing pieces 291 and the rear bottom surface first folding plates 166. Then, the wrapped commodity is guided toward the upper portion of the left and right tape disposing mechanisms 318 through the guide shields 313, 314, 317 of the wrapped commodity conveyor guide mechanism 279, and rests on the tape disposing center Q on the left and right support plates 346, when the motor 299 of the wrapped commodity discharging mechanism 278 stops. The rear bottom surface first folding plates 176 come to rest in front of the support plate 346**.

In this state, when the tape drawing rotary solenoids 334 of the left and right tape disposing mechanisms 318 are driven, as shown in FIG. 29, the arm 326 tilts in the direction of the arrow g, and the tape drawing rollers 329 rotate in the direction of the arrow e. An end 601 of the tape 600 disposed from the tip **328*a* of the flat spring 328 comes in contact with the left and right sides of the bottom surface 502 of the wrapped commodity 500 and is applied thereon by the tape pressing rollers 333. The tape 600 is gradually applied on the bottom surface 502 of the commodity 500 while it is being supported by the pressing rollers 333. At the same time the tape 600 is being drawn out of the circular tape mounting plate 322** by the rotation of the tape drawing rollers 329 while it is being pressed by the tape guide plates 331. When the locking portion 344 of the arm 326 makes contact with the cutter tilting shield 339, the cutter tilting shield tilts in the direction of the arrow f against the elastic force of the spring 342, and the other end of the tape 600 is cut by the cutter 341 at the end portion 328*a* of the flat spring 328. Tape segments 603 are left at the cut portions 603, adhering to the left and right sides of the bottom surface 502 of the wrapped commodity 500.

After the tapes have been applied, the motor 278 of the wrapped commodity discharging mechanism 278 is again driven, and the wrapped commodity 500 is pushed rearward by the pushing pieces 291 where it is carried by the discharging conveyor 420. At the same time, the cut portions 603 of the tape segments 602 are also applied by the tape pressing rollers 333 on the bottom surface 502 of the wrapped commodity 500, and as shown in FIG. 35(*d*), the tape segment 602 is completely applied on the bottom surface 502 of the wrapped commodity 500.

When the commodity is being discharged, the process of folding the wrapper 400 on the next commodity 500 is already nearing completion, and this next wrapped commodity 500 is also discharged in the same manner.

Figure 27:
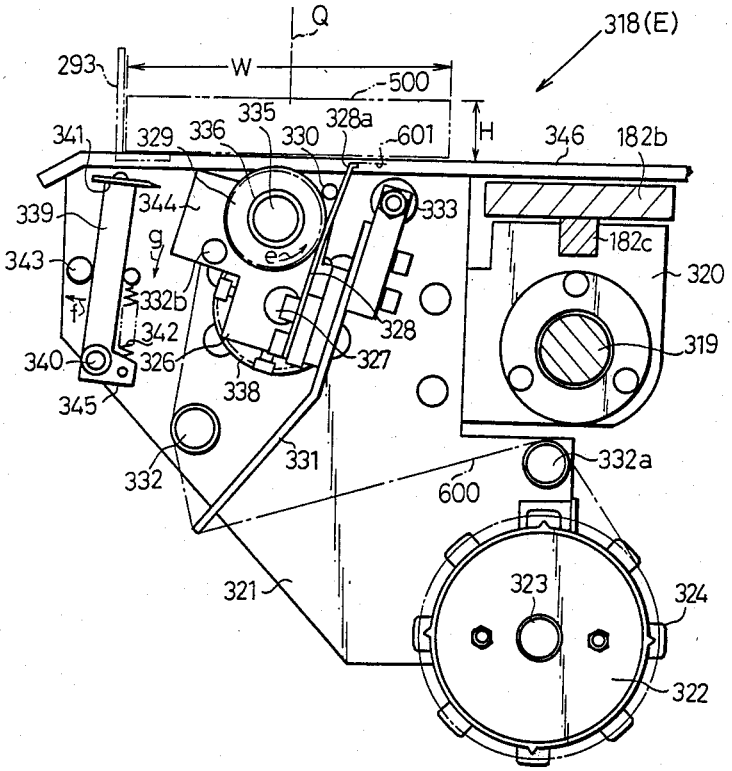
FIG. 27 to FIG. 29 show a tape applying mechanism.
Figure 28:
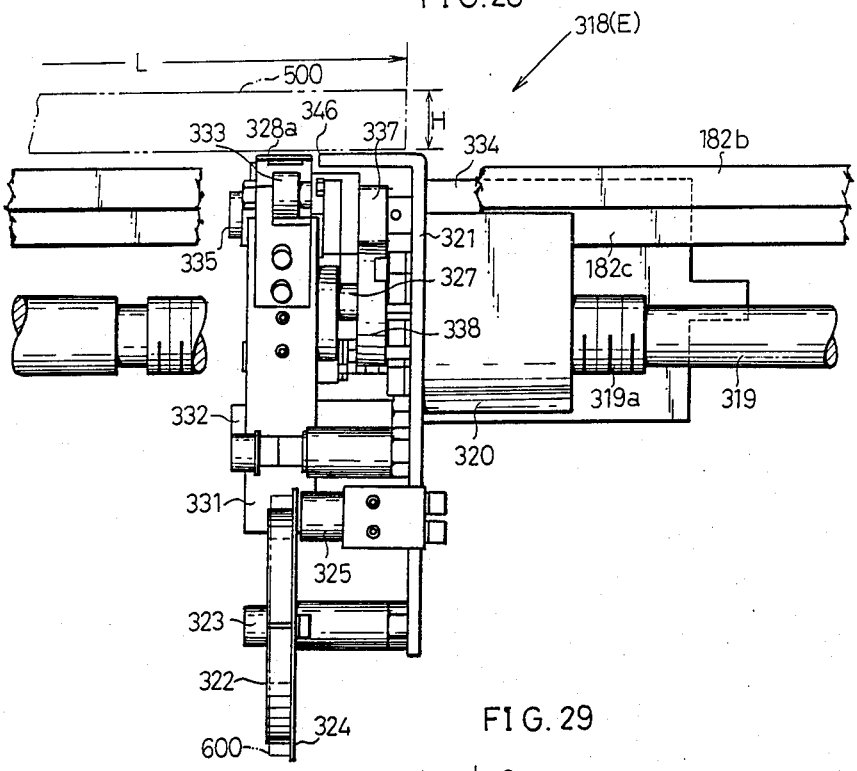

When the application of the tape 600 has been completed, the procedure goes back to the state shown in FIG. 27, except that the tape drawing rollers 329 are not rotated due to the action of the one way clutch 336, but the tapes 600 are drawn from the circular tape mounting plates 322 by the pressing action of the tape guide plates 331.

Continuous operation is performed in this manner, but when the stop button 383 on the control box 374 is pressed, operation of the wrapping machine stops. In this state where the cycle is stopped, the support shields 112, 117, 124 of the commodity receiving base mechanism 109 rest at their uppermost positions; in the wrapper folding device C, the front and rear bottom surface first folding plates 165, 166 and the front and rear surface second folding plates 175, 176 open, the front and rear surface first folding plates 171, 172, 173, 174 close, and the bottom surface front and rear second folding plates 167, 168, 169, 170 close a little and come to rest. At this time, the wrapper 400 is in the process of being folded around the commodity 500, as shown in FIG. 35(*b*). The commodity 500 is discharged wrapped, by pressing the discharge button 384 on the control box 374.

A wrapper drawing adjusting knob 385 for manually adjusting the resting position of the wrapper 400 on the wrapping region 37, and a wrapper drawing reverse adjusting knob 386 for manually adjusting the reversion timing of the rotatable rollers 81 during the drawing of the wrapper 400, and others are provided on the control box 374.

[Other Embodiments]

Next, another embodiment of the present invention is described.

Second Embodiment

Figure 36:
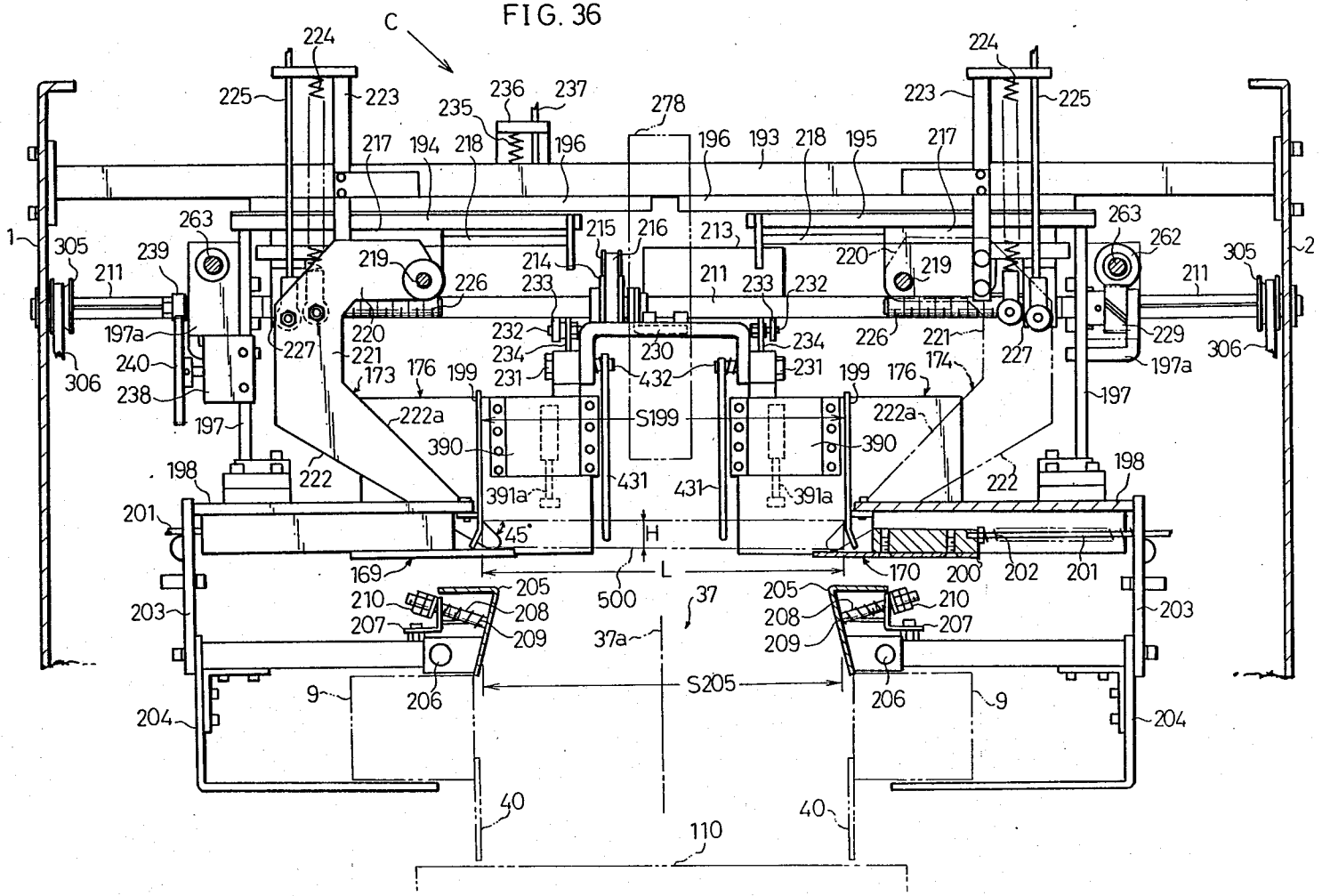
FIG. 36 and FIG. 37 are partially broken front views showing the second embodiment having a modified wrapper folding mechanism.
Figure 37:
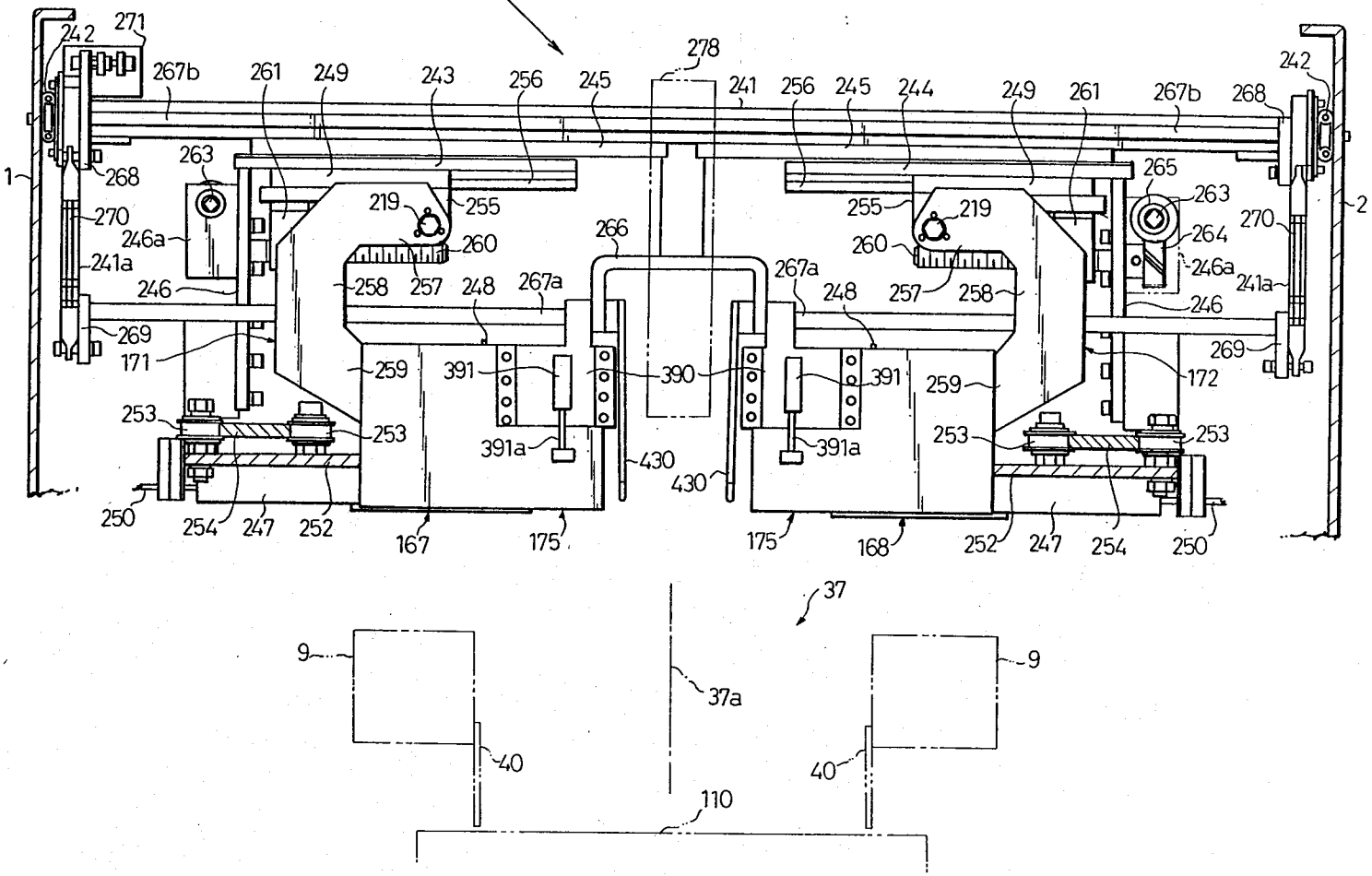

The second embodiment shown in FIG. 36 and FIG. 37 has modified versions of the front surface second folding plates 175 and the rear surface second folding plates 176 of the first embodiment. The left and right front surface second folding plates 175 and the left and right rear surface second folding plates 176 are supported such that they are movable upward or downward, by the left and right guide rails 390 attached to the brackets 230, 266, with the piston rods 391*a* of the air cylinders 391 mounted on the guide rails 390 being connected to the folding plates 175, 176. Also, the folding shields 430, 431 are supported by the brackets 266, 230, between the inner side edges of the left and right rear surface second folding plates 176 and the left and right front surface second folding plates 175, and they extend downward along these inner side edges up to near the lower edges of the folding plates 175, 176. One folding shield 430 hangs downward, and is pushed by the spring 423. This folding shield is tiltable rearward, against the elastic force of the spring 423.

In this second embodiment, as shown in FIG. 35(*c*), when the wrapper 400 is folded by the front and rear surface second folding plates 175, 176, the piston rod 391 of each of the air cylinders 391 move downward, and the folding plates 175, 176 move downward along the front and rear surfaces 503, 504 of the commodity 500. Therefore, the tension on the wrapper 400 on the front and rear surfaces 503, 504 of the commodity 500 can be more substantially applied, preventing the formation of wrinkles.

A space between the left and right front surface second folding plates 175 and the left and right rear surface second folding plates 176 is not desirable in preventing the formation of wrinkles in the process of applying tension to the wrapper 400, but this space is necessary for the pushing pieces 291 of the wrapped commodity disposing mechanism 278 to pass through. Therefore in the second embodiment, this space is provided between the folding shields 430, 431. Hence, while the pushing pieces 291 are moving between the folding shields 430 and the folding shields 431 and pass through them, the folding shields 431 are pushed by the movement of the commodity 500, allowing it to pass through. Specifically, when the commodity 500 is being raised by the wrapper 400, first, the wrapper 400 comes in contact with the lower ends of the folding shields 430, 431, and becomes wrapped about the lateral central portion of the front surface 503 and rear surface 504 of the commodity 500. Afterwards, the left and right front surface second folding plates 175 and the left and right rear surface second folding plates 176 fold the wrapper 400 around the front surface 503 and the rear surface 504 of the commodity 500. Therefore, further tension can be applied on the wrapper 400.

Third Embodiment

Figure 38:
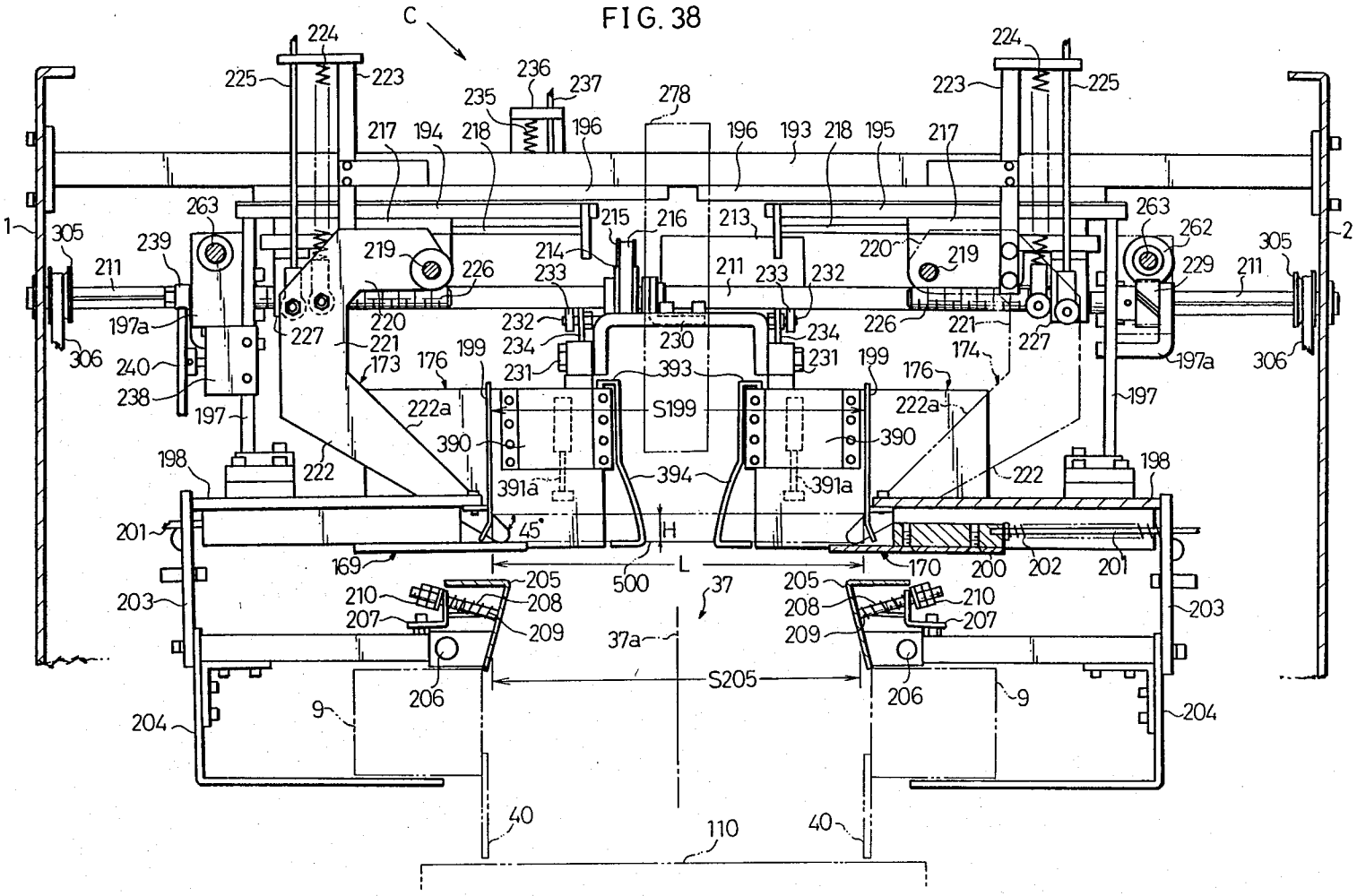
FIG. 38 and FIG. 39 are partially broken front views showing the third embodiment having the same modification.
Figure 39:
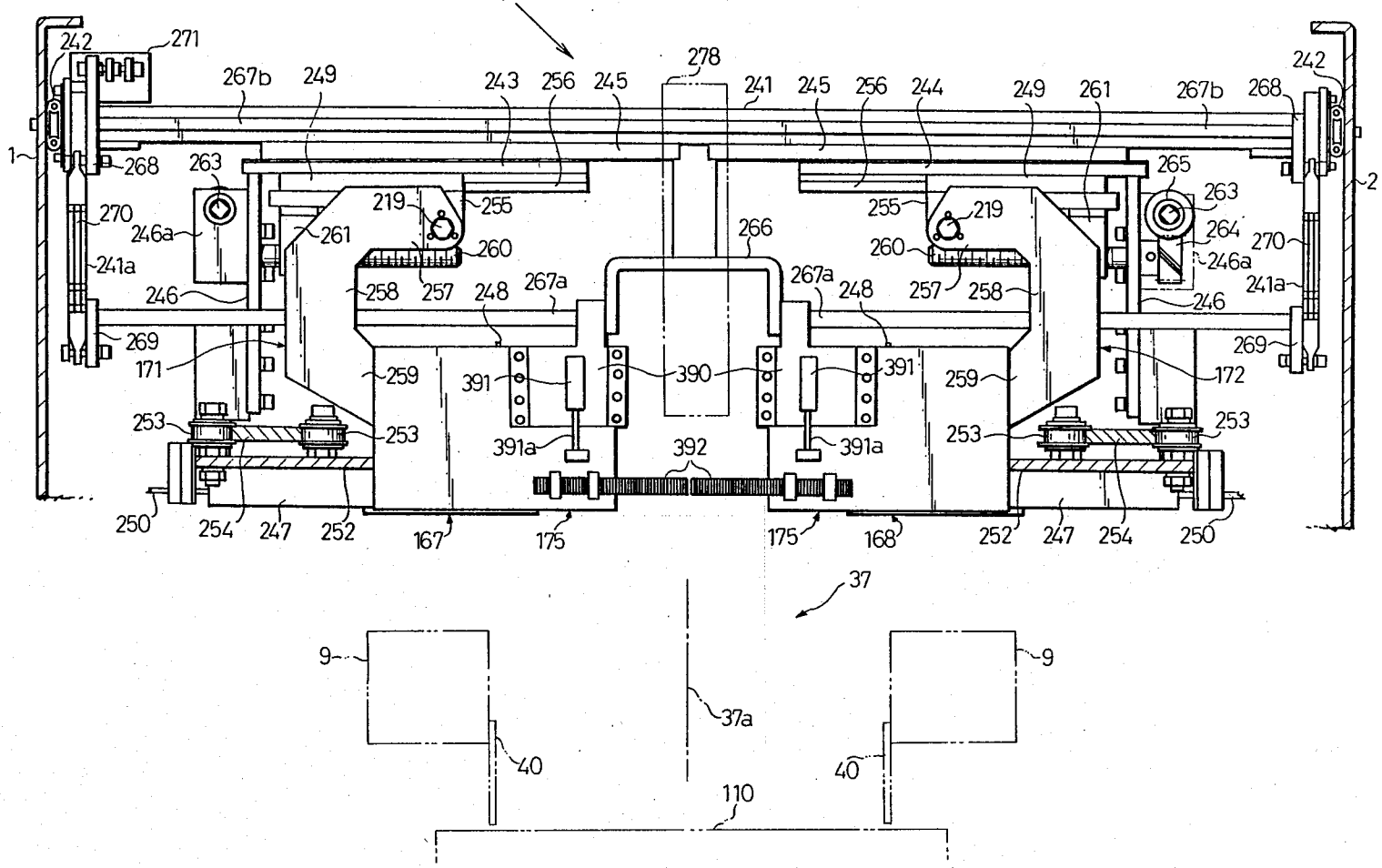

The third embodiment shown in FIG. 38 and FIG. 39 has modified versions of the folding shields 430, 431 of the second embodiment. Bendable pieces 392 made up of a coil spring are attached to the lower inner edges of the left and right front surface second folding plates 175, such that they protrude toward the center, while the upper ends of wire springs 394 are supported on a support portion 393 attached to the upper ends at the inner sides of the left and right rear surface second folding plates 176. These springs 394 extend downward along the inner side edge of the left and right rear surface second folding plates 176, having elastic forces directed forward and rearward.

Fourth Embodiment

Figure 17:
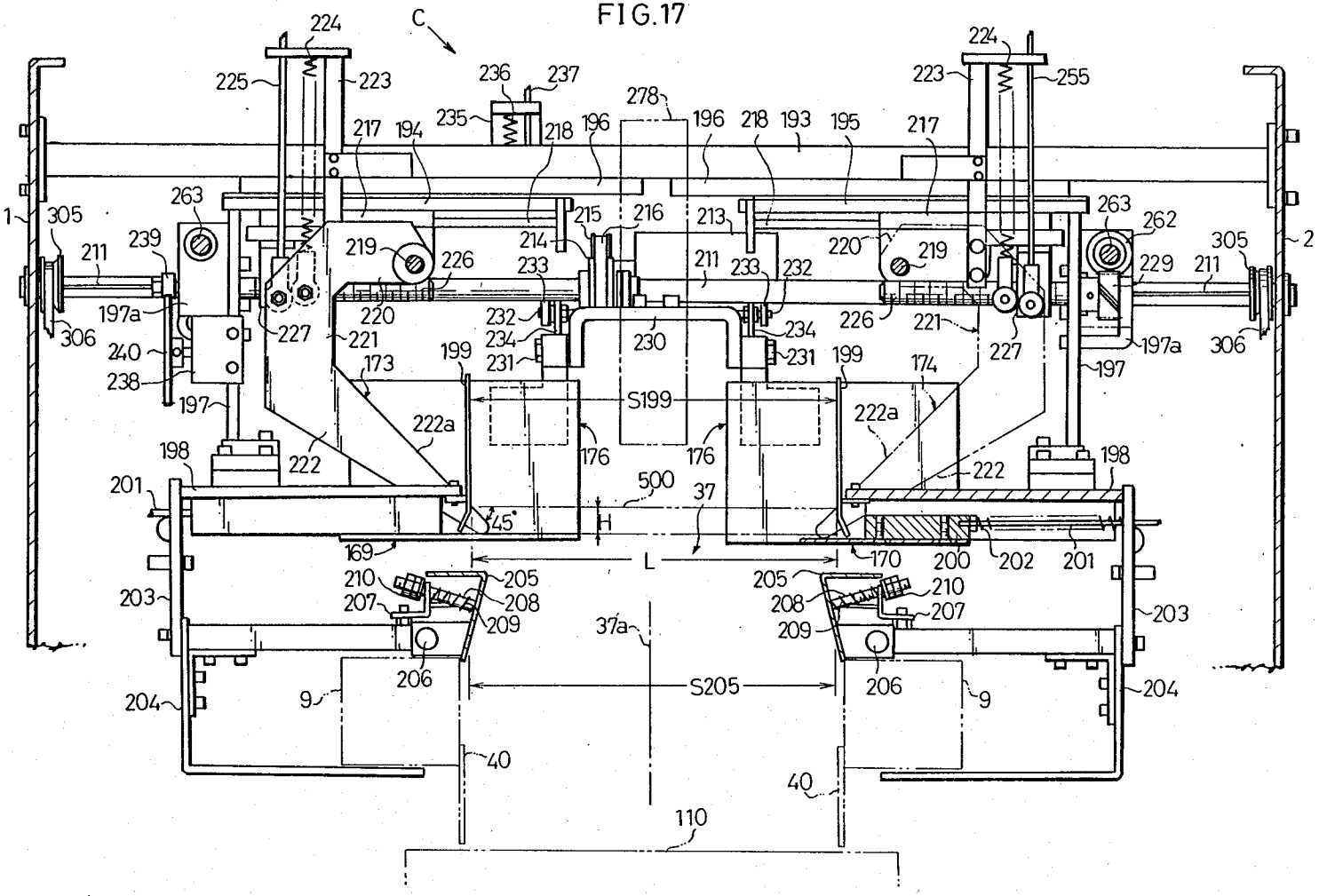
Figure 18:
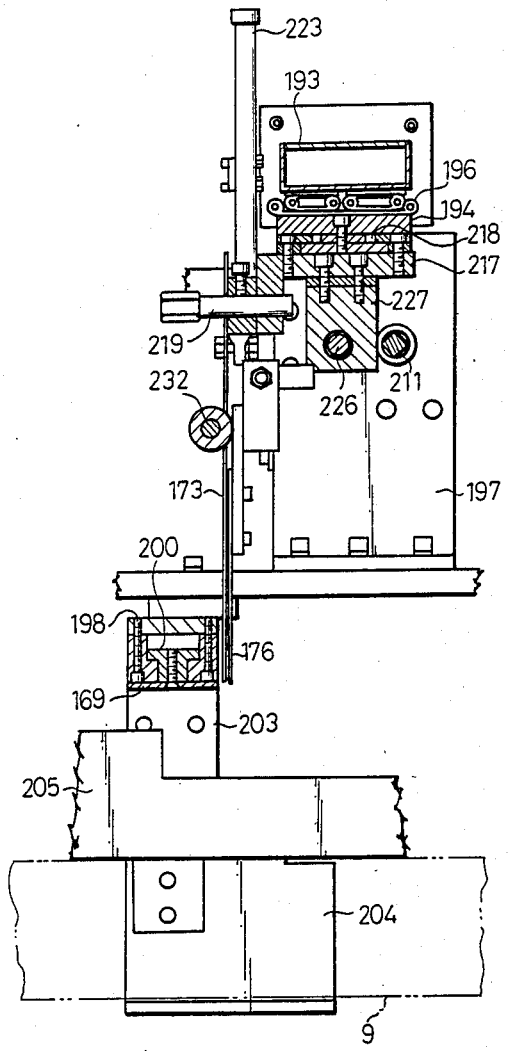
Figure 40:
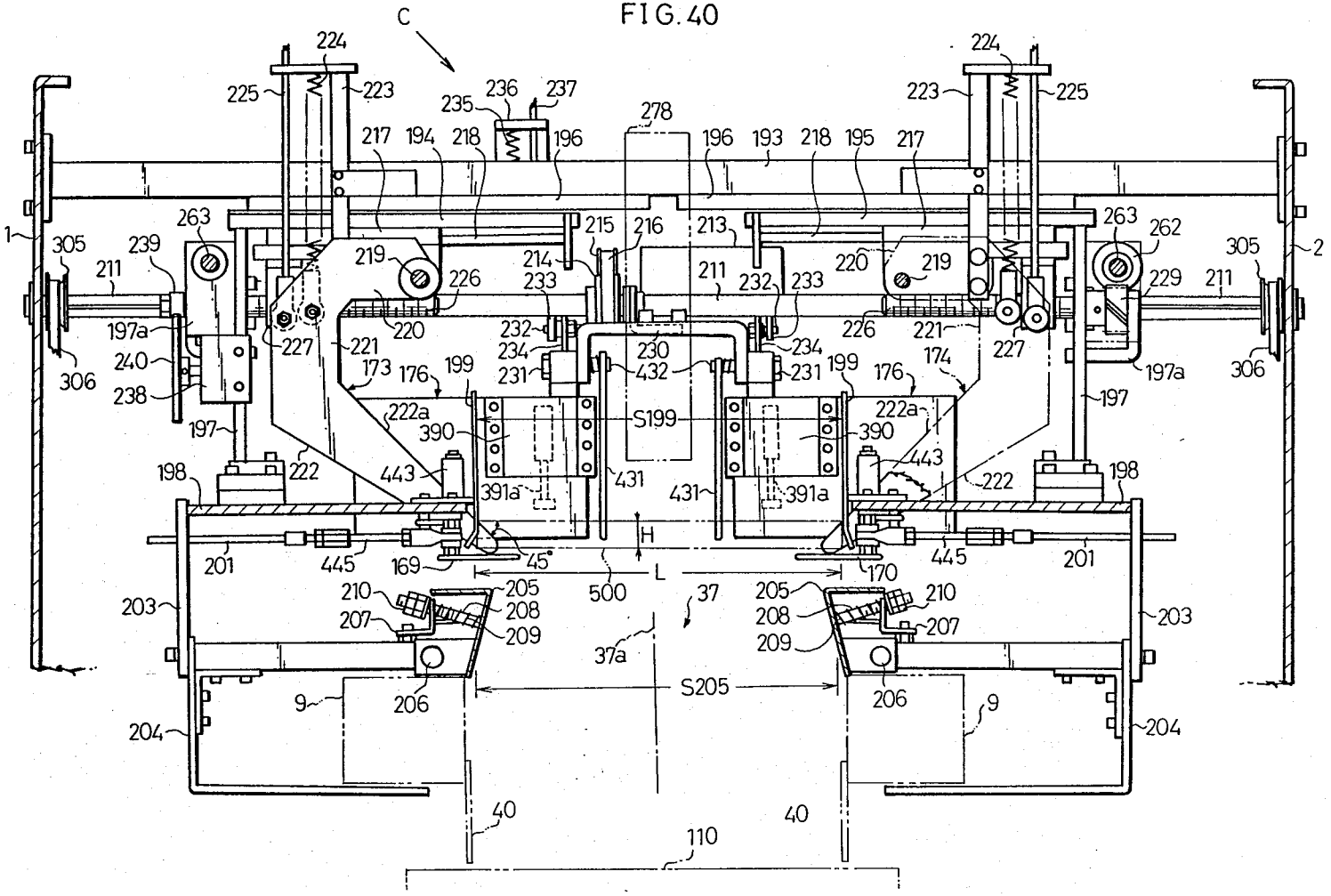
FIG. 40 and FIG. 41 are partially broken front views showing the fourth embodiment having the same modification, FIG. 42(*a*), (*b*) are operation diagrams showing the bottom surface front and rear second folding plates of the fourth embodiment.
Figure 41:
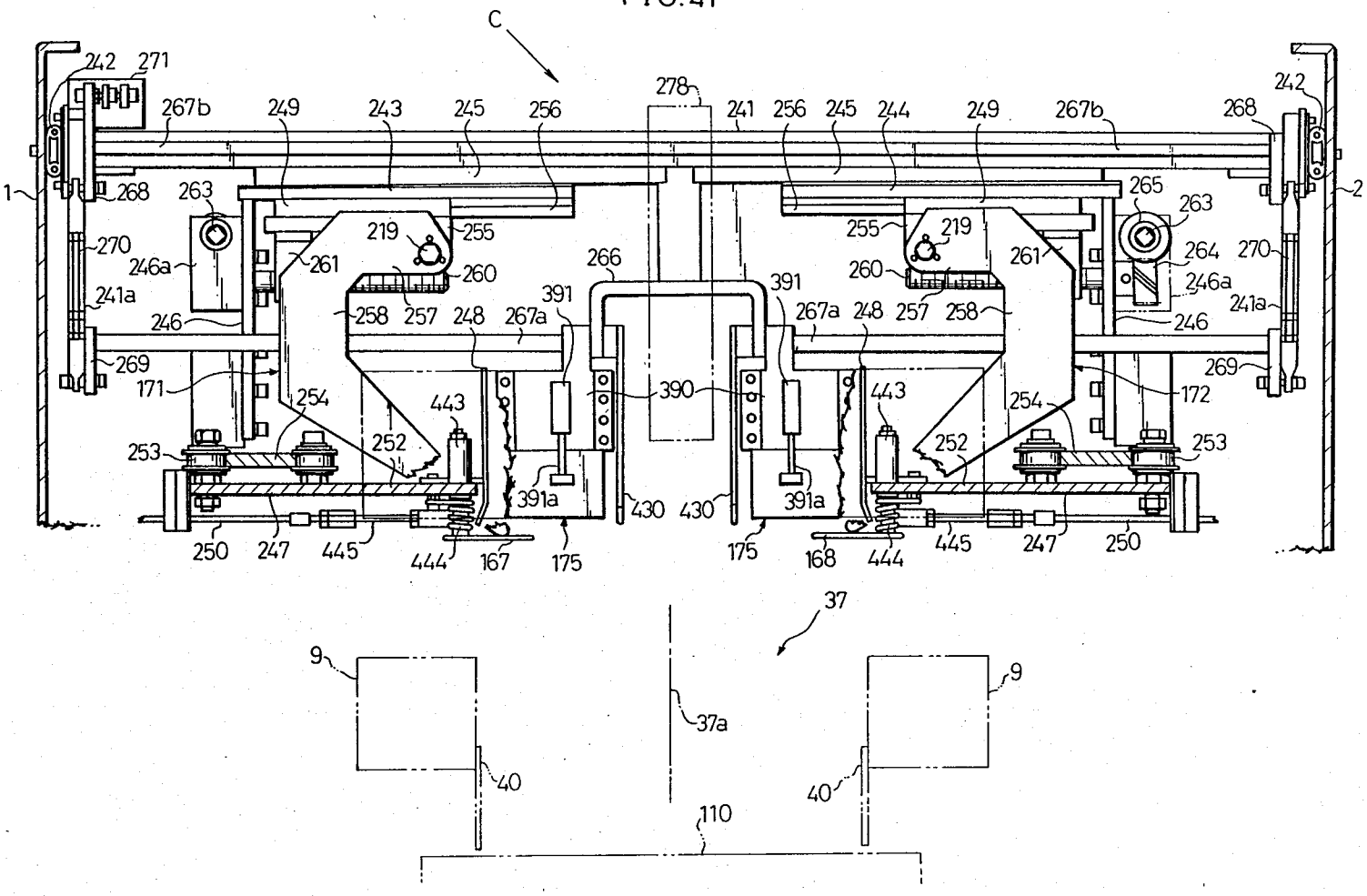
Figure 42A:
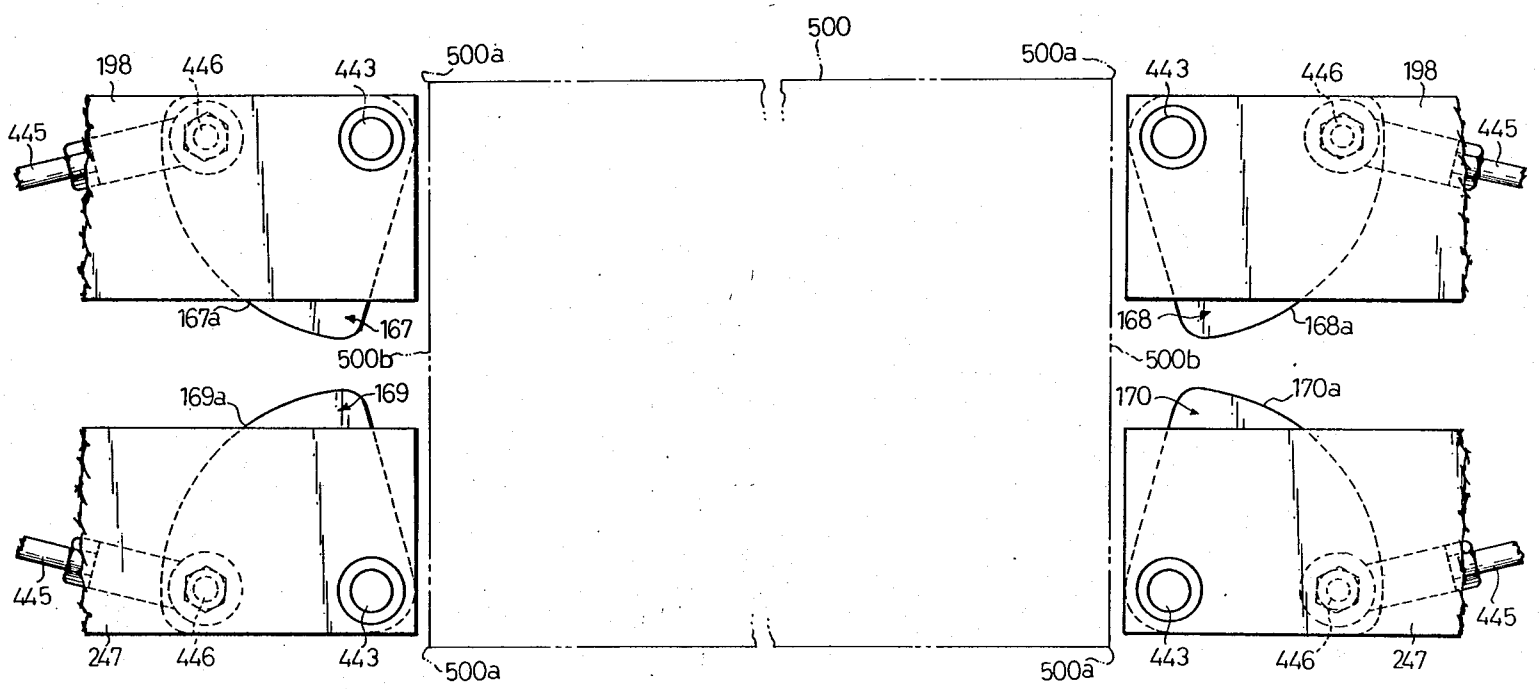
Figure 42B:
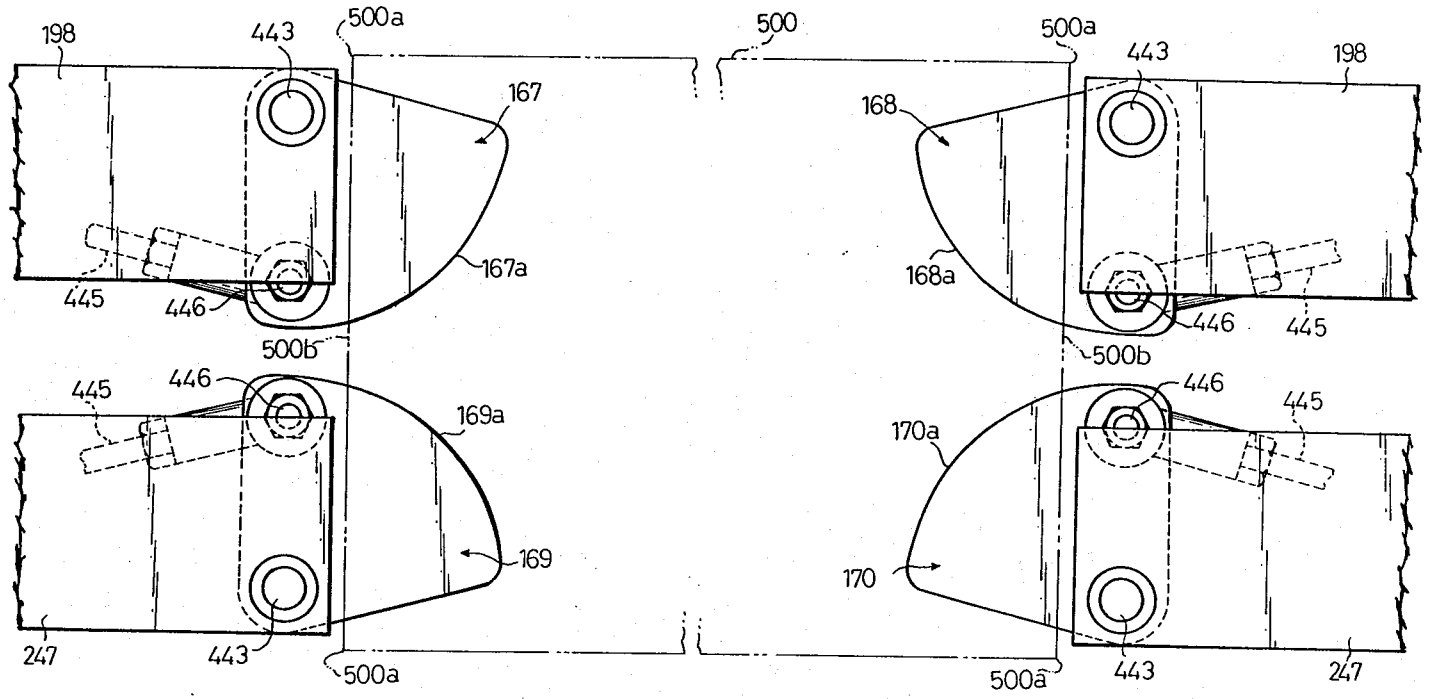
Figure 44:
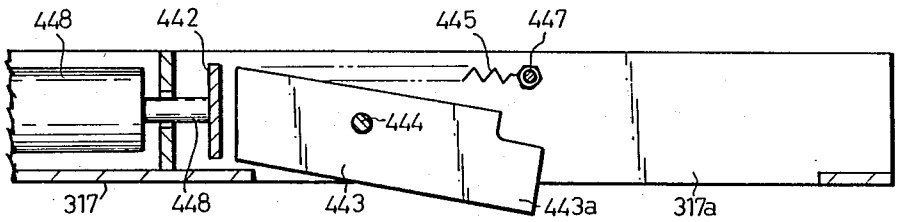
FIG. 43 to FIG. 46 show the fifth embodiment having a commodity discharging mechanism added.
Figure 45:
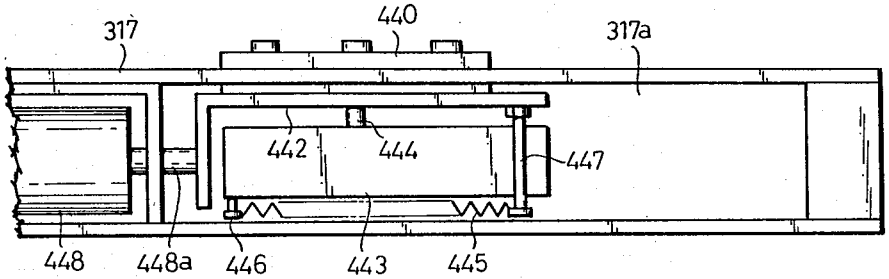
Figure 43:
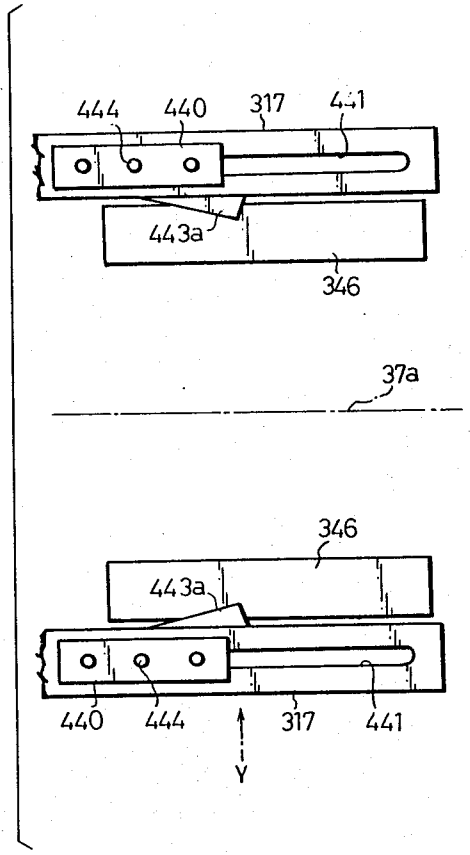
Figure 46D:
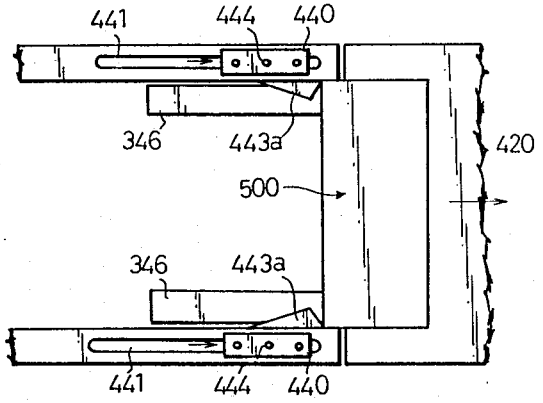
Figure 46C:
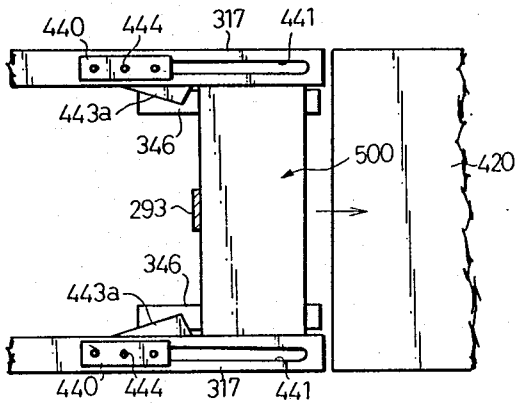
Figure 46B:
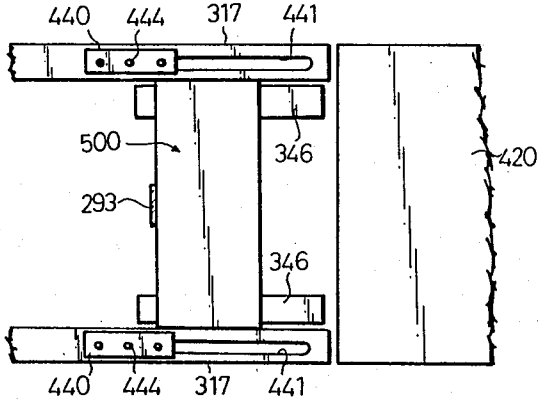
Figure 46A:
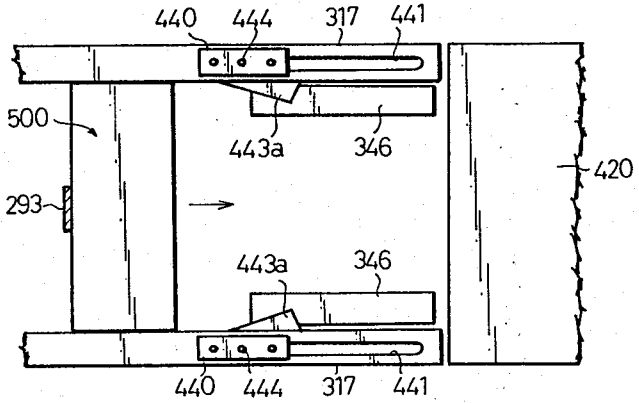
Figure 48:
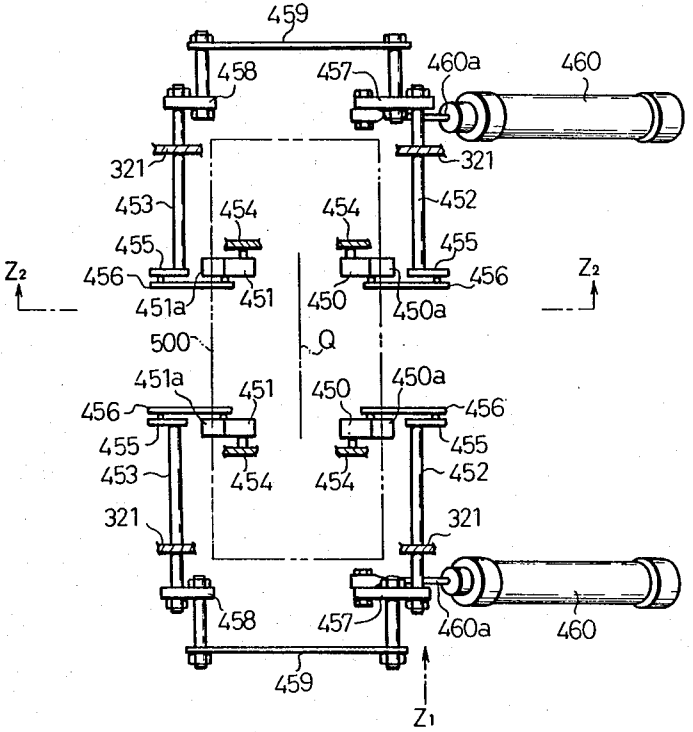
FIG. 47 to FIG. 51 show the sixth embodiment having a wrapper tension giving mechanism of the tape disposing mechanism added.

The fourth embodiment shown in FIG. 40 to FIG. 42 has modified versions of the bottom surface front and rear second folding plates 167, 168, 169, 170 of the first embodiment. As shown in FIG. 17 and FIG. 20 of the first embodiment, these parts move laterally in a straight line and fold the wrapper 400 along the bottom surface 502 of the commodity 500 (refer to FIG. 35(*a*)), from the left and right sides of the front and rear portion of the same bottom surface 502. However, in the fourth embodiment, as shown in FIG. 42(*a*) and FIG. 42(*b*) these parts are rotatable, with a support shaft 443 as the center of rotation.

Hence, the folding plates 167, 168, 169, 170 are fan-shaped, the edges at the tips forming arc portions 167*a*, 168*a*, 169*a*, 170*a*, and their basal ends being supported on the support blocks 198, 247 by the support shaft 443, such that they are rotatable along the bottom surface 502 of the commodity 500. A spring 444 (refer to FIG. 41) is wound around the circumference of the support shaft 443, and through its elastic force, the folding plates 167, 168, 169, 170 are enabled to bore through the bottom surface 502 of the commodity 500 near the four corners 500*a*, as shown in FIG. 42(*b*). In this bored through state, the arc portions 167*a*, 169*a* of the left folding plates 167, 169 and the arc portions 168*a*, 170*a* of the right folding plates 168, 170 are set facing each other.

Links 445 with adjustable lengths are rotatably supported by shafts 446 on one side of the arc portions 167*a*, 168*a*, 169*a*, 170*a* of the folding plates 167, 168, 169, 170, with wires 250, 201 being connected to these links 445, as in the first embodiment. When these wires 250, 201 are pulled, against the elastic force of the spring 444, as shown in FIG. 42(*a*), the folding plates 167, 168, 169, 170 rotate, with the support shaft 443 as the center of rotation, and move away from the commodity 500.

In the first embodiment, since the folding plates 167, 168, 169, 170 move in a straight line, in the process of forming a folding line 400*c* near the four corners 500*a* of the commodity shown in FIG. 35(*c*), at the start of folding, the folding plates 167, 168, 169, 170 make simultaneous contact with the wrapper 400 at the four corners 500*a* and at the middle portion 500*b* away from the four corners 500*a*, and fold the bottom surface folded portion 400*d*. In this process, at the four corners 500*a* that give strong resistance to folding, the wrapper 400 may get torn.

However, in the fourth embodiment, in the state shown in FIG. 42(*a*), when the folding plates 167, 168, 169, 170 rotate, first, after having come in contact with the wrapper 400 at the middle portion 500*b*, they gradually approach the corners 500*a* and form the folding line 400*c*, and at the same time fold the bottom surface folded portion 400*d*. Therefore, as opposed to the case in the first embodiment, since folding is done from the middle portion 500*b*, giving less folding resistance, and gradually proceeds to the four corners 500*a* that give strong resistance to folding, the possibility that the wrapper 400 may get torn is eliminated.

Fifth Embodiment

Figure 1A:
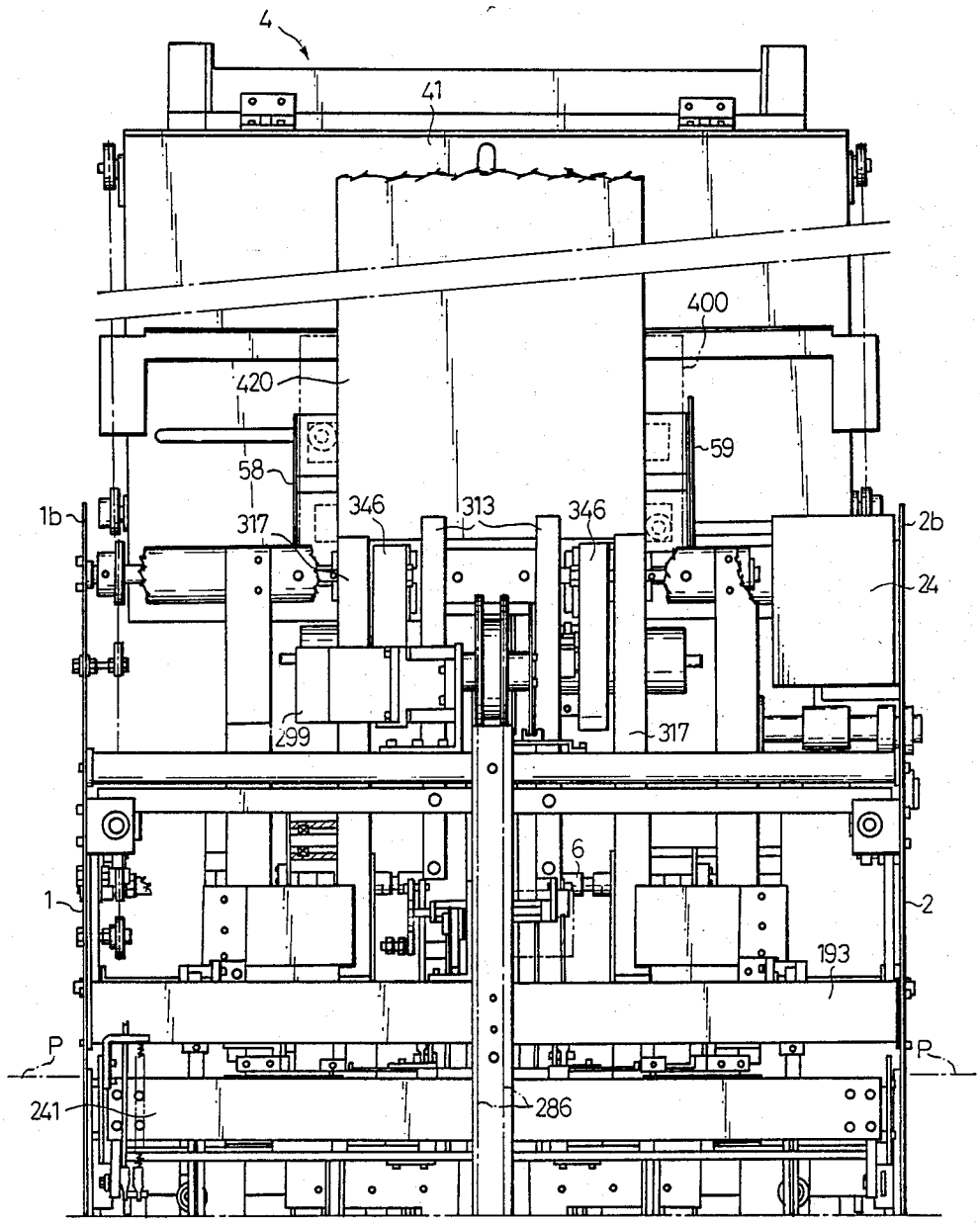
FIG. 1(*a*), (*b*) are plane views showing a general outline of a wrapping machine related to the present embodiment.
Figure 1B:
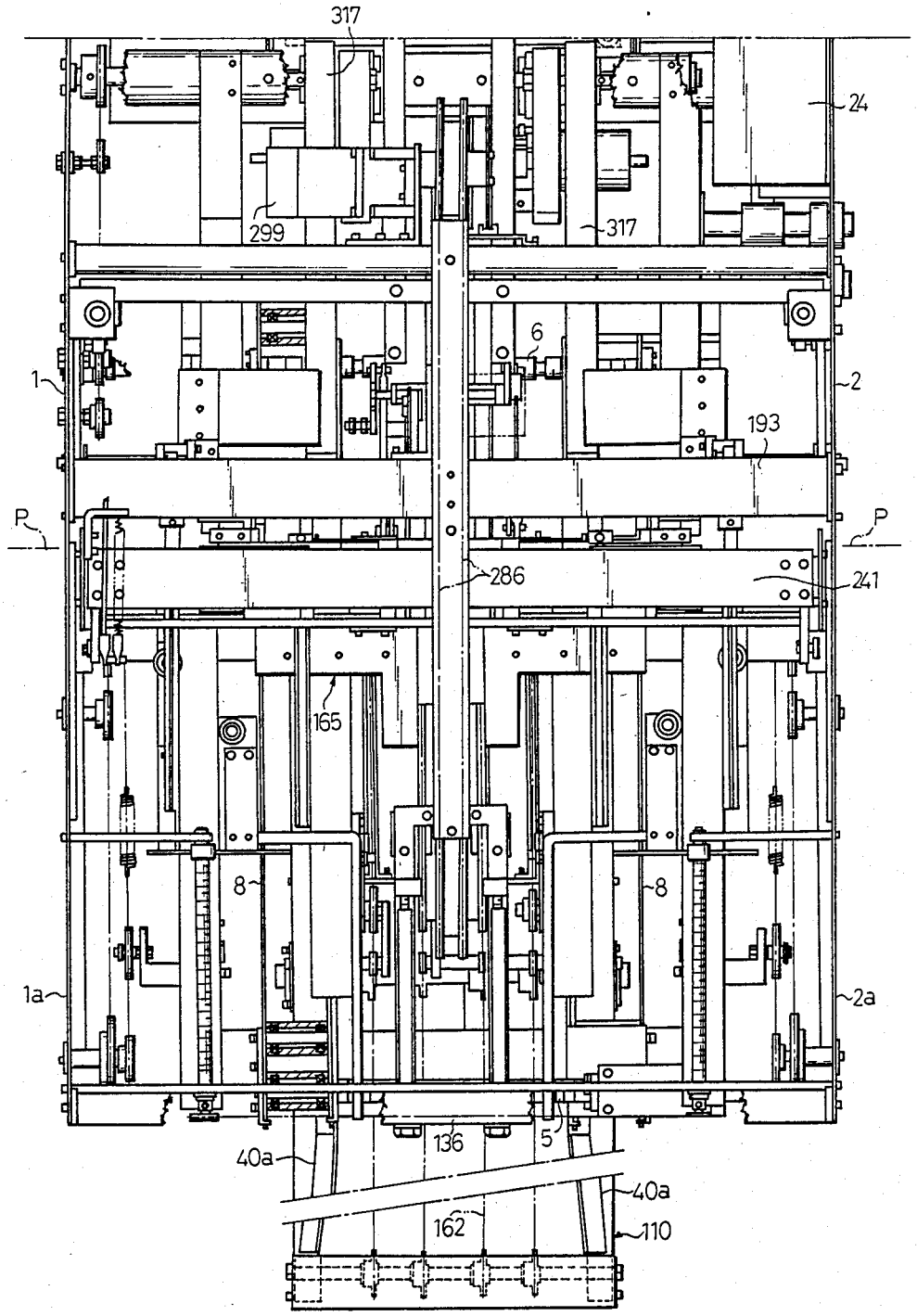
Figure 25:
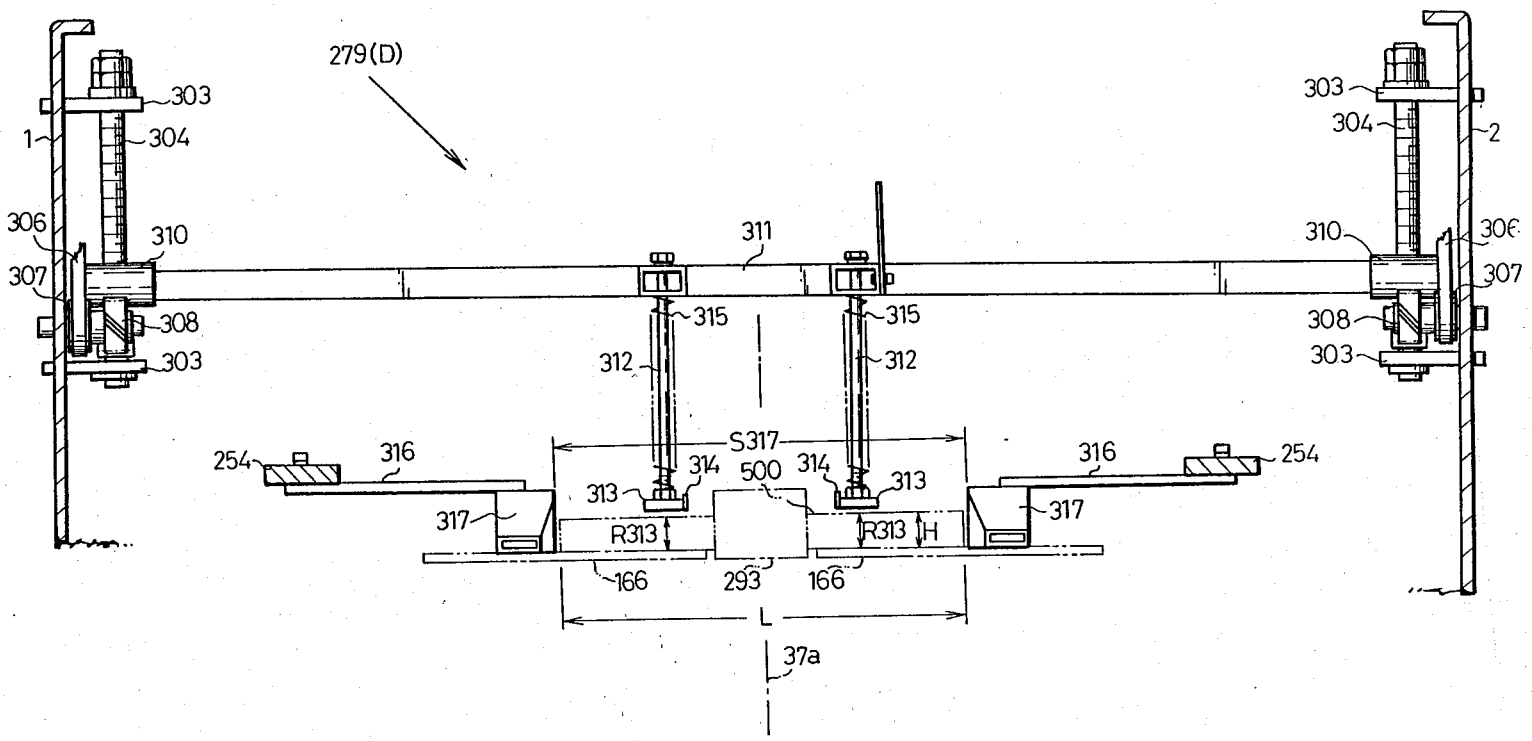
FIG. 25 is a partially broken front view showing the commodity conveying guide mechanism.

The fifth embodiment shown in FIG. 43 to FIG. 46 has a commodity discharging mechanism added to the left and right guide shields 317 of the wrapped commodity conveyor guide mechanism 279 (refer to FIG. 1(*a*), (*b*), FIG. 16(*a*), (*b*) and FIG. 25) of the first embodiment. This commodity discharging mechanism is provided near the commodity support plates 346 of the tape disposing mechanisms 318. This commodity discharging mechanism is described in detail below.

A slider 440 is supported between the guides shield 317, such that it is movable forward or rearward within a fixed range. Within the interval between the guide shields 317, a bracket 442 is attached to the slider 440, with a pusher 443 being supported on this bracket 442, such that it is rotatable in the horizontal direction about a shaft 444. A spring 445 is connected between the pusher 443 and the bracket 442 by means of support pins 446, 447, and due to the elastic force of this spring 445, the pushing portion 443*a* of the pusher 443 is always protruding from the facing inner edge of the guide shields 317. An air cylinder 448 is attached to the guide shields 317, its piston rod 448*a* fixed to the bracket 442. When the piston rod 448*a* advances or retreats, the slider 440, bracket 442, the pusher 443, and others move forward or backward along the rails 441.

As shown in FIG. 24(*a*), (*b*), the commodity 500 wrapped with the wrapper 400 is pushed by the commodity support plates 293 of the wrapped commodity discharging mechanism 278 and is carried toward the commodity support plates 246 of the tape disposing mechanisms 318, as shown in FIG. 46(*a*). In this process of carrying, the piston rod 448*a* of the air cylinder 448 retreats, with the pusher 443 in its waiting position. At the same time, the pushing portion 443*a* positioned on the commodity support plates 346 of the tape disposing mechanisms 318 protrudes from the facing inner edges of the guide shields 317.

As shown in FIG. 46(*b*), when the wrapped commodity 500 comes to rest on the commodity support plates 346 of the tape disposing mechanisms 318, the pushing portions 443*a* of the pushers 443 are pushed by the wrapped commodity 500, against the elastic force of the spring 445, and the pushers 443 become inserted into the guide shields 317.

As shown in FIG. 46(*c*), after the tapes have been applied, the wrapped commodity 500 is again carried by the commodity support plates 293 of the wrapped commodity discharging mechanism 278. When it is moved away from the pushing portions 443*a* of the pushers 443, the pushing portions 443*a* of the pushers 443 again protrude from the facing inner edges of the guide shields 317 due to the elastic force of the springs 445. Immediately afterwards, as shown in FIG. 46(*d*), when the piston rods 448*a* of the air cylinders 448 advance, the pushers 443 also move, and the pushing portions 443*a* push the wrapped commodity 500, the wrapped commodity being carried on the discharge conveyor 420.

In the first embodiment, since the commodity support plates 293 of the pushing pieces 291 of the wrapped commodity discharging mechanism 278 move away upward while pushing the wrapped commodity 500 after it has been applied with tapes, there is the possibility that the conveyance of the wrapped commodity 500 may not be enough, but in this fifth embodiment, due to the operation of the pushers 443, the wrapped commodity is carried with certainty.

Sixth Embodiment

Figure 47:
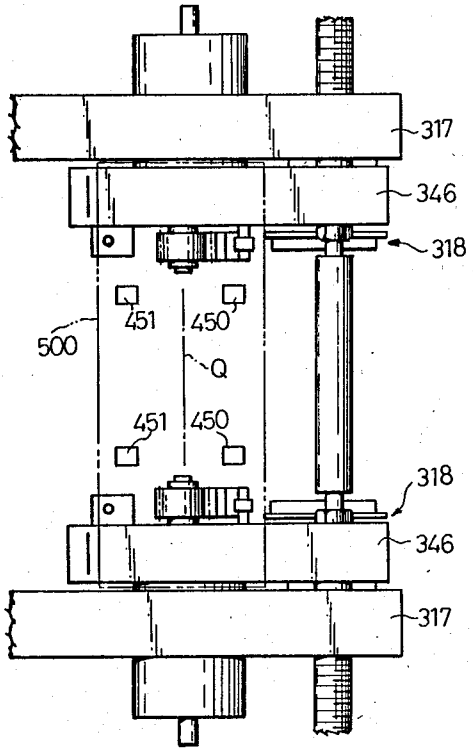

The sixth embodiment shown in FIG. 47 to FIG. 51 has a wrapper tension giving mechanism added to the tape disposing mechanisms 318 of the first embodiment. This wrapper tension giving mechanism is furnished with a pair of pressing claws 450, 451 between the commodity support plates 346 of the tape disposing mechanisms 318, as shown in FIG. 47. A more detailed description of this wrapper tension giving mechanism is given below.

Linking shafts 452, 453 are rotatably supported on the front and rear sides of the side plates 321 of the tape disposing mechanisms 318. The pressing claws 450, 451 are supported by support plates 454 on the inner sides of the inner end portions of the linking shafts 452, 453, such that these pressing claws are movable forward and rearward. The left and right pairs of pressing claws 452, 453 are arranged at the front and back of the tape disposing center Q, at an inner side than the tape disposing position of the tape disposing mechanisms 318. Levers 455 are attached to the inner end portions of the linking shafts 452, 453, the levers 455 and the pressing claws 452, 453 being connected by the links 456 . Levers 457, 458 are attached to the outer end portions of the linking shafts 452, 453, the interval of these levers 457, 458 being connected by links 459. The piston rods **460*a* of air cylinders 460 are linked to each of the levers 457. When these piston rods advance or retreat, the levers 457 rotate, and the linking shafts 452 also rotate. At the same time, the other linking shafts 453 also rotate through the links 459 and the other levers 458, these rotations being transmitted to the pressing claws 450, 451 via the levers 455 and the links 456, causing the pressing claws 450, 451** to rotate and approach or move away from each other.

Figure 51A:
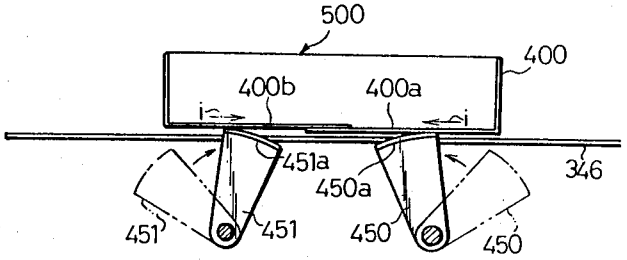
Figure 51B:
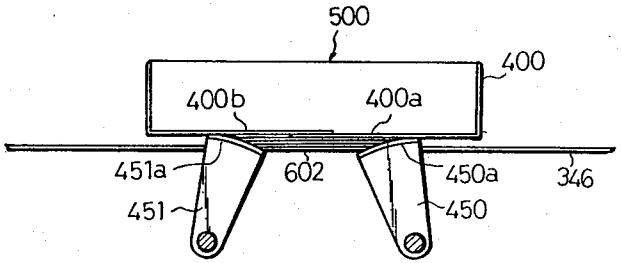
Figure 49:
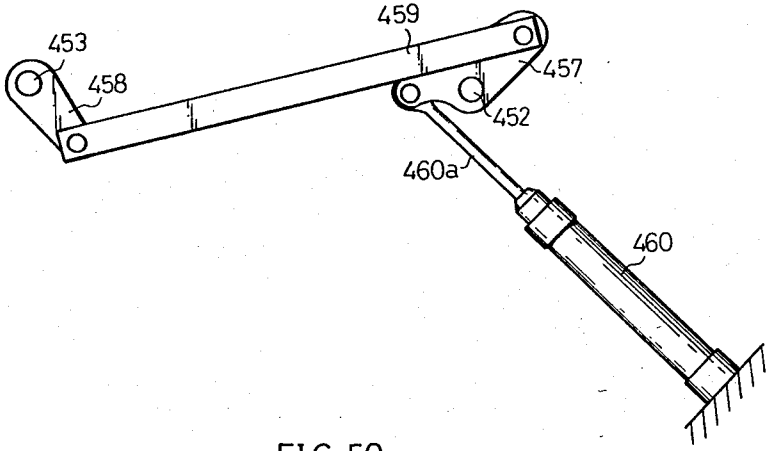
Figure 50:
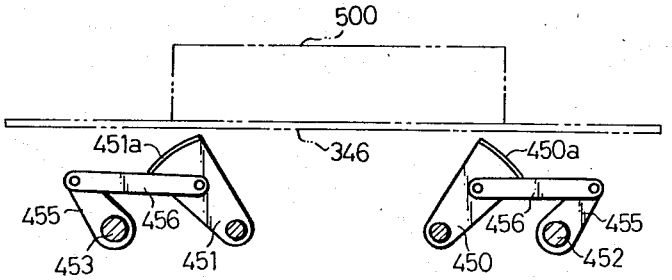
Figure 53:
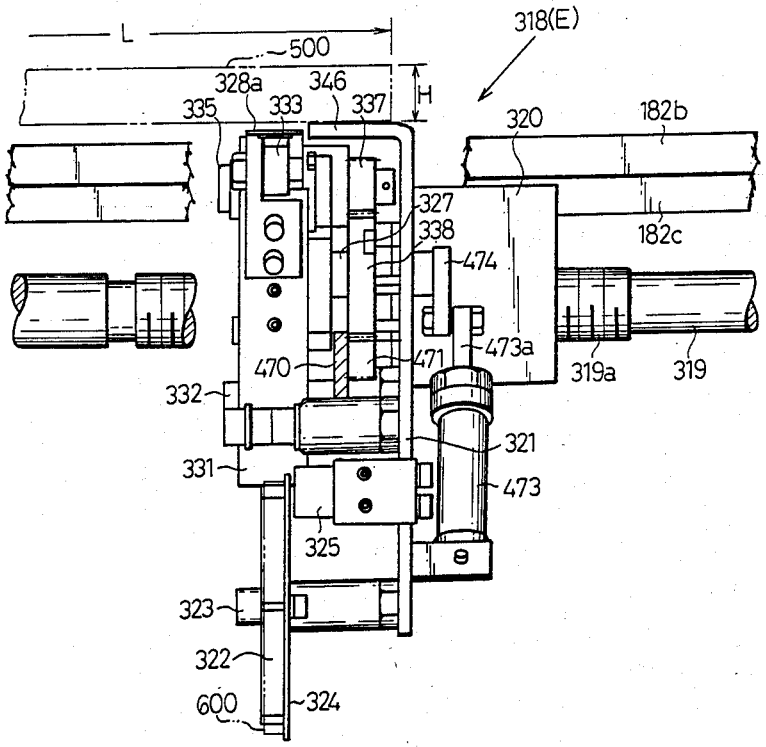
FIG. 52 to FIG. 56 show the seventh embodiment having a modification of the tape disposing mechanism.

When the wrapped commodity 500 comes to rest on the commodity support plates 436 of the tape disposing mechanisms 318, the piston rods **460*a* of the air cylinders 460 retreat, as shown in FIG. 51**(*a*), the pressing claws 450, 451 approach each other from their separated state shown in FIG. 50. As a result, with the pressing surfaces **450*a*, 451*a* of the pressing claws 450, 451 raising the commodity 500 up a little, the bottom surface folding portions 400*a*, 400*b* of the wrapper 400 are pulled in the direction i, giving tension to the wrapper 400. Afterwards, as shown in FIG. 5**(*b*), with the wrapper 400 maintaining its tension, the pressing claws 450, 451 approach each other, and tape segments 602 are applied on the bottom surface folding portions **400*a*, 400*b* by the tape disposing mechanisms 318. After the application of the tapes, the pressing claws 450, 451 move away from each other, as shown in FIG. 50. Hence, the wrapped commodity 500** applied with the tapes can be wrapped well, without any wrinkles in the wrapping material.

Seventh Embodiment

The seventh embodiment shown in FIG. 52 to FIG. 56 has a modified version of the tape disposing mechanism 318 of the first embodiment. The seventh embodiment is described in detailed below, pointing out mainly its structural differences with the first embodiment.

Figure 54:
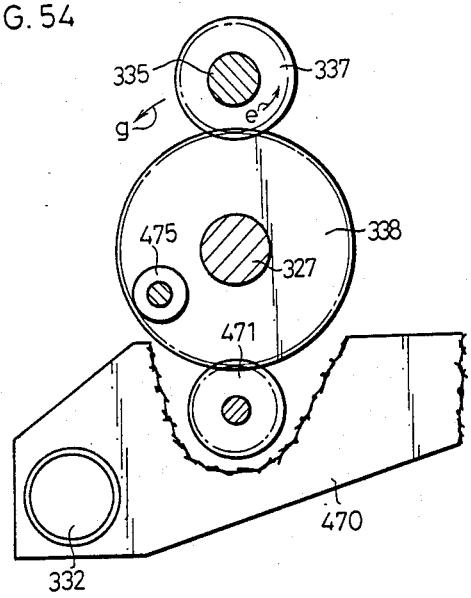
Figure 55:
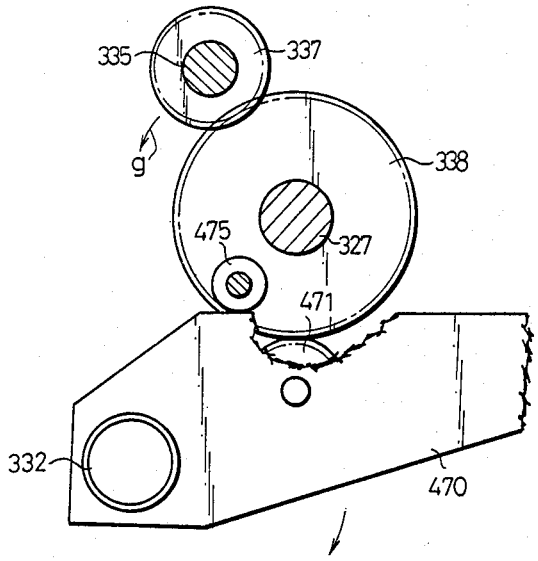

A lock plate 470 is supported on the inner side of the side plate 321 below the arm 326, such that it is rotatable upward and downward, having the same central shaft of rotation as the tape guide pins 332. As shown in FIG. 54, an irrotational lock gear 471 is fixed to the lock plate 470, between the this lock plate 470 and the side plate 321. A spring 472 is linked between this lock plate 470 and the side plate 321, and the lock plate 470 rotating upward due to the elastic force of this spring 472, and the lock gear 471 of this lock plate 470 meshing with the gear 338 on the shaft 327. In the first embodiment, this gear 338 is supported so as to be integrally rotatable with the shaft 327, but in the seventh embodiment, the gear 338 is rotatable relative to the shaft 327. In the first embodiment, this shaft 327 is rotated by the tape drawing rotary solenoid 334, but in the seventh embodiment, the piston rods **473*a* of the air cylinders 473 are linked to this shaft 327 via a lever 474. Above the lock plate 470, a pressing roller 475 is supported on the lower end portion of the arm 326, and as shown in FIG. 55, when the lock levers 470 are rotated downward by the pressing rollers 475, against the elastic force of the spring 472, together with the rotation of the arm 326, the lock gear 471 of the lock plate 470 moves away from the gear 338, and the gear 338 becomes rotatable relative to the shaft 327. Between the tape pressing rollers 333 and the flat spring 328, another flat spring 476 is attached to the arm 326, this flat spring 476 pressing against the tape pressing roller 333**.

With the wrapped commodity 500 at rest on the tape disposing center Q on the support plates 346 of the left and right tape disposing mechanisms 318, when the air cylinders 473 are driven, the shaft 327 is rotated by their piston rods **473*a* via the levers 474, and the arm 326 begins to tilt in the direction g. At the start of this tilting process, as shown in FIG. 54, the gear 338 on the shaft 327 meshes with the lock gear 471, and since it is not rotatable, the gear 337 on the shaft 335 meshing with the gear 338 rotates with the shaft 335, and due to the rotation of this shaft 335, the tape drawing rollers 329 also rotate in the direction e. Therefore, the staring tips 601 of the tapes 600 stretching out from the tip portions 328*a* of the flat springs 328 make contact with the left and right sides of the bottom surface 502 of the wrapped commodity, and remain in contact with the left and right sides of the bottom surface 502 of the wrapped commodity while being supported by the tape pressing rollers 333. The tapes 600 are then pressed by the tape pressing rollers 333, and gradually applied on the bottom surface 502 of the wrapped commodity 500 while being supported by the same pressing rollers 333. At the same time, the tapes 600 are being drawn from the circular tape mounting plates 342 by the rotation of the tape drawing rollers 329 while being pressed against the tape guide plates 331**.

Further, when the arm 326 is tilted, as shown in FIG. 55, the pressing rollers 475 of the arm 326 make contact with the lock plate 470, and the lock plate 470 rotates downward, the lock gear 471 of the lock plate 470 moving away from the gear 338. As a result, since the gear 338 becomes rotatable, together with the tilting of the arm 326, the gear 337 moves on the gear 338 without rotating. Therefore, drawing of the tape 600 is not performed. The tape 600 is drawn by the movement of the flat spring 328 as a result of the tilting of the arm 326, and as in the case mentioned earlier, the tape is gradually applied on the bottom surface 502 of the commodity 500.

Figure 56:
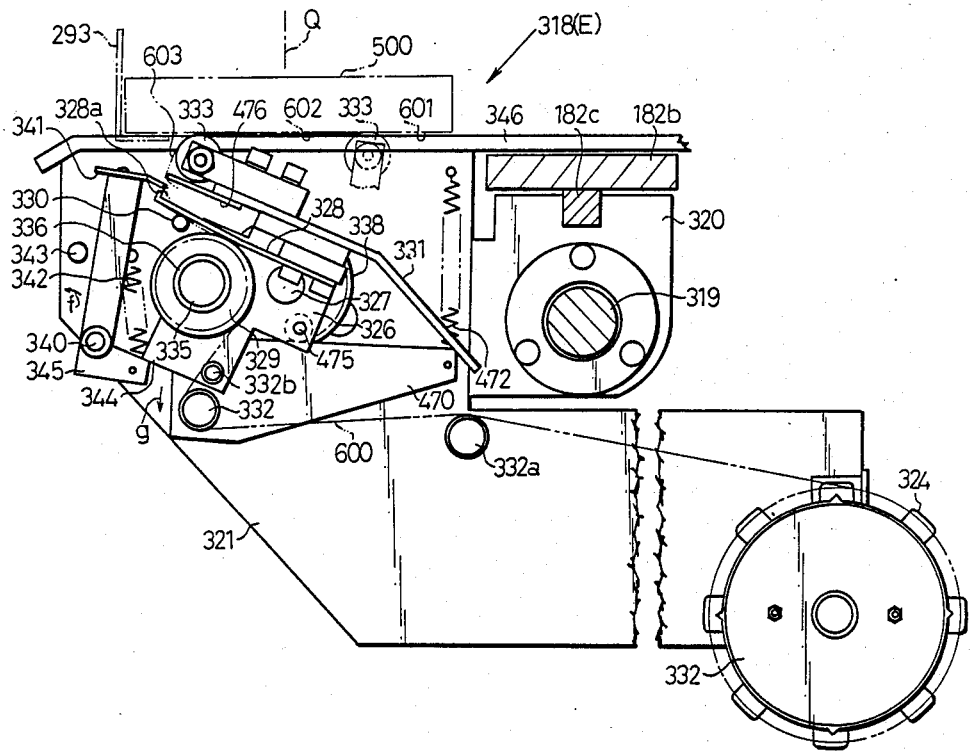

Afterward, when the locking portion 344 of the arm 326 comes in contact with the locking portion 345 of the cutter tilting shield 339, as shown in FIG. 56, the cutter tilting shield 339 tilts in the direction f against the elastic force of the spring 342, the cutter 341 being inserted between the flat spring 328 and the flat spring 476 and cutting the other end of the tape 600. The tape segments 602 are applied on the left and right sides of the bottom surface 502 of the wrapped commodity 500, leaving cut ends 603.

After the tapes have been applied, the motors 299 of the wrapped commodity discharging mechanism 278 are again driven; the wrapped commodity is pushed rearward by the pushing pieces 291, and carried on the conveyor 420. During this time, the cutting ends 603 of the tape segments 602 are also pressed against the bottom surface of the wrapped commodity 500 by the tape pressing rollers 333, and the tape segments 602 are completely applied on the bottom surface 502 of the wrapped commodity 500. Afterward, when the piston rods 473*a* of the cylinders 473 retreat, the operation returns to the state shown in FIG. 52. During this time, the rotation of the tape drawing rollers 329 is disenabled by the action of the one way clutch 336, and there is no drawing of the tapes 600. Again, the tapes 600 are drawn from the circular tape mounting plates 322 by the pressing action of the tape guide plates 331, and there is a slackening of the tapes 600 between the tape guide plates 331 and the tape drawing rollers 329. Then in the next process, these slackened portions are drawn out, and application of the tapes 600 is performed.

In the first embodiment, since the tape drawing rollers 329 rotate and the tapes drawn while the arms 326 is in the process of tilting, when the wrapped commodity 500 is carried away without the tapes 600 being applied correctly, the tapes 600 being drawn by the tape drawing rollers 329 are left in a state where they are drawn from the tip portions 328*a* of the flat springs 328. When the arm 326 returns from its tilted position shown in FIG. 29 to its initial state shown in FIG. 27, the tapes that were left have the possibility of sticking and being wound on the tape drawing rollers 329, and others, making it a problem to take out the tapes 600 that have been wounded.

Figure 52:
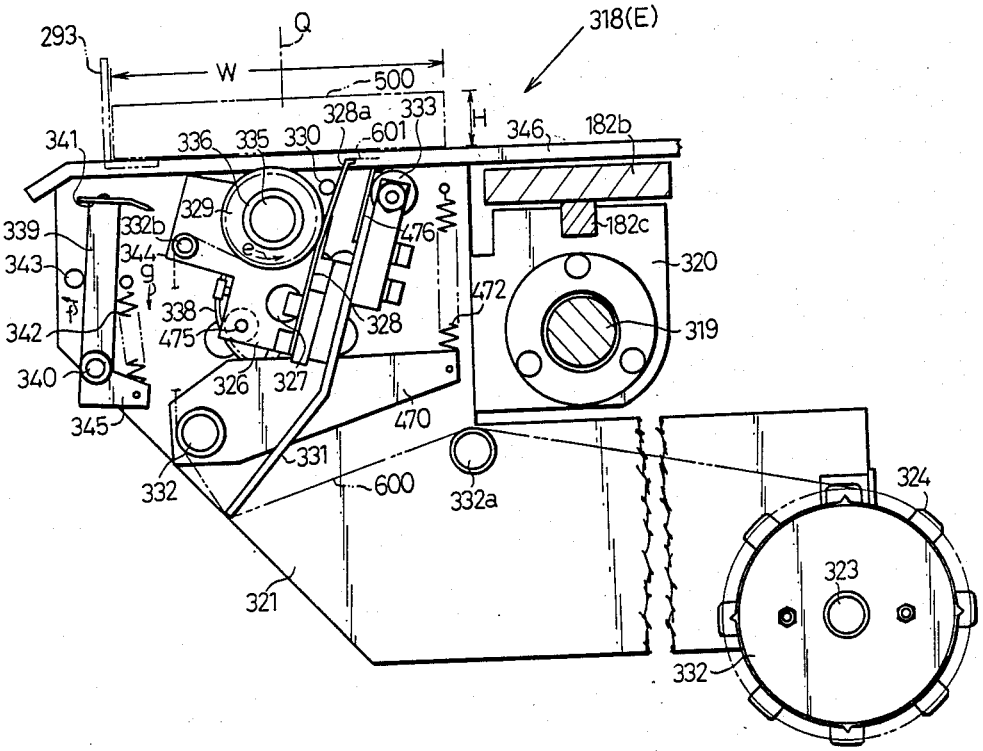

However, in the seventh embodiment, as mentioned earlier, since only when the arm 326 begins to tilt from its initial state shown in FIG. 52 do the tape drawing rollers 329 rotate and the tapes 600 forcibly drawn, even if there has been a mistake in the application of the tapes 600, in the tilted position shown in FIG. 56, the tapes 600 drawn from the tip portions 328*a* of the flat plates 328 is minimal. And when the operation returns to the state shown in FIG. 52, the chance that the drawn tapes 600 stick and wind around the tape drawing rollers 329, and others is eliminated. After there has been a mistake in the application of the tapes 600 and the operation returns to the state shown in FIG. 52, the tapes 600 slacken between the tape drawing rollers 329 and the tape guide plates 331. This slackened portion is then drawn in the next wrapping process.

Also, when there have been cases where the tapes 600 were applied to the wrapped commodity 500 without mistakes and cases where the tapes 600 were applied with mistakes, when the tapes 600 have ran out in the circular tape mounting plates 322, since the amount of tapes 600 drawn are different, the amounts of rotation of the toothed plates 324 of the circular tape mounting plates also differ. If this difference in the amounts of rotation is detected with the sensor 325, then these two cases can be differentiated.

As many apparently widely different embodiments of this invention may be made without departing from the spirit and scope therof, it is to be understood that the invention is not limited to the specific embodiments thereof except as defined in the appended claims.

What is claimed is:

1. A wrapping machine used to wrap with a prescribed wrapper a commodity having the shape of a hexahedron having a length, a width, and a height, as well as a top surface, a bottom surface, a front surface, a rear surface, a right side surface, and a left side surface, in this wrapping machine, the commodity being wrapped in a wrapping region, this wrapping region having a central position along the length of the commodity, and a reference wrapping position along the width of the commodity, the wrapping machine further comprising:

a wrapper supply means that holds at least two wrappers of different sizes, and selectively supplies either of the wrappers to the wrapping region, a sensing means, provided in the wrapper supply means, that detects the sizes of the wrappers, a control means electrically connected to the sensing means, as well as operationally connected to the wrapper supply means; this control means has a display means, and it determines whether the sizes of the wrappers are within the usable range for wrapping the commodity or not; when the sizes of two or more of the wrappers are within the usable range for wrapping the commodity, it drives the wrapper supply means to supply either of the wrappers to the wrapping region; when only one of the wrappers has the size within the usable range for wrapping the commodity, it drives the wrapper supply means to supply the usable wrapper to the wrapping region; when neither of the sizes of the wrappers is within the usable range for wrapping the commodity, it displays the size of the wrapper capable of wrapping the commodity on the display means, and a wrapper folding means, provided near the vicinity of the wrapping region, that wraps the commodity in the wrapping region with the wrapper supplied from the wrapper supply means.

2. A wrapping machine as set forth in claim 1, further having a conveying means provided near the vicinity of the wrapping region and operationally connected to the control means, this conveying means carrying the commodity wrapped with the wrapper, and a tape disposing means, provided below the conveying means, having a tape disposing center located on the conveying means, extending along the length of the commodity, this tape disposing means applying tapes on the bottom surface of the commodity positioned on the conveying means, these tapes being applied relative to the tape applying center across the seams extending along the length of the commodity, the wrapper supply means supplying a wrapper along the width of the commodity in the wrapping region, the control means regulating the amount of supply of the wrapper in the wrapping region according to the width and height of the commodity, and to the length of the wrapper relative to the supplying direction of the wrapper, the same control means also calculating the position of the seam of the wrapper on the bottom surface of the commodity along the direction of the width of the commodity according to the width and height of the commodity and to the amount of supply of the wrapper, hence determining the amount of conveyance of the commodity by the conveying means such that the seam of the wrapper is positioned on the tape disposing center of the tape disposing means.

3. A wrapping machine as set forth in claim 1, in which the wrapper folding means has a pair of movable bottom surface first folding plates provided on the front and rear sides of the commodity positioned on the wrapping region, such that they fold the wrapper along the bottom surface of the commodity from its front and rear surfaces, a pair of movable bottom surface front second folding plates provided on the left and right sides of the front surface of the commodity positioned on the wrapping region, such that they fold the wrapper along the bottom surface of the commodity from its left and right surfaces, a pair of movable bottom surface rear second folding plates provided on the left and right sides of the rear surface of the commodity positioned on the wrapping region, such that they fold the wrapper along the bottom surface of the commodity from its left and right surfaces, a pair of movable front surface first folding plates provided on the left and right sides of the front surface of the commodity positioned on the wrapping region, such that they fold the wrapper along the front surface of the commodity from its left and right surfaces, a pair of movable rear surface first folding plates provided on the left and right sides of the rear surface of the commodity positioned on the wrapping region, such that they fold the wrapper along the rear surface of the commodity from its left and right surfaces, a movable front surface second folding plate provided in front of the front surface of the commodity positioned on the wrapping region, such that it folds the wrapper from the front surface toward the rear surface of the commodity, a movable rear surface second folding plate provided behind the rear surface of the commodity positioned on the wrapping region, such that it folds the wrapper from the rear surface toward the front surface of the commodity, a first interval adjusting means, connected to the folding plates mentioned above, that adjusts a first interval between the bottom surface front second folding plates, a second interval between the bottom surface rear second folding plates, a third interval between the front surface first folding plates, and a fourth interval between the rear surface first folding plates relative to the central position on the wrapping region, according to the length of the commodity, and a second interval adjusting means, connected to the folding plates mentioned above, that adjusts a fifth interval between the bottom surface front second folding plates and the bottom surface rear second folding plates, and a sixth interval between the front surface first folding plates and rear surface first folding plates relative to the reference wrapping position of the wrapping region, according to the width of the commodity, the control means being operationally connected to the first and second interval adjusting means, controlling the operation of the first adjusting means according to the length of the commodity, and controlling the second adjusting means according to the width of the commodity.

4. A wrapping machine as set forth in claim 3, that has a first linking means connected to the first adjusting means, operating the first adjusting means such that the first adjusting means adjusts the first to the fourth intervals simultaneously according to the length of the commodity, and a second linking means connected to the second adjusting means, operating the second adjusting means such that the second adjusting means adjusts the fifth and sixth intervals simultaneously according to the width of the commodity.

5. A wrapping machine as set forth in claim 1, in which the wrapper supply means has support bases, each holding a pile of wrappers of different sizes, pressing pieces provided on the support bases at the tip from which the wrappers are supplied, pressing the end portions of the wrappers, and rotatable rollers, rotatable clockwise and counterclockwise, provided on the support bases at the end portions of the wrappers and making contact with the wrappers.

6. A wrapping machine used to wrap with a prescribed wrapper a commodity having the shape of the hexahedron having a length, a width, and a height, as well as a top surface, bottom surface, a front surface, a rear surface, a left side surface, and a right side surface, in this wrapping machine, the commodity is wrapped in a wrapping region, this wrapping region having a central position along the length of the commodity and a reference wrapping position along the width of the commodity, the wrapping machine further comprising:

a commodity receiving base means provided below the wrapping region, capable of descending relative to the wrapping region, this commodity receiving base means having at least two first support shields provided facing each other from both sides of the central position on the wrapping region, capable of approaching and moving away from said central position, second support shields disposed near the first support shields, capable of approaching and moving away from the reference wrapping position along the direction of the width of the commodity, a first interval adjusting means that adjusts a first interval between the first support shields relative to the central position according to the length of the commodity, and a second interval adjusting means that adjusts a second interval between the second support shields relative to the reference wrapping position according to the width of the commodity, a commodity conveying means provided below the wrapping region, this commodity conveying means carrying the commodity to the reference wrapping position on the wrapping region during the descent of the commodity receiving base means, placing the commodity on the first and second support shields of the commodity receiving base means, a wrapper conveying means, provided near the wrapping region, that carries the wrapper to the wrapping region, this wrapper conveying means having a pair of carrying portions provided facing each other from both sides of the central position of the wrapping region and extending along the direction of the width of the commodity, and a third interval adjusting means that adjusts a third interval between the carrying portions relative to the central position according to the length of the commodity, the wrapper being carried to the reference wrapping position on the wrapping region, it ends in the direction of its length held by the carrying portions, the wrapper being carried and raised by the commodity as the commodity receiving base mechanism on which the commodity is resting ascends, a wrapper folding means having:

a pair of movable bottom surface first folding plates provided on the front and rear sides of the commodity positioned on the wrapping region, such that they fold the wrapper along the bottom surface of the commodity from its front and rear surfaces, a pair of movable surface front second folding plates provided on the left and right sides of the front surface of the commodity positioned on the wrapping region, such that they fold the wrapper along the bottom surface of the commodity from its left and right surfaces, a pair of movable bottom surface rear second folding plates provided on the left and right sides of the rear surface of the commodity positioned on the wrapping region, such that they fold the wrapper along the bottom surface of the commodity from its left and right surfaces, a pair of movable front surface first folding plates provided on the left and right sides of the front surface of the commodity positioned on the wrapping region, such that they fold the wrapper along the front surface of the commodity from its left and right surfaces, a pair of movable rear surface first folding plates provided on the left and right sides of the rear surface of the commodity positioned on the wrapping region, such that they fold the wrapper along the rear surface of the commodity from its left and right surfaces, a movable front surface second folding plate provided in front of the front surface of the commodity positioned on the wrapping region, such that it folds the wrapper from the front surface toward the rear surface of the commodity, a movable rear surface folding plate provided behind the rear surface of the commodity positioned on the wrapping region, such that it folds the wrapper from the rear surface toward the front surface of the commodity, a fourth interval adjusting means, connected to the folding plates mentioned above, that adjusts a fourth interval between the bottom surface front second folding plates, a fifth interval between the bottom surface rear second folding plates, a sixth interval between the front surface first folding plates, and a seventh interval between the rear surface first folding plates relative to the central position on the wrapping region, according to the length of the commodity, and a fifth interval adjusting means, connected to the folding plates mentioned above, that adjusts an eighth interval between the bottom surface front second folding plates and the bottom surface rear second folding plates, and a ninth interval between the front surface first folding plates and rear surface first folding plates relative to the reference wrapping position of the wrapping region, according to the width of the commodity, a first linking means connected to the first, third, and fourth adjusting means, linking the first, third and fourth adjusting means such that the first, third and fourth adjusting means adjust the first, third, and fourth to the seventh intervals simultaneously according to the length of the commodity, and a second linking means connected to the second and fifth adjusting means, linking the second and fifth adjusting means such that the second and fifth adjusting means adjust the second, eight, and ninth intervals simultaneously according to the width of the commodity.

7. A wrapping machine as set forth in claim 6, in which the wrapper conveying means further has a pair of guide plates mounted on the carrying portions, extending along the length of said carrying portions, guiding the commodity on the commodity conveying means, the wrapping machine adjusting the third interval between the carrying portions, simultaneous with the adjustment of the interval between the guide plates.

8. A wrapping machine as set forth in claim 6, in which the second support shields of the commodity receiving base means are provided on the commodity carrying means side; during the ascent of the commodity receiving base means, the second support shields makes contact with the rear surface of the commodity carried by the commodity conveying means toward the commodity receiving base means, the commodity being stopped right in front of the commodity receiving base means.

9. A wrapping machine as set forth in claim 1, further comprising:

a conveying means, provided near the wrapping region, that carries the commodity having a wrapper folded around it, a tape disposing means provided below the conveying means, this tape disposing means having a tape mounting portion provided below the conveying means, a tape mounted on the tape mounting portion such that the tape is capable of being drawn out; an arm mounted below the conveying means via a shaft, and tiltable in the direction of the width of the commodity; a tape guide portion provided on the arm, enabling the maintenance of the supply of the tape drawn from the tape mounting portion to the conveying means; a cutter provided near the arm, below the conveying means; and a tape drawing mouth provided on the tape guide portion, this tape drawing mouth being capable of reciprocating motion, with the tilting of the arm, between the first position making contact with the bottom surface of the commodity on the conveying means and the second position near the cutter, at said first position an end of the tape being drawn from the tape drawing mouth toward the commodity on the conveying means, the tape being applied on the wrapper on the bottom surface side of the commodity while the tape drawing mouth moves from the first position to the second position, the tape being cut by the cutter at said second position.

10. A wrapping machine as set forth in claim 6, in which the carrying portions of the wrapper conveying means comprises a pair of conveyor belts provided on both sides of the wrapper, the wrapper conveying means further having crease marking pieces provided near the facing inner edge portions of the conveyor belts, these crease marking pieces comprising recessed portions and protruding portions provided on both sides of the wrapper, creases being formed on the wrapper on both ends along its length while the wrapper, inserted between the conveyor belts, pass between the crease marking pieces.

11. A wrapping machine as set forth in claim 10, in which the crease marking pieces are connected such that they can be linked to the carrying portions, the third interval between the carrying portions being adjusted together with the adjustment of the interval between the crease marking pieces.

12. A wrapping machine used to wrap with a prescribed wrapper a commodity having the shape of a hexadron having a length, a width, and a height, as well as a top surface, a bottom surface, a front surface, a rear surface, a right side surface, and a left side surface, in this wrapping machine, the commodity being wrapped in a wrapping region, this wrapping region having a central position along the length of the commodity, and a reference wrapping position along the width of the commodity, the wrapping machine further comprising:

a wrapper supply means that holds wrappers and supplies the wrapper to the wrapping region, a sensing means, provided in the wrapper supply means, that detects the size of the wrapper, a control means electrically connected to the sensing means, as well as operationally connected to the wrapper supply means; this control means has a display means, and it determines whether the size of the wrapper is within the usable range for wrapping the commodity or not; when the wrapper has the size within the usable range for wrapping the commodity, it drives the wrapper supply means to supply the wrapper to the wrapping region; when the size of the wrapper is out of the usable range for wrapping the commodity, it displays the size of the wrapper capable of wrapping the commodity on the display means, and a wrapper folding means, provided near the vicinity of the wrapping region, that wraps the commodity in the wrapping region with the wrapper supplied from the wrapper supply means.

* * * * *